US007341325B2

(12) United States Patent
Shinkawa

(10) Patent No.: US 7,341,325 B2
(45) **Date of Patent: *Mar. 11, 2008**

(54) DROPLET EJECTION APPARATUS AND METHOD OF DETECTING EJECTION FAILURE IN DROPLET EJECTION HEADS

(75) Inventor: Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 259 days.

This patent is subject to a terminal disclaimer.

(21) Appl. No.: 10/807,920

(22) Filed: Mar. 24, 2004

(65) Prior Publication Data

US 2005/0062781 A1 Mar. 24, 2005

(30) Foreign Application Priority Data

Mar. 28, 2003 (JP) ..... 2003-092935

(51) Int. Cl.
*B41J 29/393* (2006.01)

(52) U.S. Cl. ..... 347/19; 347/23; 347/54

(58) Field of Classification Search ..... 347/19
See application file for complete search history.

(56) References Cited

U.S. PATENT DOCUMENTS 4,034,380 A 7/1977 Isayama
4,301,459 A 11/1981 Isayama et al.
4,484,199 A 11/1984 Watanabe
4,498,088 A 2/1985 Kanayama
4,577,203 A * 3/1986 Kawamura ..... 347/30
4,625,220 A 11/1986 Nagashima
4,695,852 A 9/1987 Scardovi
4,768,045 A 8/1988 Koto
5,072,235 A 12/1991 Slowik et al.

(Continued)

FOREIGN PATENT DOCUMENTS

CN 1103029 5/1995

(Continued)

OTHER PUBLICATIONS

Communication from European Patent Office re: counterpart application No. 04004519.7.

(Continued)

*Primary Examiner*—Matthew Luu
*Assistant Examiner*—Brian J. Goldberg
(74) *Attorney, Agent, or Firm*—Harness, Dickey & Pierce, P.L.C.

(57) ABSTRACT

It is an object of the invention to provide a droplet ejection apparatus and a method of detecting an ejection failure in droplet ejection heads capable of detecting an ejection failure in the droplet ejection heads by counting the number of reference pulses generated for a predetermined time period after a droplet ejection operation. The droplet ejection apparatus of the invention includes: a plurality of droplet ejection heads, each of the droplet ejection heads including a diaphragm, an actuator which displaces the diaphragm; a driving circuit which drives the actuator of each droplet ejection head; pulse generating means for generating reference pulses; a subtraction counter for counting the number of reference pulses generated for a predetermined time period; and ejection failure detecting means for detecting an ejection failure of the droplets on the basis of the count value of the counter counted for the predetermined time period.

19 Claims, 37 Drawing Sheets

U.S. PATENT DOCUMENTS

| | | | | |
|---|---|---|---|---|
| 5,371,528 | A | 12/1994 | Izumida et al. | |
| 5,379,061 | A * | 1/1995 | Yamaguchi et al. | 347/23 |
| 5,500,657 | A | 3/1996 | Yauchi et al. | |
| 5,563,634 | A | 10/1996 | Fujii et al. | |
| 5,581,287 | A | 12/1996 | Baezner et al. | |
| 5,731,826 | A | 3/1998 | Hirano | |
| 5,818,473 | A | 10/1998 | Fujii et al. | |
| 5,975,668 | A * | 11/1999 | Fujii et al. | 347/10 |
| 5,995,801 | A | 11/1999 | Katsuta et al. | |
| 6,010,205 | A | 1/2000 | Billet | |
| 6,048,045 | A | 4/2000 | Nohata et al. | |
| 6,076,914 | A | 6/2000 | Imai | |
| 6,145,966 | A | 11/2000 | Hotomi et al. | |
| 6,168,263 | B1 | 1/2001 | Nojima et al. | |
| 6,174,038 | B1 * | 1/2001 | Nakazawa et al. | 347/10 |
| 6,220,692 | B1 | 4/2001 | Iwaya et al. | |
| 6,238,112 | B1 | 5/2001 | Girones et al. | |
| 6,257,694 | B1 | 7/2001 | Tokumaru et al. | |
| 6,299,277 | B1 * | 10/2001 | Fujii | 347/23 |
| 6,322,190 | B1 | 11/2001 | Kono et al. | |
| 6,364,452 | B1 * | 4/2002 | Noyes et al. | 347/43 |
| 6,375,299 | B1 | 4/2002 | Foster et al. | |
| 6,565,185 | B1 | 5/2003 | Endo | |
| 6,811,238 | B2 | 11/2004 | Shingyohuchi | |
| 6,820,955 | B1 | 11/2004 | Usui | |
| 2001/0007460 | A1 * | 7/2001 | Fujii et al. | 347/54 |
| 2002/0018090 | A1 * | 2/2002 | Takazawa et al. | 347/19 |
| 2002/0021325 | A1 | 2/2002 | Koitabashi et al. | |
| 2002/0027575 | A1 | 3/2002 | Bruch et al. | |
| 2002/0036667 | A1 | 3/2002 | Shingyohuchi | |
| 2002/0039120 | A1 | 4/2002 | Otsuka et al. | |
| 2002/0089562 | A1 | 7/2002 | Simons et al. | |
| 2002/0105555 | A1 | 8/2002 | Tsukada et al. | |
| 2002/0130918 | A1 | 9/2002 | Hayakawa et al. | |
| 2002/0144550 | A1 * | 10/2002 | Nishihara | 73/651 |
| 2002/0149657 | A1 * | 10/2002 | Ishinaga et al. | 347/100 |
| 2002/0170353 | A1 | 11/2002 | Usui et al. | |
| 2003/0007032 | A1 | 1/2003 | Ho | |
| 2003/0043216 | A1 | 3/2003 | Usui et al. | |
| 2003/0146742 | A1 * | 8/2003 | Nishida et al. | 324/76.11 |
| 2003/0156149 | A1 | 8/2003 | Choi | |
| 2004/0001116 | A1 | 1/2004 | Wouters et al. | |
| 2004/0056915 | A1 | 3/2004 | Miyazawa | |
| 2004/0165016 | A1 | 8/2004 | Oyen | |
| 2004/0223027 | A1 * | 11/2004 | Shinkawa et al. | 347/23 |
| 2004/0239714 | A1 * | 12/2004 | Sakagami et al. | 347/19 |
| 2004/0252144 | A1 | 12/2004 | Higuchi et al. | |
| 2005/0122360 | A1 * | 6/2005 | Sakagami et al. | 347/19 |
| 2005/0128232 | A1 | 6/2005 | Shinkawa | |
| 2005/0128323 | A1 | 6/2005 | Choi | |

FOREIGN PATENT DOCUMENTS

| | | | | |
|---|---|---|---|---|
| CN | 1241490 | | 1/2000 | |
| EP | 0933215 | | 8/1999 | |
| EP | 0985533 | A1 | 3/2000 | |
| EP | 1147900 | | 10/2001 | |
| EP | 1211078 | | 6/2002 | |
| JP | 63-141750 | | 6/1988 | |
| JP | 63141750 | * | 6/1988 | 347/19 |
| JP | 02-003323 | | 1/1990 | |
| JP | 06-122206 | | 5/1994 | |
| JP | 08-309963 | | 11/1996 | |
| JP | 11-334102 | | 12/1999 | |
| JP | 2000-272116 | | 10/2000 | |
| JP | 2000-351204 | | 12/2000 | |
| JP | 2002-187263 | | 7/2002 | |

OTHER PUBLICATIONS

Communication from European Patent Office re: counterpart application No. 04004518.9.

Communication from PCT re: corresponding International Application No. PCT/JP2004/002401.

Communication from PCT re: corresponding International Application No. PCT/JP2004/002405.

Communication from PCT re: corresponding International Application No. PCT/JP2004/002400.

Communication from PCT re: corresponding International Application No. PCT/JP2004/002403.

Communication from PCT re: corresponding International Application No. PCT/JP2004/002414.

Communication from PCT re: corresponding International Application No. PCT/JP2004/002390.

Communication from PCT re: corresponding International Application No. PCT/JP2004/002437.

Communication from PCT re: corresponding International Application No. PCT/JP2004/002443.

Patent abstracts of Japan regarding Publication No. 08-309963 published Nov. 26, 1996.

Communication from China Patent Office regarding counterpart application.

* cited by examiner (a) Before Adhesion of Paper Dust (b) After Adhesion of Paper Dust Table 1 (Example of Judgment of Cause of Ejection Failure)

| | Reference Value P1 | ReferenceValue N1 | ReferenceValue N2 |
|---|---|---|---|
| Normal Ejection | 0 | 0 | 0 |
| Drying | 0 | 1 | 1 |
| Adhesion of Paper Dust | 0 | 1 | 0 |
| Intrusion of Air Bubble | 1 | 0 | 0 |

Fig. 28

Table 2 (Example until 1/2 Cycle)

| | Ts | T (1/2) |
|---|---|---|
| Normal Ejection | 0 0 0 | 0 0 0 |
| Drying | 0 1 1 | 0 1 1 |
| Adhesion of Paper Dust | 0 1 0 | 0 1 0 |
| Intrusion of Air Bubble | 1 0 0 | 1 0 0 |

Fig. 33

DROPLET EJECTION APPARATUS AND METHOD OF DETECTING EJECTION FAILURE IN DROPLET EJECTION HEADS

BACKGROUND OF THE INVENTION

1. Technical Field

The present invention relates to a droplet ejection apparatus and a method of judging an ejection failure in droplet ejection heads.

2. Background Art

An ink jet printer, which is one type of droplet ejection apparatus, forms an image on a predetermined sheet of paper by ejecting ink drops (droplets) via a plurality of nozzles of a printing head of the ink jet printer. The printing head (ink jet head) of the ink jet printer is provided with a number of nozzles. However, there is a case where some of the nozzles are blocked due to an increase of ink viscosity, intrusion of air bubbles, adhesion of dust or paper dust, or the like, and therefore, these nozzles become unable to eject ink droplets. When the nozzles are blocked, missing dots occur within a printed image, which results in deterioration of image quality.

As far, a method of optically detecting a state where no ink droplets are ejected through the nozzles of the ink jet head (a state of failing ink droplet ejection) for each nozzle of the ink jet head was devised as a method of detecting such an ejection failure of an ink droplet (hereinafter, also referred to as the missing dot) (for example, Japanese Laid-Open Patent Application No. Hei. 8-309963 or the like). This method makes it possible to identify a nozzle causing the missing dot (ejection failure).

In the optical missing dot (droplet ejection failure) detecting method described above, however, a detector including a light source and an optical sensor is attached to a droplet ejection apparatus (for example, an ink jet printer). Hence, this detecting method generally has a problem that the light source and the optical sensor have to be set (or provided) with exact accuracy (high degree of accuracy) so that droplets ejected through the nozzles of the droplet ejection head (ink jet head) pass through a space between the light source and the optical sensor and therefore intercept light from the light source to the optical sensor. In addition, since such a detector is generally expensive, the droplet ejection apparatus having the detector has another problem that the manufacturing costs of the ink jet printer are increased. Further, since an output portion of the light source or a detection portion of the optical sensor may be smeared by ink mist through the nozzles or paper dust from printing sheets or the like, there is a possibility that the reliability of the detector becomes a matter of concern.

Further, although the optical missing dot detecting method described above can detect the missing dot, that is, an ejection failure (non-ejection) of ink droplets of the nozzles, the cause of the missing dot (ejection failure) cannot be identified (judged) on the basis of the detection result. Hence, there is another problem that it is impossible to select and carry out appropriate recovery processing depending on the cause of the missing dot (ejection failure). For this reason, for example, ink may be pump-sucked (vacuumed) from the ink jet head under circumstances where a wiping process might be sufficient for recovery. This increases discharged ink (wasted ink), or causes several types of recovery processing to be carried out because appropriate recovery processing is not carried out, and thereby reduces or deteriorates throughput of the ink jet printer (droplet ejection apparatus).

SUMMARY OF THE INVENTION

It is an object of the invention to provide a droplet ejection apparatus and a method of detecting an ejection failure in droplet ejection heads capable of detecting an ejection failure in the droplet ejection heads by counting the number of reference pulses generated for a predetermined time period after a droplet ejection operation.

In order to achieve the above object, in one aspect of the invention, the invention is directed to a droplet ejection apparatus. The droplet ejection apparatus of the invention includes:

- a plurality of droplet ejection heads, each of the droplet ejection heads including:
  - a diaphragm;
  - an actuator which displaces the diaphragm;
  - a cavity filled with a liquid, an internal pressure of the cavity being increased and decreased in response to displacement of the diaphragm; and
  - a nozzle communicated with the cavity, through which the liquid is ejected in the form of droplets in response to the increase and decrease of the internal pressure of the cavity;
- a driving circuit which drives the actuator of each droplet ejection head;
- pulse generating means for generating reference pulses;
- a counter for counting the number of reference pulses generated for a predetermined time period; and
- ejection failure detecting means for detecting an ejection failure of the droplets on the basis of the count value of the counter counted for the predetermined time period.

In the droplet ejection apparatus of the invention, when the operation in which the liquid is ejected as droplets is carried out by the driving of the actuator, the pulses generating in the predetermined time period are counted, and it is detected whether the droplet has been ejected normally or not on the basis of the counted value.

Therefore, according to the droplet ejection apparatus of the invention, in comparison with the conventional droplet ejection apparatus capable of detecting an ejection failure, the droplet ejection apparatus of the invention does not need other parts (for example, optical missing dot detecting device or the like). As a result, not only an ejection failure of the droplets can be detected without increasing the size of the droplet ejection head, but also the manufacturing costs of the droplet ejection apparatus capable of carrying out an ejection failure (missing dot) detecting operation can be reduced. In addition, because the droplet ejection apparatus of the invention detects an ejection failure of the droplets through the use of the residual vibration of the diaphragm after the droplet ejection operation, an ejection failure of the droplets can be detected even during the recording operation.

The residual vibration of the diaphragm referred to herein means a state in which the diaphragm keeps vibrating while damping due to the droplet ejection operation after the actuator carried out the droplet ejection operation according to a driving signal (voltage signal) from the driving circuit until the actuator carries out the droplet ejection operation again in response to input of the following driving signal.

It is preferable that the predetermined time period is a time period until a residual vibration of the diaphragm displaced by the actuator is generated after the droplet has been normally ejected from the droplet ejection head, or a time period corresponding to a first half cycle of the residual vibration or a time period corresponding to a first one cycle of the residual vibration. Further, it is preferable that the ejection failure detecting means detects presence or absence of the ejection failure by comparing a normal count range of the reference pulses when a droplet is normally ejected by the driving of the actuator with a count value of the counter counted for the predetermined time period.

In this case, it is preferable that the ejection failure detecting means judges that an air bubble has been intruded into the cavity as a cause of the ejection failure in the case where the count value is smaller than the normal count range, and judges that the liquid in the vicinity of the nozzle has thickened due to drying or that paper dust is adhering in the vicinity of the outlet of the nozzle as a cause of the ejection failure in the case where the count value is larger than the normal count range.

It is preferable that the counter subtracts the number of reference pulses counted for the predetermined time period from a predetermined reference value, and the ejection failure detecting means detects the ejection failure on the basis of the subtraction result. In this case, it is preferable that the ejection failure detecting means judges that an air bubble has intruded into the cavity as a cause of the ejection failure in the case where the subtraction result is smaller than a first threshold, that the liquid in the vicinity of the nozzle has thickened due to drying as a cause of the ejection failure in the case where the subtraction result is larger than a second threshold, and that paper dust is adhering in the vicinity of the outlet of the nozzle as a cause of the ejection failure in the case where the subtraction result is smaller than the second threshold and larger than a third threshold. In this regard, in the invention, "paper dust" is not limited to mere paper dust generated from a recording sheet or the like. For example, the "paper dust" includes all the substances that could adhere in the vicinity of the nozzles and impede ejection of droplets, such as pieces of rubber from the advancing roller (feeding roller) and dust afloat in air.

Moreover, it is preferable that the droplet ejection apparatus of the invention further includes storage means for storing the detection result detected by the ejection failure detecting means. Furthermore, it is preferable that the droplet ejection apparatus of the invention further includes switching means for switching a connection of the actuator from the driving circuit to the ejection failure detecting means after carrying out a droplet ejection operation by driving the actuator.

Further, it is preferable that the ejection failure detecting means includes an oscillation circuit and the oscillation circuit oscillates in response to an electric capacitance component of the actuator that varies with the residual vibration of the diaphragm. In this case, it is preferable that the ejection failure detecting means includes a resistor element connected to the actuator, and the oscillation circuit forms a CR oscillation circuit based on the electric capacitance component of the actuator and a resistance component of the resistor element. Further, it is preferable that the ejection failure detecting means includes an F/V converting circuit that generates a voltage waveform in response to the residual vibration of the diaphragm from a predetermined group of signals generated based on changes in an oscillation frequency of an output signal from the oscillation circuit. Moreover, it is preferable that the ejection failure detecting means includes a waveform shaping circuit that shapes the voltage waveform in response to the residual vibration of the diaphragm generated by the F/V converting circuit into a predetermined waveform. In this case, it is preferable that the waveform shaping circuit includes: DC component eliminating means for eliminating a direct current component from the voltage waveform of the residual vibration of the diaphragm generated by the F/V converting circuit; and a comparator that compares the voltage waveform from which the direct current component thereof has been eliminated by the DC component eliminating means with a predetermined voltage value; and that the comparator generates and outputs a rectangular wave based on this voltage comparison.

In this regard, it is preferable that the actuator includes an electrostatic actuator and a piezoelectric actuator having a piezoelectric element and using a piezoelectric effect of the piezoelectric element. Because the droplet ejection apparatus of the invention can be utilized in not only an electrostatic actuator constituted from the capacitor described above but also a piezoelectric actuator, it is possible to apply the invention to most existing droplet ejection apparatuses. Furthermore, it is preferable that the droplet ejection apparatus of the invention includes an ink jet printer.

In another embodiment of the invention, a droplet ejection apparatus of the invention includes:

- a plurality of droplet ejection heads, each of the droplet ejection heads including:
  - a cavity filled with a liquid;
  - a nozzle communicated with the cavity; and
  - a piezoelectric actuator for varying a pressure of the liquid filled in the cavity, the liquid being ejected through the nozzle in the form of droplets in response to the variation of the pressure;
- a driving circuit which drives the piezoelectric actuator of each droplet ejection head;
- pulse generating means for generating reference pulses;
- a counter for counting the number of reference pulses generated for a predetermined time period; and
- ejection failure detecting means for detecting an ejection failure of the droplets on the basis of the count value of the counter counted for the predetermined time period.

In this way, according to the droplet ejection apparatus of the invention, it is possible to adopt the same configuration as described above with the use of the electromotive voltage of the piezoelectric actuator. In this case, it is preferable that the predetermined time period is a time period until the residual vibration of an electromotive voltage of the piezoelectric actuator is generated after the droplet has been normally ejected from the droplet ejection head. Further, it is preferable that the droplet ejection apparatus includes an ink jet printer.

In another aspect of the invention, the invention is directed to a method of detecting an ejection failure in droplet ejection heads. Each of the droplet ejection heads includes a diaphragm, an actuator, a cavity and a nozzle. The method includes the steps of:

- carrying out a droplet ejection operation in which a liquid in the cavity is ejected through the nozzle in the form of droplets by displacement of the diaphragm by driving the actuator;
- generating reference pulses and measuring a predetermined time period after the droplet ejection operation;
- counting the number of reference pulses generated for the measured predetermined time period; and
- detecting an ejection failure of the droplets on the basis of the count value in the counting step.

In this case, it is preferable that the counting step includes subtracting the number of reference pulses counted for the predetermined time period from a predetermined reference value; and that the ejection failure detecting step includes detecting the ejection failure on the basis of the subtraction result.

Further, in another embodiment of the invention, the invention is directed to a method of detecting an ejection failure in droplet ejection heads. Each of the droplet ejection heads includes a cavity, a nozzle and a piezoelectric actuator. The method includes the steps of:

carrying out a droplet ejection operation in which a liquid in the cavity is ejected through the nozzle in the form of droplets by driving the piezoelectric actuator;

generating reference pulses and measuring a predetermined time period after the droplet ejection operation;

counting the number of reference pulses generated for the measured predetermined time period; and detecting an ejection failure of the droplets on the basis of the count value in the counting step.

BRIEF DESCRIPTION OF THE DRAWINGS

The above and other objects, features, and the advantages of the invention will readily become more apparent from the following detailed description of preferred embodiments of the invention with reference to the accompanying drawings.

FIG. 28 is one example of judging result of the cause of the ejection failure in the residual vibration detection processing of the invention.

FIG. 33 is a table showing a relationship between a time period until the generation of the residual vibration, a half cycle of the residual vibration, and causes of the ejection failure.

DETAILED DESCRIPTION OF THE PREFERRED EMBODIMENTS

Preferred embodiments of a droplet ejection apparatus and a method of detecting an ejection failure in droplet ejection heads of the invention will now be described in detail with reference to FIGS. 1-38. It is to be understood that these embodiments are mentioned for the purpose of illustration of the invention and interpretations of the content of the invention are not limited to these embodiments. It should be noted that, in the embodiments described below, an ink jet printer that prints an image on a recording sheet (droplet receptor) by ejecting ink (liquid material) will be described as one example of the droplet ejection apparatus of the invention.

First Embodiment

Figure 1:
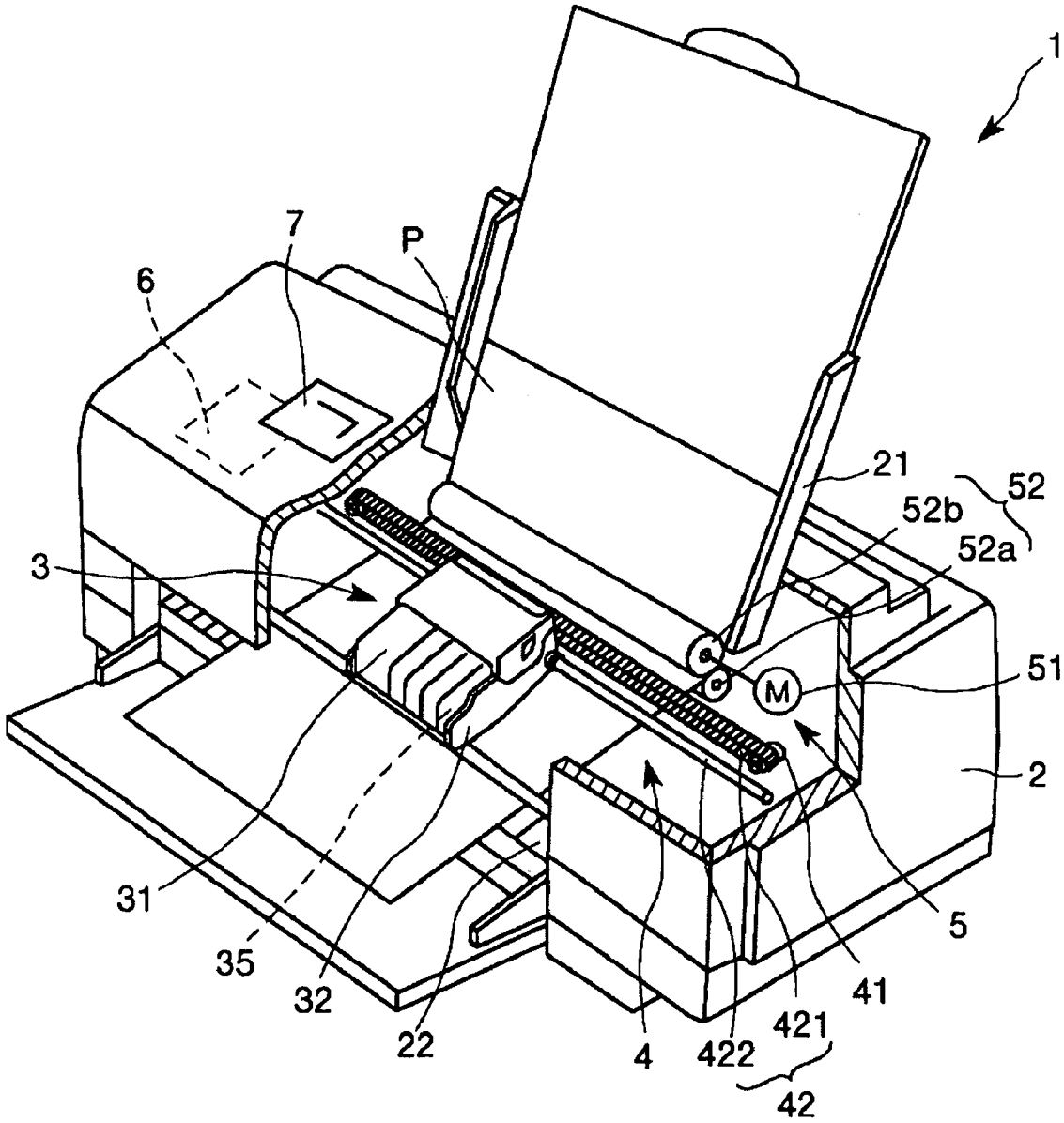
FIG. 1 is a schematic view showing the configuration of an ink jet printer as one type of droplet ejection apparatus of the invention.

FIG. 1 is a schematic view showing the configuration of an ink jet printer 1 as one type of droplet ejection apparatus according to a first embodiment of the invention. Now, in following explanations using FIG. 1, an upper side and lower side are referred to as "upper" and "lower," respectively. First, the configuration of the ink jet printer 1 will be described.

The ink jet printer 1 shown in FIG. 1 includes a main body 2. A tray 21 on which recording sheets P may be placed, a sheet discharge port 22, through which the recording sheet P is discharged, and an operation panel 7 are respectively provided in the rear of the top, in the front of the bottom, and on the top surface, of the main body 2.

The operation panel 7 is provided with a display portion (not shown) for displaying an error message or the like, such as a liquid crystal display, an organic EL display, an LED lamp or the like, and an operation portion (not shown) comprising various kinds of switches or the like.

Further, the main body 2 mainly includes a printing device 4 equipped with printing means (moving element) 3 which undergoes a reciprocating motion, a feeder (feeding means) 5 which feeds and discharges a recording sheet P to/from the printing device 4 one by one, and a control section (control means) 6 which controls the printing device 4 and the feeder 5.

The feeder 5 intermittently feeds recording sheets P one by one under the control of the control section 6. The recording sheet P passes by the vicinity of the bottom of the printing means 3. In this instance, the printing means 3 reciprocates in a direction substantially perpendicular to the feeding direction of the recording sheet P, thereby carrying out a printing operation on the recording sheet P. In other words, the printing operation by the ink jet method is carried out so that the reciprocating motion of the printing means 3 and the intermittent feeding of the recording sheet P constitute the main scanning and the sub scanning of printing, respectively.

The printing device 4 is provided with the printing means 3, a carriage motor 41 serving as a driving source for moving the printing means 3 (making it to reciprocate) in the main scanning direction, and a reciprocating mechanism 42 which receives rotations of the carriage motor 41 and making the printing means 3 to reciprocate in the main scanning direction.

The printing means 3 includes a plurality of head units 35 on which a plurality of nozzles 110 are provided in accordance with ink types, a plurality of ink cartridges (I/C) 31 each respectively supplying the head units 35 with inks, a carriage 32 on which the head units 35 and ink cartridges 31 are mounted.

Further, as will be described in FIG. 3, the head unit 35 is provided with a number of ink jet recording heads (i.e., ink jet heads or droplet ejection heads) 100 each comprising a nozzle 110, a diaphragm 121, an electrostatic actuator 120, a cavity 141, an ink supply port 142, and the like. In this regard, although FIG. 1 shows the configuration in which the head units 35 and the ink cartridges 31 are included, the invention is not limited to this configuration. For example, the invention may include a configuration in which the ink cartridges 31 are provided in another place instead of being mounted on the carriage 32, and communicates with the head units 35 via tubes or the like to supply inks thereto (not shown in the drawings). Hereinafter, the configuration in which the plurality of ink jet heads 100, each of which comprises the nozzle 110, the diaphragm 121, the electrostatic actuator 120, the cavity 141, the ink supply port 142, and the like, are provided will be referred to as the "head unit 35".

By using cartridges respectively filled with four colors of inks, including yellow, cyan, magenta, and black, as the ink cartridges 31, full-color printing becomes possible. In this case, the head units 35 respectively corresponding to the colors are provided in the printing means 3. Here, FIG. 1 shows four ink cartridges 31 respectively corresponding to four colors of inks, but the printing means 3 may be configured to further include an ink cartridge or ink cartridges 31 for other ink such as light cyan, light magenta, or dark yellow a special color or the like.

The reciprocating mechanism 42 includes a carriage guide shaft 422 supported by a frame (not shown) at both ends thereof, and a timing belt 421 extending in parallel with the carriage guide shaft 422.

The carriage 32 is supported by the carriage guide shaft 422 of the reciprocating mechanism 42 so as to be able to reciprocate and is fixed to a part of the timing belt 421.

When the timing belt 421 is run forward and backward via a pulley by the operation of the carriage motor 41, the printing means 3 is guided by the carriage guide shaft 422 and starts to reciprocate. During this reciprocating motion, ink droplets are ejected through the nozzles 110 of the plurality of ink jet heads 100 in the head units 35 as needed in response to image data (printing data) to be printed, thereby carrying out printing operation onto the recording sheet P.

The feeder 5 includes a feeding motor 51 serving as a driving source thereof, and a feeding roller 52 which is rotated in association with the operation of the feeding motor 51.

The feeding roller 52 comprises a driven roller **52*a* and a driving roller 52*b* which vertically face across a transportation path of a recording sheet P (i.e., a recording sheet P). The driving roller 52*b* is connected to the feeding motor 51. This allows the feeding roller 52 to feed a number of recording sheets P placed on the tray 21 to the printing device 4 one by one, and discharge the recording sheets P from the printing device 4 one by one. Instead of the tray 21**, a feeding cassette in which the recording sheets P can be housed may be removably attached.

The control section 6 carries out a printing operation on a recording sheet P by controlling the printing device 4, the feeder 5 and the like according to the printing data inputted from a host computer 8 such as a personal computer (PC), a digital camera (DC) or the like. The control section 6 also controls the display portion of the operation panel 7 to display an error message or the like, or an LED lamp or the like to be turned ON/OFF, and controls the respective portions to carry out corresponding processes according to press signals of various switches inputted from the operation portion.

Figure 2:
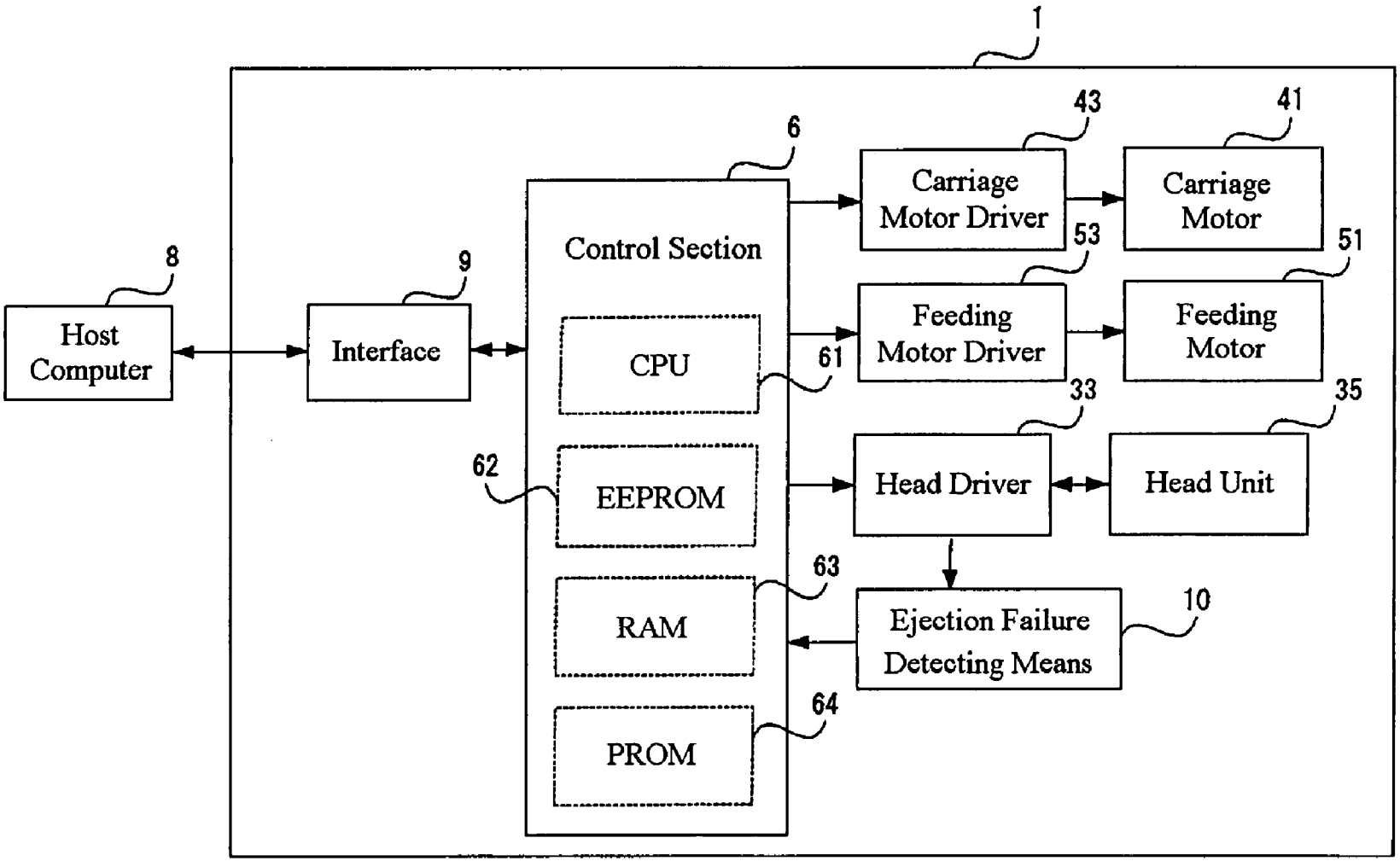
FIG. 2 is a block diagram schematically showing a major portion of the ink jet printer (droplet ejection apparatus) of the invention.

FIG. 2 is a block diagram schematically showing a major portion of the ink jet printer of the invention. Referring to FIG. 2, the ink jet printer 1 of the invention is provided with an interface portion (IF) 9 for receiving printing data or the like inputted from the host computer 8, the control section 6, the carriage motor 41, a carriage motor driver 43 for controlling the driving of the carriage motor 41, the feeding motor 51, a feeding motor driver 53 for controlling the driving of the feeding motor 51, the head units 35, a head driver 33 for controlling the driving of the head units 35, and ejection failure detecting means 10. In this regard, the ejection failure detecting means 10 and the head driver 33 will be described later in detail.

Referring to FIG. 2, the control section 6 is provided with a CPU (Central Processing Unit) 61 which carries out various types of processes such as a printing process, ejection failure detection processing or the like, an EE PROM (Electrically Erasable Programmable Read-Only Memory) (storage means) 62 as one kind of nonvolatile semiconductor memory for storing the printing data inputted from the host computer 8 via the IF 9 in a data storage region (not shown), a RAM (Random Access Memory) 63 for temporarily storing various kinds of data when the ejection failure detection processing or the like (described later) is carried out or temporarily opening up application programs for printing processes or the like, and a PROM 64 as one kind of nonvolatile semiconductor memory in which control programs and the like for controlling the respective portions are stored. The components of the control section 6 are electrically connected to each other via a bus (not shown).

As described above, the printing means 3 is provided with the plurality of head units 35 respectively corresponding to the colors of inks. Further, each head unit 35 is provided with a plurality of nozzles 110 and the plurality of electrostatic actuators 120 respectively corresponding to the nozzles 110 (i.e., the plurality of ink jet heads 100). In other words, each head unit 35 is configured to include a plurality of ink jet heads 100 (droplet ejection heads) each comprising a set including a nozzle 110 and an electrostatic actuator 120. The head driver 33 comprises a driving circuit 18 for driving the electrostatic actuators 120 of the respective ink jet heads 100 to control ejection timing of inks, and switching means 23 (see FIG. 16). In this regard, the configuration of the ink jet head 100 and the electrostatic actuator 120 will be described later.

Although it is not shown in the drawings, various kinds of sensors capable of detecting, for example, a remaining quantity of ink in each of the ink cartridges 31, the position of the printing means 3, printing environments such as temperature, humidity and the like are electrically connected to the control section 6.

When the control section 6 receives printing data from the host computer 8 via the IF 9, the control section 6 stores the printing data in the EE PROM 62. The CPU 61 then executes a predetermined process on the printing data, and outputs driving signals to each of the drivers 33, 43, and 53 according to the processed data and input data from the various kinds of sensors. When these driving signals are respectively inputted through the drivers 33, 43, and 53, the plurality of electrostatic actuators 120 corresponding to the plurality of ink jet heads. 100 in the respective head units 35, the carriage motor 41 of the printing device 4, and the feeder 5 start to operate individually. In this way, a printing operation is effected on a recording sheet P.

Figure 4:
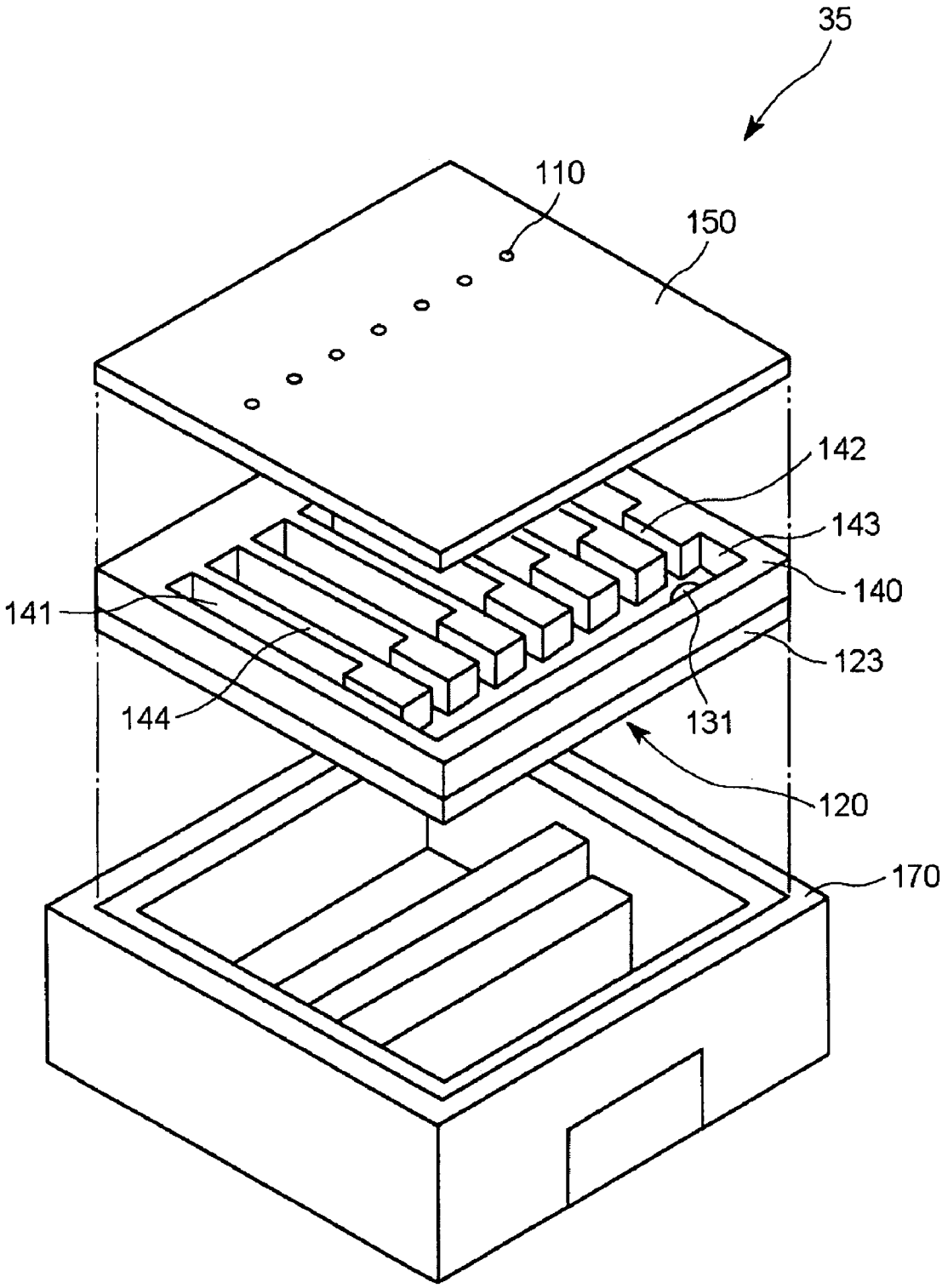
FIG. 4 is an exploded perspective view showing the configuration of the head unit shown in FIG. 1 corresponding to one color of ink.
Figure 5:
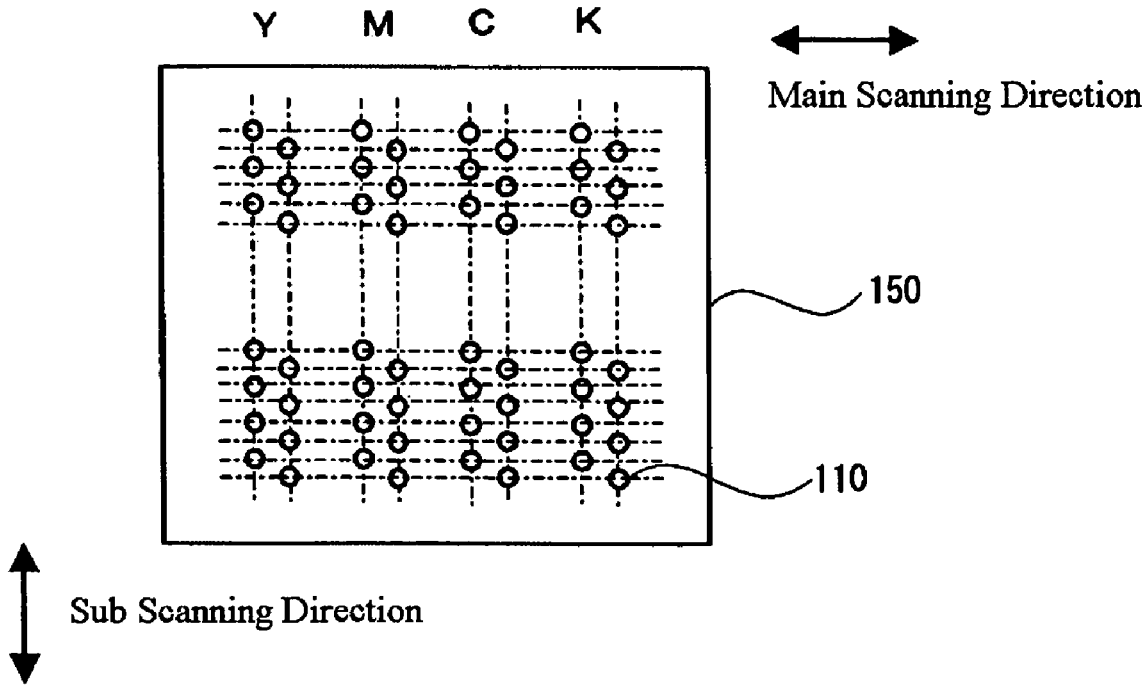
FIG. 5 shows one example of a nozzle arrangement pattern in a nozzle plate of the head unit using four colors of inks.

Next, the structure of the ink jet head 100 in each head unit 35 in the printing means 3 will now be described. FIG. 3 is a schematic cross sectional view of one ink jet head 100 in the head unit 35 shown in FIG. 1 (including common components such as the ink cartridge 31). FIG. 4 is an exploded perspective view schematically showing the configuration of the head unit 35 corresponding to one color of ink. FIG. 5 is a plan view showing an example of a nozzle surface of the printing means 3 adopting the head unit 35 in which the plurality of ink jet heads 100 are provided shown in FIG. 3. It should be noted that FIGS. 3 and 4 are shown upside down from the normally used state, and FIG. 5 is a plan view when is viewed from the top of the ink jet head 100 shown in FIG. 3.

Figure 3:
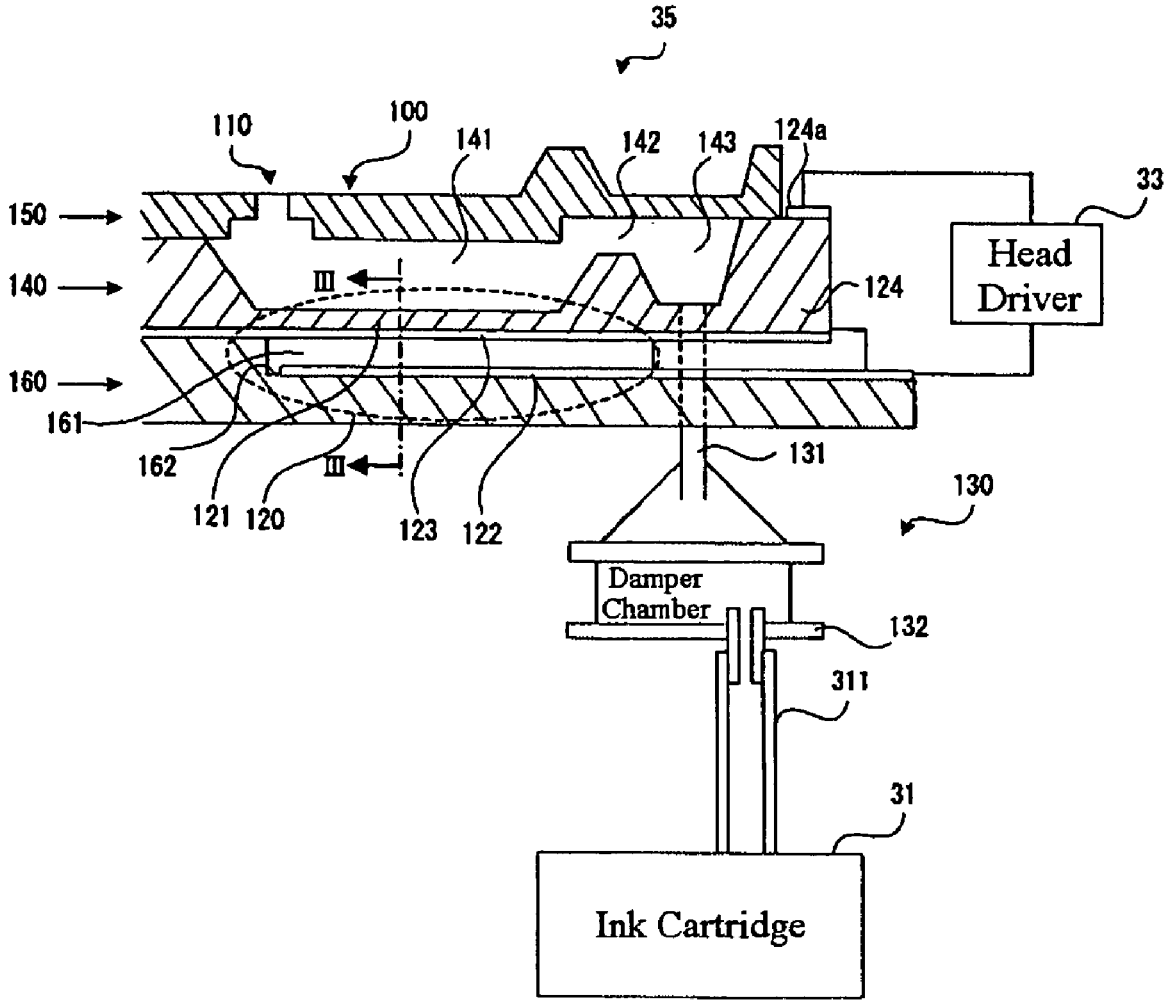
FIG. 3 is a schematic cross sectional view of an ink jet head in the ink jet printer shown in FIG. 1.

As shown in FIG. 3, the head unit 35 is connected to the ink cartridge 31 via an ink intake port 131, a damper chamber 130, and an ink supply tube 311. The damper chamber 130 is provided with a damper 132 made of rubber. The damper chamber 130 makes it possible to absorb fluctuation of ink and a change in ink pressure when the carriage 32 reciprocates, whereby it is possible to supply the respective ink jet heads 100 in the head unit 35 with a predetermined quantity of ink in a stable manner.

Further, the head unit 35 has a triple-layer structure, in which a silicon substrate 140 in the middle, a nozzle plate 150 also made of silicon, which is layered on the upper side of the silicon substrate 140 in FIG. 3, and a borosilicate glass substrate (glass substrate) 160 having a coefficient of thermal expansion close to that of silicon, which is layered on the lower side of the silicon substrate 140. A plurality of independent cavities (pressure chambers) 141 (seven cavities are shown in FIG. 4), one reservoir (common ink chamber) 143, and grooves each serving as an ink supply port (orifice) 142 that allows communication between the reservoir 143 and each of the cavities 141 are formed in the silicon substrate 140 of the middle layer. Each groove may be formed, for example, by applying an etching process from the surface of the silicon substrate 140. The nozzle plate 150, the silicon substrate 140, and the glass substrate 160 are bonded to each other in this order, whereby each of the cavities 141, the reservoir 143 and each of the ink supply ports 142 are defined therein.

Each of these cavities 141 is formed in the shape of a strip (rectangular prism), and is configured in such a manner that a volume thereof is variable with vibration (displacement) of a diaphragm 121 described later and this change in volume makes ink (liquid material) to be ejected through the nozzle (ink nozzle) 110. The nozzles 110 are respectively formed in the nozzle plate 150 at positions corresponding to the portions on the tip side of the cavities 141, and communicate with the respective cavities 141. Further, the ink intake port 131 communicating with the reservoir 143 is formed in the glass substrate 160 at a portion where the reservoir 143 is located. Ink is supplied from the ink cartridge 31 to the reservoir 143 by way of the ink supply tube 311 and the damper chamber 130 through the ink intake port 131. The ink supplied to the reservoir 143 passes through the respective ink supply ports 142 and is then supplied to the respective cavities 141 that are independent from each other. In this regard, the cavities 141 are respectively defined by the nozzle plate 150, sidewalls (partition walls) 144, and bottom walls 121.

The bottom wall 121 of each of the independent cavity 141 is formed in a thin-walled manner, and the bottom wall 121 is formed to function as a diaphragm that can undergo elastic deformation (elastic displacement) in the out-of-plane direction (its thickness direction), that is, in the vertical direction of FIG. 3. Consequently, hereinafter, the portion of this bottom wall 121 will be occasionally referred to as the diaphragm 121 for ease of explanation (in other words, the same reference numeral 121 is used for both the "bottom wall" and the "diaphragm").

Shallow concave portions 161 are respectively formed in the surface of the glass substrate 160 on the silicon substrate 140 side, at the positions corresponding to the cavities 141 in the silicon substrate 140. Thus, the bottom wall 121 of each cavity 141 faces, with a predetermined clearance in between, the surface of an opposing wall 162 of the glass substrate 160 in which the concave portions 161 are formed. In other words, a clearance (air gap) having a predetermined thickness (for example, approximately 0.2 microns) exists between the bottom wall 121 of each cavity 141 and a segment electrode 122 described later. In this case, the concave portions 161 can be formed by an etching process, for example.

The bottom wall (diaphragm) 121 of each cavity 141 forms a part of a common electrode 124 on the respective cavities 141 side for accumulating charges by a driving signal supplied from the head driver 33. In other words, the diaphragm 121 of each cavity 141 also serves as one of the counter electrodes (counter electrodes of the capacitor) in the corresponding electrostatic actuator 120 described later. The segment electrodes 122 each serving as an electrode opposing the common electrode 124 are respectively formed on the surfaces of the concave portions 161 in the glass substrate 160 so as to face the bottom walls 121 of the cavities 141. Further, as shown in FIG. 3, the surfaces of the bottom walls 121 of the respective cavities 141 are covered with an insulating layer 123 made of a silicon dioxide ($SiO_2$) film. In this manner, the bottom wall 121 of each cavity 141, that is, the diaphragm 121 and the corresponding segment electrode 122 form (constitute) the counter electrodes (counter electrodes of the capacitor) via the insulating layer 123 formed on the surface of the bottom wall 121 of the cavity 141 on the lower side of FIG. 3 and the clearance within the concave portion 161. Therefore, the diaphragm 121, the segment electrode 122, and the insulating layer 123 and the clearance therebetween form the major portion of the electrostatic actuator 120.

As shown in FIG. 3, the head driver 33 including the driving circuit 18 for applying a driving voltage between these counter electrodes carries out charge and discharge of these counter electrodes in response to a printing signal (printing data) inputted from the control section 6. One output terminal of the head driver (voltage applying means) 33 is connected to the respective segment electrodes 122, and the other output terminal is connected to an input terminal 124*a* of the common electrode 124 formed in the silicon substrate 140. Because the silicon substrate 140 is doped with impurities and therefore has conductive property by itself, it is possible to supply the common electrode 124 of the bottom walls 121 with a voltage from the input terminal 124*a* of the common electrode 124. Alternatively, for example, a thin film made of an electrically conductive material such as gold, copper, or the like may be formed on one surface of the silicon substrate 140. This makes it possible to supply a voltage (electric charges) to the common electrode 124 at low electric resistance (efficiently). This thin film may be formed, for example, by vapor deposition, sputtering, or the like. In this embodiment, for example, because the silicon substrate 140 and the glass substrate 160 are coupled (bonded) to each other through anode bonding, an electrically conductive film used as an electrode in this anode bonding is formed on the silicon substrate 140 on the channel forming surface side (i.e., on the top side of the silicon substrate 140 shown in FIG. 3). This electrically conductive film is directly used as the input terminal 124*a* of the common electrode 124. It should be appreciated, however, that in the invention, for example, the input terminal 124*a* of the common electrode 124 may be omitted and the bonding method of the silicon substrate 140 and the glass substrate 160 is not limited to the anode bonding.

As shown in FIG. 4, the head unit 35 is provided with the nozzle plate 150 in which a plurality of nozzles 110 corresponding to the plurality of ink jet heads 100 are formed, the silicon substrate (ink chamber substrate) 140 in which a plurality of cavities 141, a plurality of ink supply ports 142, and one reservoir 143 are formed, and the insulating layer 123, all of which are accommodated in a base body 170 containing the glass substrate 160. The base body 170 is made of, for example, various kinds of resin materials, various kinds of metal materials, or the like, and the silicon substrate 140 is fixed to and supported by the base body 170.

The plurality of nozzles 110 formed in the nozzle plate 150 are aligned linearly and substantially parallel to the reservoir 143 in FIG. 4 to make the illustration simple. However, the alignment pattern of the nozzles 110 is not limited to this pattern, and they are normally arranged in a manner that steps are shifted as in the nozzle alignment pattern shown in FIG. 5, for example. Further, the pitch between the nozzles 110 can be set appropriately depending on the printing resolution (dpi: dot per inch). In this regard, FIG. 5 shows the alignment pattern of the nozzles 110 in the case where four colors of ink (ink cartridges 31) are applied.

Figure 6:
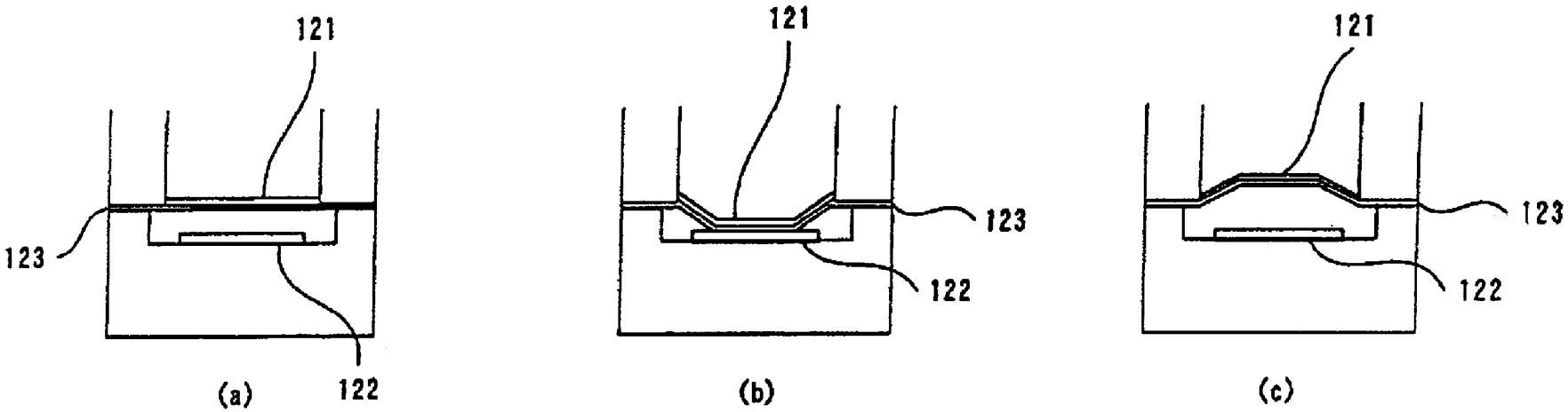
FIG. 6 is a state diagram showing respective states of a cross section taken along the line III-III of FIG. 3 when a driving signal is inputted.

FIG. 6 shows respective states of the cross section taken along the line III-III of FIG. 3 when a driving signal is inputted. When a driving voltage is applied between the counter electrodes from the head driver 33, Coulomb force is generated between the counter electrodes, whereby the bottom wall (diaphragm) 121 then bends (is attracted) towards the segment electrode 122 from the initial state (FIG. 6(*a*)) so that the volume of the cavity 141 is increased (FIG. 6(*b*)). When the electric charges between the counter electrodes are discharged abruptly at this state under the control of the head driver 33, the diaphragm 121 restores upward in the drawing due to its elastic restoring force, whereby the diaphragm 121 moves upwards above its initial position at the initial state so that the volume of the cavity 141 is contracted abruptly (FIG. 6(*c*)). At this time, a part of the ink (liquid material) filled in the cavity 141 is ejected through the nozzle 110 communicating with this cavity 141 in the form of ink droplets due to the compression pressure generated within the cavity 141.

The diaphragm 121 in each cavity 141 undergoes damped vibration continuately by this series of operations (the ink ejection operation by the driving signal from the head driver 33) until an ink droplet is ejected again when the following driving signal (driving voltage) is inputted. Hereinafter, this damped vibration is also referred to as the residual vibration. The residual vibration of the diaphragm 121 is assumed to have an intrinsic vibration frequency that is determined by the acoustic resistance r given by the shapes of the nozzle 110 and the ink supply port 142, a degree of ink viscosity and the like, the acoustic inertance m given by a weight of ink within the channel (cavity 141), and compliance Cm of the diaphragm 121.

Figure 7:
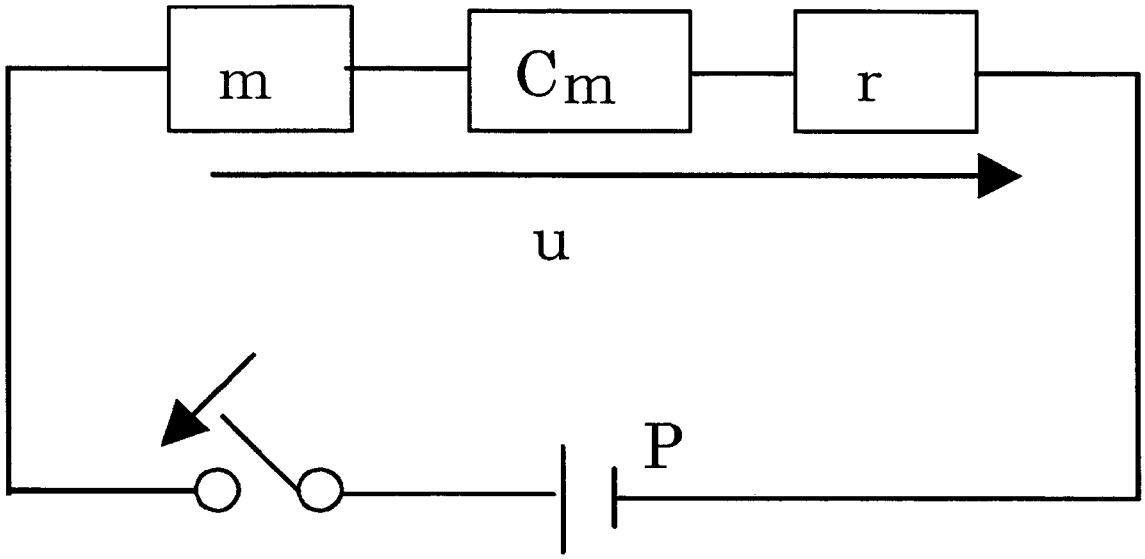
FIG. 7 is a circuit diagram showing a computation model of simple harmonic vibration on the assumption of residual vibration of the diaphragm shown in FIG. 3.

The computation model of the residual vibration of the diaphragm 121 based on the above assumption will now be described. FIG. 7 is a circuit diagram showing the computation model of simple harmonic vibration on the assumption of the residual vibration of the diaphragm 121. In this way, the computation model of the residual vibration of the diaphragm 121 can be represented by a sound pressure P, and the acoustic inertance m, compliance Cm and acoustic resistance r mentioned above. Then, by computing a step response in terms of a volume velocity u when the sound pressure P is applied to the circuit shown in FIG. 7, following equations are obtained.

$$u = \frac{P}{\omega \cdot m} e^{-\alpha t} \cdot \sin \omega t \quad (1)$$

$$\omega = \sqrt{\frac{1}{m \cdot C_m} - \alpha^2} \quad (2)$$

$$\alpha = \frac{r}{2m} \quad (3)$$

Figure 8:
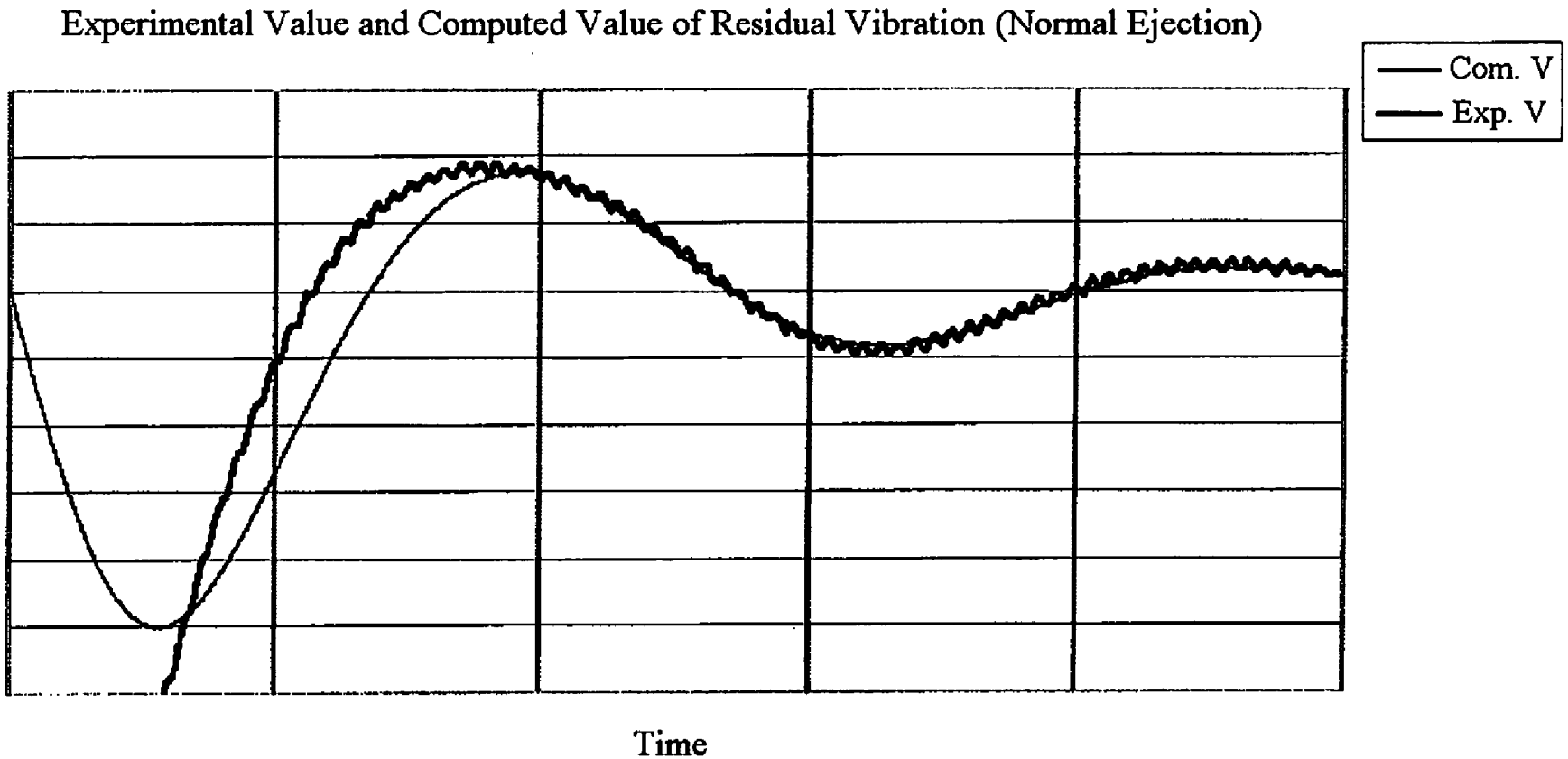
FIG. 8 is a graph showing the relationship between an experimental value and computed value of residual vibration of the diaphragm shown in FIG. 3 in the case of normal ejection.

The computation result obtained from the equations described above is compared with the experiment result from an experiment carried out separately as to the residual vibration of the diaphragm 121 after ejection of ink droplets. FIG. 8 is a graph showing the relationship between the experimental value and the computed value of the residual vibration of the diaphragm 121. As can be understood from the graph shown in FIG. 8, two waveforms of the experimental value and the computed value substantially correspond with each other.

In the meantime, a phenomenon, which ink droplets are not ejected normally through the nozzle 110 even when the above-mentioned ejection operation is carried out, that is, the occurrence of an ejection failure of droplets, may occur in any of the ink jet heads 100 of the head unit 35. As for causes of the occurrence of the ejection failure, as will be described below, (1) intrusion of an air bubble into the cavity 141, (2) drying and thickening (fixing) of ink in the vicinity the nozzle 110, (3) adhesion of paper dust in the vicinity the outlet of the nozzle 110, or the like may be mentioned.

Once the ejection failure occurs, it typically results in non-ejection of droplets through the nozzle 110, that is, the advent of a droplet non-ejection phenomenon, which gives rise to missing dots in pixels forming an image printed (drawn) on a recording sheet P. Further, in the case of the ejection failure, even when droplets are ejected through the nozzle 110, the ejected droplets do not land on the recording sheet P adequately because a quantity of droplets is too small or the flying direction (trajectory) of droplets is deviated, which also appears as missing dots in pixels. For this reason, hereinafter, an ejection failure of droplets may also be referred to simply as the "missing dot".

In the following, values of the acoustic resistance r and/or the acoustic inertance m are adjusted on the basis of the comparison result shown in FIG. 8 for each cause of the missing dot (ejection failure) phenomenon (i.e., droplet non-ejection phenomenon) during the printing process, which occurs in the nozzle 110 of the ink jet head 100, so that the computed value and the experimental value of the residual vibration of the diaphragm 121 match (or substantially correspond) with each other. In this regard, three types of causes including intrusion of an air bubble, thickening due to drying, and adhesion of paper dust will be discussed herein.

Figure 9:
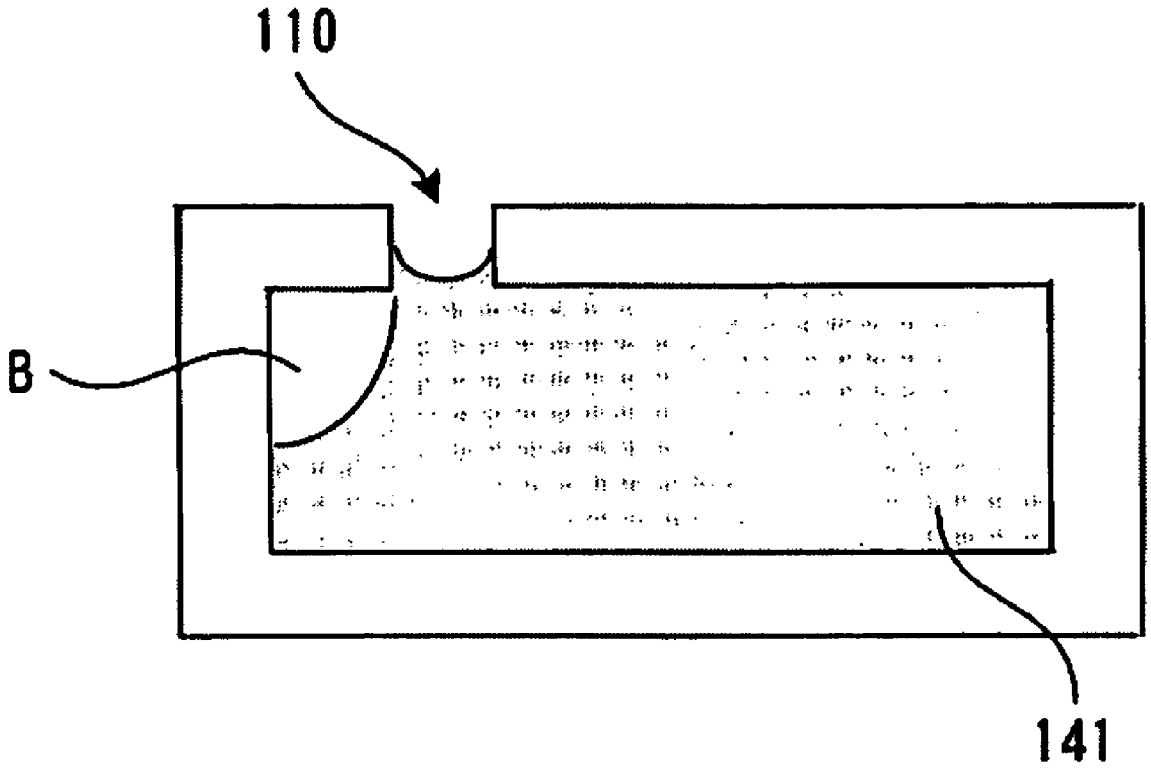
FIG. 9 is a conceptual view in the vicinity of the nozzle in a case where an air bubble has intruded into the cavity shown in FIG. 3.

First, intrusion of an air bubble into the cavity 141, which is one of the causes of the missing dot, will be discussed. FIG. 9 is a conceptual view in the vicinity of the nozzle 110 in a case where an air bubble B has intruded into the cavity 141 of FIG. 3. As shown in FIG. 9, the air bubble B thus generated is assumed to be generated and adhering to the wall surface of the cavity 141 (FIG. 9 shows a case where the air bubble B is adhering in the vicinity of the nozzle 110, as one example of the adhesion position of the air bubble B).

When the air bubble B has intruded into the cavity 141 in this manner, a total weight of ink filling the cavity 141 is thought to decrease, which in turn lowers the acoustic inertance m. Because the air bubble B is adhering to the wall surface of the cavity 141, the nozzle 110 is thought to become in a state where its diameter is increased in size by the diameter of the air bubble B, which in turn lowers the acoustic resistance r.

Figure 10:
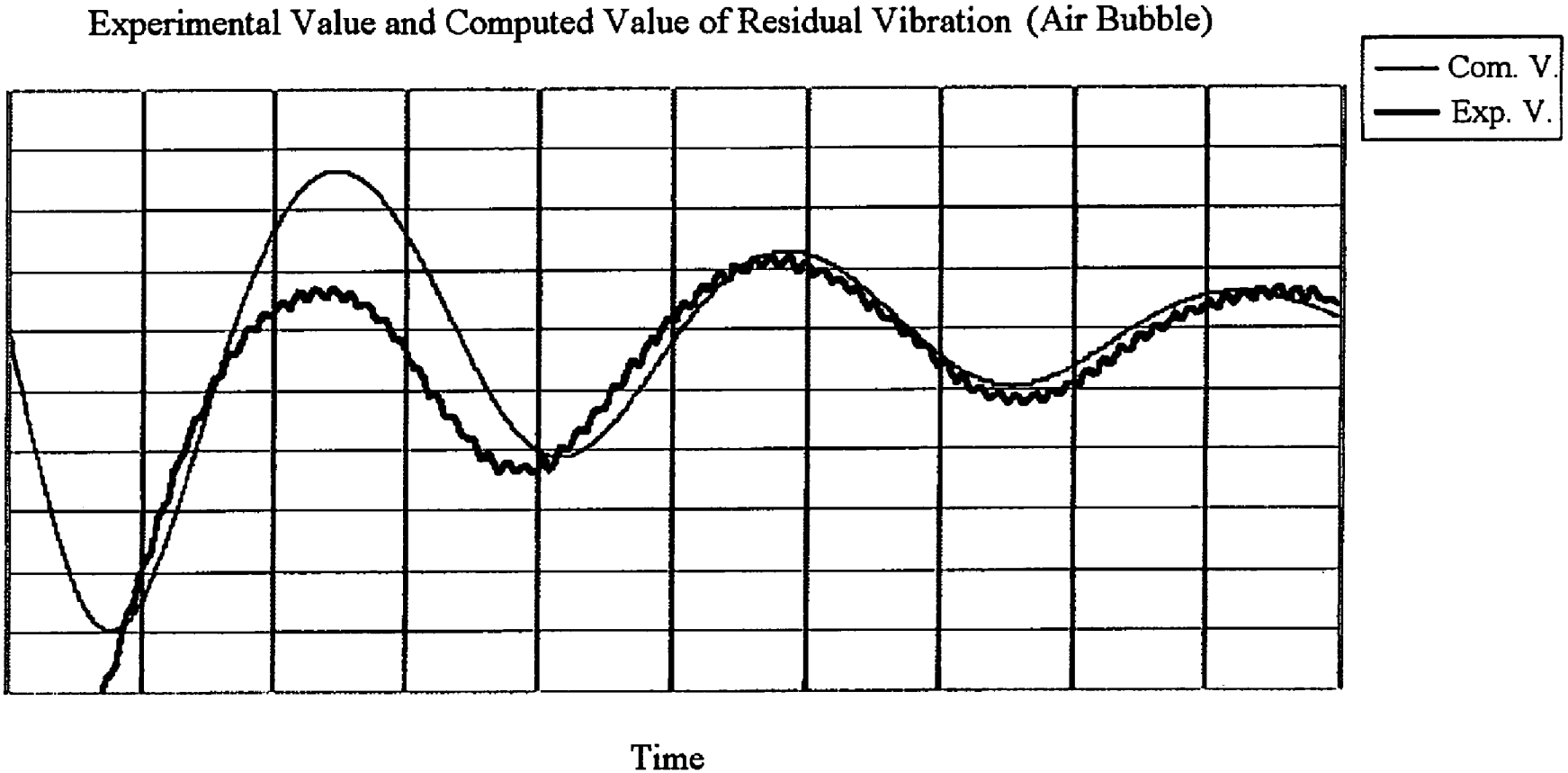
FIG. 10 is a graph showing the computed value and the experimental value of residual vibration in a state where ink droplets cannot be ejected due to intrusion of an air bubble into the cavity.

Thus, by setting both the acoustic resistance r and the acoustic inertance m smaller than in the case of FIG. 8 where ink is ejected normally, to be matched with the experimental value of the residual vibration in the case of intrusion of an air bubble, the result (graph) as shown in FIG. 10 was obtained. As can be understood from the graphs of FIGS. 8 and 10, in the case of intrusion of an air bubble into the cavity 141, a residual vibration waveform, characterized in that the frequency becomes higher than in the case of normal ejection, is obtained. In this regard, it can also be confirmed that the damping rate of amplitude of the residual vibration becomes smaller as the acoustic resistance r is lowered, and the amplitude of the residual vibration thus becomes smaller slowly.

Figure 11:
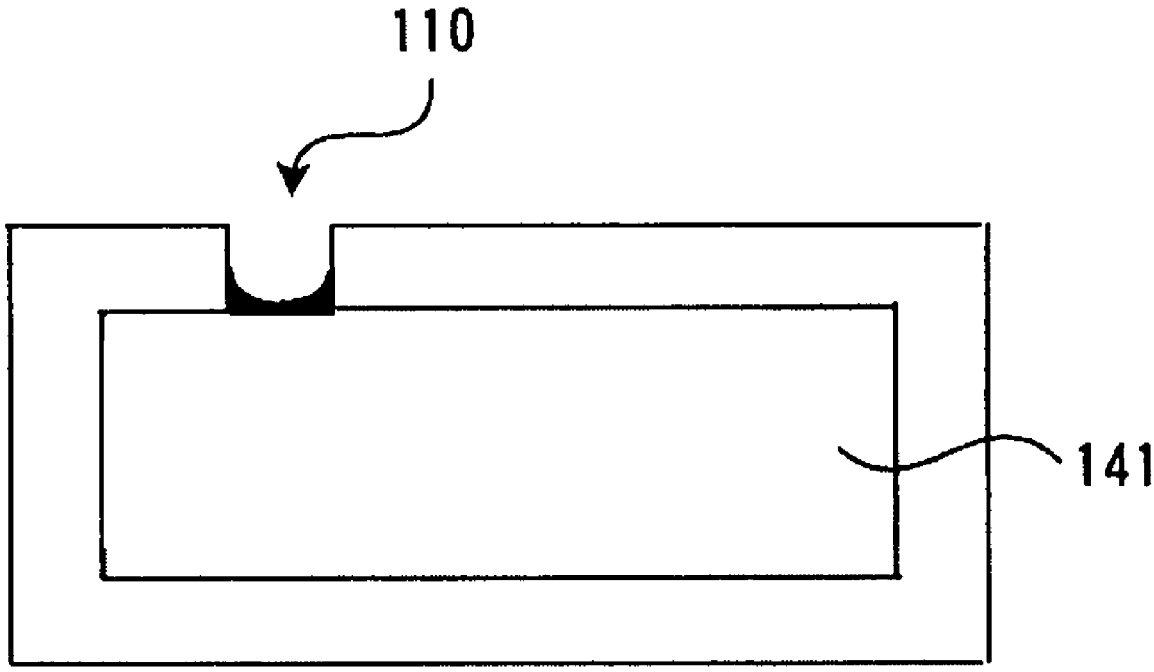
FIG. 11 is a conceptual view in the vicinity of the nozzle in a case where ink has fixed due to drying in the vicinity of the nozzle shown in FIG. 3.

Next, drying (fixing and thickening) of ink in the vicinity of the nozzle 110, which is another cause of the missing dot, will be discussed. FIG. 11 is a conceptual view in the vicinity of the nozzle 110 in a case where ink has fixed due to drying in the vicinity of the nozzle 110 of FIG. 3. As shown in FIG. 11, in a case where ink has fixed due to drying in the vicinity of the nozzle 110, ink within the cavity 141 is in a situation that the ink is trapped within the cavity 141. When ink dries and thickens in the vicinity of the nozzle 110 in this manner, the acoustic resistance r is thought to increase.

Figure 12:
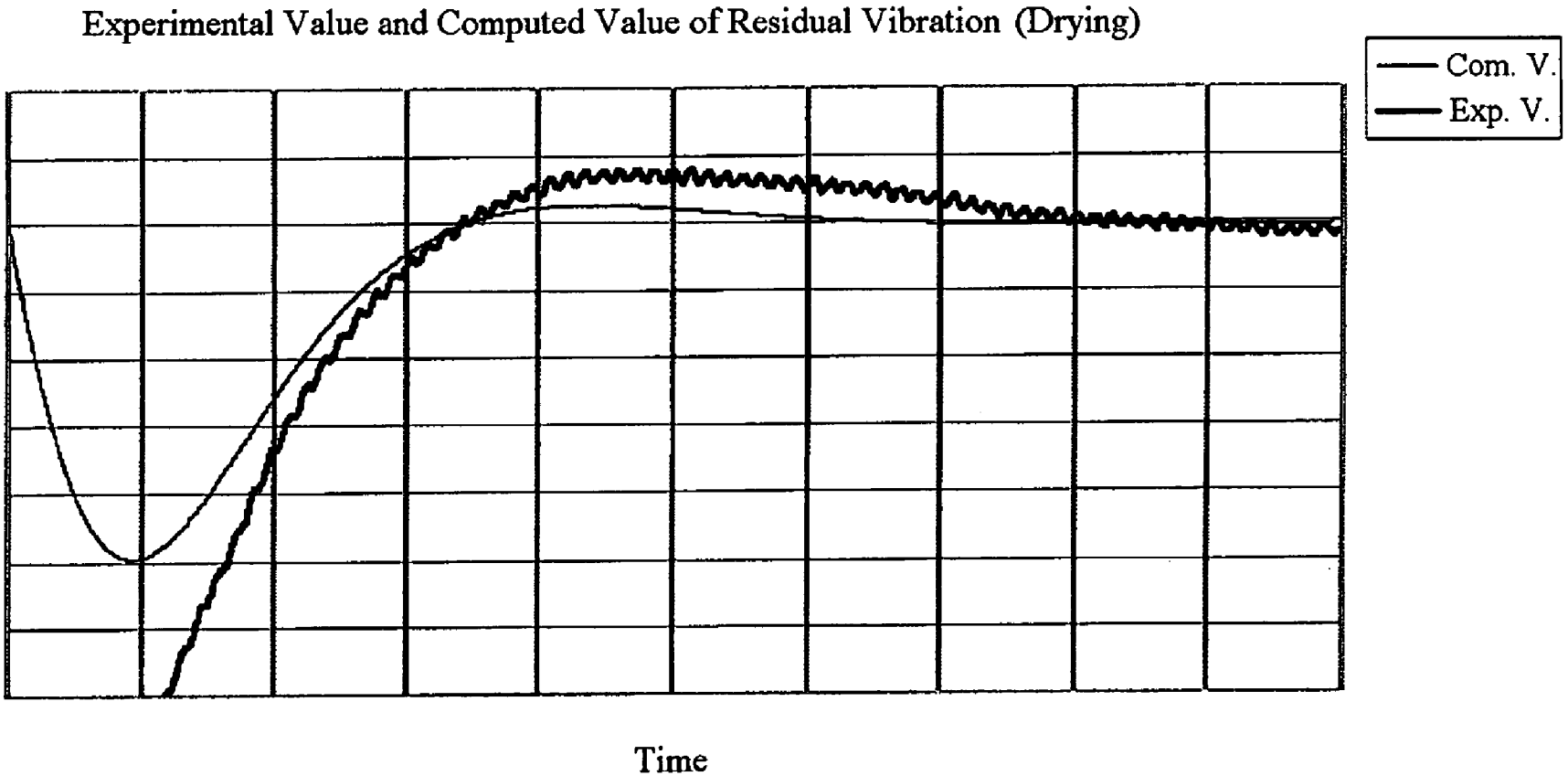
FIG. 12 is a graph showing the computed value and the experimental value of residual vibration in a state where ink has thickened due to drying in the vicinity of the nozzle.

Thus, by setting the acoustic resistance r larger than in the case of FIG. 8 where ink is ejected normally, to be matched with the experimental value of the residual vibration in the case of fixing (thickening) of ink caused by drying in the vicinity of the nozzle 110, the result (graph) as shown in FIG. 12 was obtained. In this case, the experimental values shown in FIG. 12 are those obtained by measuring the residual vibration of the diaphragm 121 in a state where the head unit 35 was allowed to stand for a few days without attaching a cap (not shown), so that ink could not be ejected because the ink within the cavity 141 had dried and thickened (the ink had fixed) in the vicinity of the nozzle 110. As can be understood from the graphs of FIGS. 8 and 12, in the case where ink has thickened due to drying in the vicinity of the nozzle 110, a residual vibration waveform, characterized in that not only the frequency becomes extremely low compared with the case of normal ejection, but also the residual vibration is over-damped, is obtained. This is because, when the diaphragm 121 moves upward in FIG. 3 after the diaphragm 121 is attracted downward in FIG. 3 in order to eject an ink droplet and ink thereby flows into the cavity 141 from the reservoir 143, there is no escape for the ink within the cavity 141 and the diaphragm 121 suddenly becomes unable to vibrate anymore (i.e., the diaphragm 121 becomes over-damped).

Figure 13:
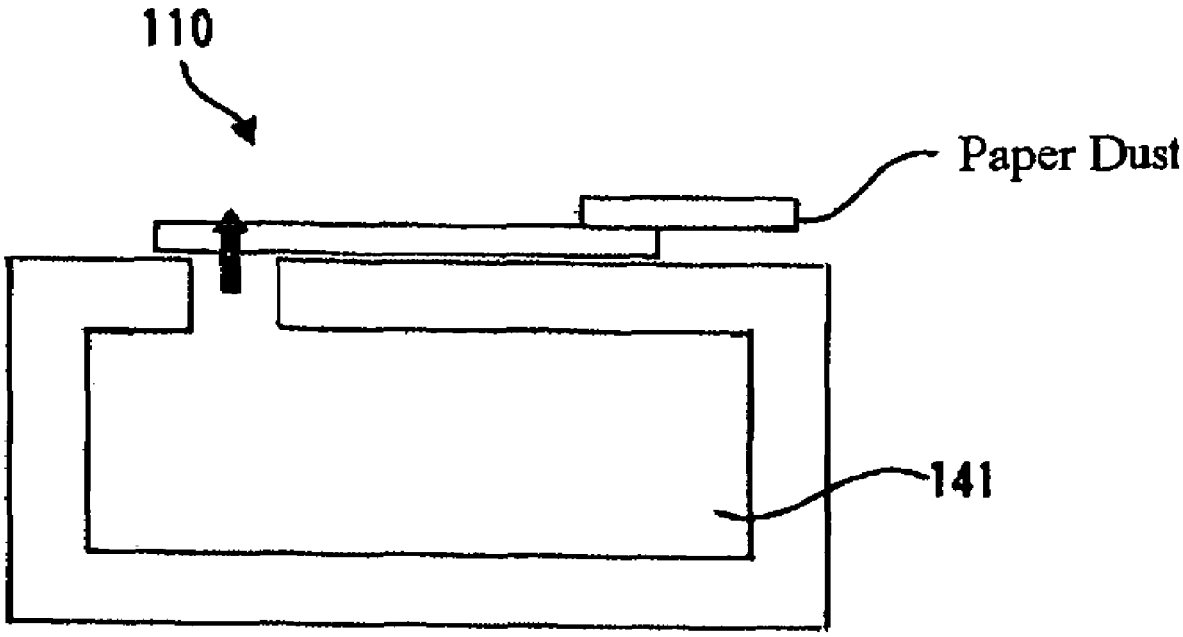
FIG. 13 is a conceptual view in the vicinity of the nozzle in a case where paper dust is adhering in the vicinity of the outlet of the nozzle shown in FIG. 3.

Next, adhesion of paper dust in the vicinity of the outlet of the nozzle 110, which is still another cause of the missing dot, will be described. FIG. 13 is a conceptual view in the vicinity of the nozzle 110 in the case of adhesion of paper dust in the vicinity of the outlet of the nozzle 110 of FIG. 3. As shown in FIG. 13, in the case where paper dust is adhering in the vicinity of the outlet of the nozzle 110, not only ink seeps out from the cavity 141 via paper dust, but also it becomes impossible to eject ink through the nozzle 110. In the case where paper dust is adhering in the vicinity of the outlet of the nozzle 110 and ink seeps out from the nozzle 110 in this manner, a quantity of ink within the cavity 141 and ink seeping out when viewed from the diaphragm 121 is thought to increase compared with the normal state, which in turn causes the acoustic inertance m to increase. Further, fibers of the paper dust adhering in the vicinity of the outlet of the nozzle 110 are thought to cause the acoustic resistance r to increase.

Figure 14:
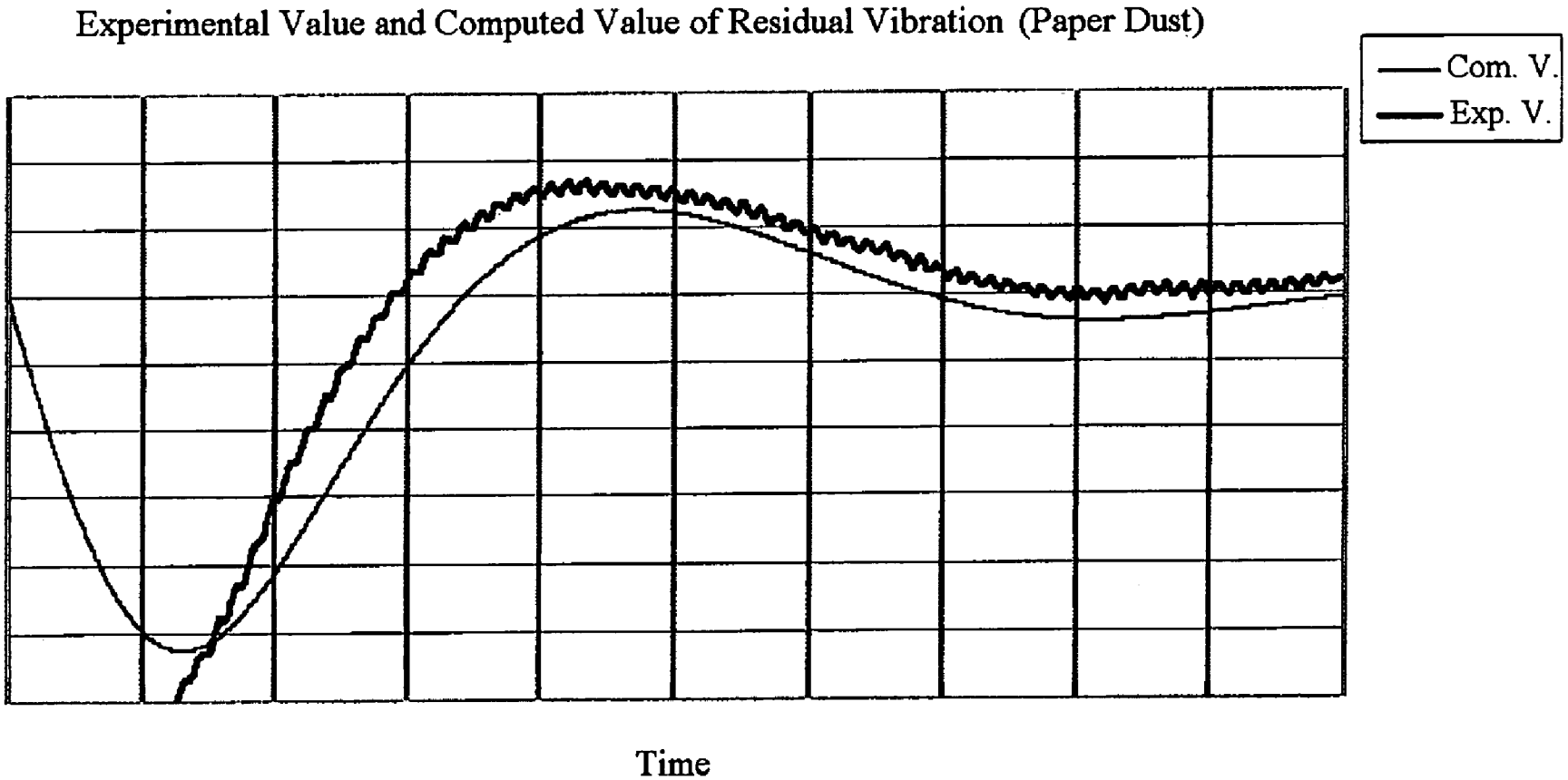
FIG. 14 is a graph showing the computed value and the experimental value of residual vibration in a state where paper dust is adhering to the outlet of the nozzle.
Figure 15:
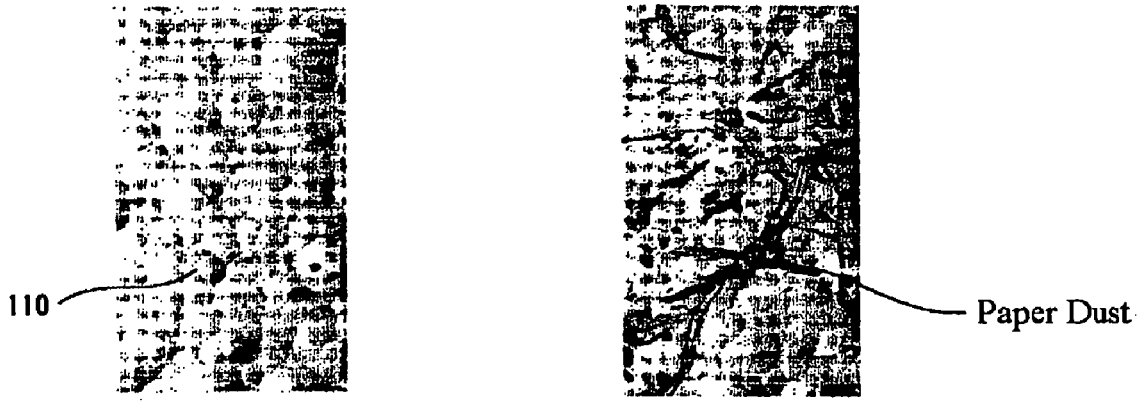
FIG. 15 shows pictures of the nozzle states before and after adhesion of paper dust in the vicinity of the nozzle.

Thus, by setting both the acoustic inertance m and the acoustic resistance r larger than in the case of FIG. 8 where ink is ejected normally, to be matched with the experimental value of the residual vibration in the case of adhesion of paper dust in the vicinity of the outlet of the nozzle 110, the result (graph) as shown in FIG. 14 was obtained. As can be understood from the graphs of FIGS. 8 and 14, in the case where paper dust is adhering in the vicinity of the outlet of the nozzle 110, a residual vibration waveform, characterized in that the frequency becomes lower than in the case of normal ejection, is obtained (it is also understood from the graphs of FIGS. 12 and 14 that the frequency of the residual vibration in the case of adhesion of paper dust is higher than that in the case of thickening ink). FIG. 15 shows pictures of the states of the nozzle 110 before and after adhesion of paper dust. It can be seen from FIG. 15(*b*) that once paper dust adheres in the vicinity of the outlet of the nozzle 110, ink seeps out along the paper dust.

Note that in both the cases where ink has thickened due to drying in the vicinity of the nozzle 110 and where paper dust is adhering in the vicinity of the outlet of the nozzle 110, the frequency of the damped vibration is lower than in the case where ink droplets are ejected normally. Hence, a comparison is made, for example, with a predetermined threshold in the frequency, the cycle or the phase of the damped vibration to identify these two causes of the missing dot (non-ejection of ink, i.e., ejection failure) from the waveform of the residual vibration of the diaphragm 121, or alternatively the causes can be identified from a change of the cycle of the residual vibration (damped vibration) or the damping rate of a change in amplitude. In this way, an ejection failure of the respective ink jet heads 100 can be detected from a change of the residual vibration of the diaphragm 121, in particular, a change of the frequency thereof, when ink droplets are ejected through the nozzle 110 of each of the ink jet heads 100. Further, by comparing the frequency of the residual vibration in this case with the frequency of the residual vibration in the case of normal ejection, the cause of the ejection failure can be identified.

Figure 16:
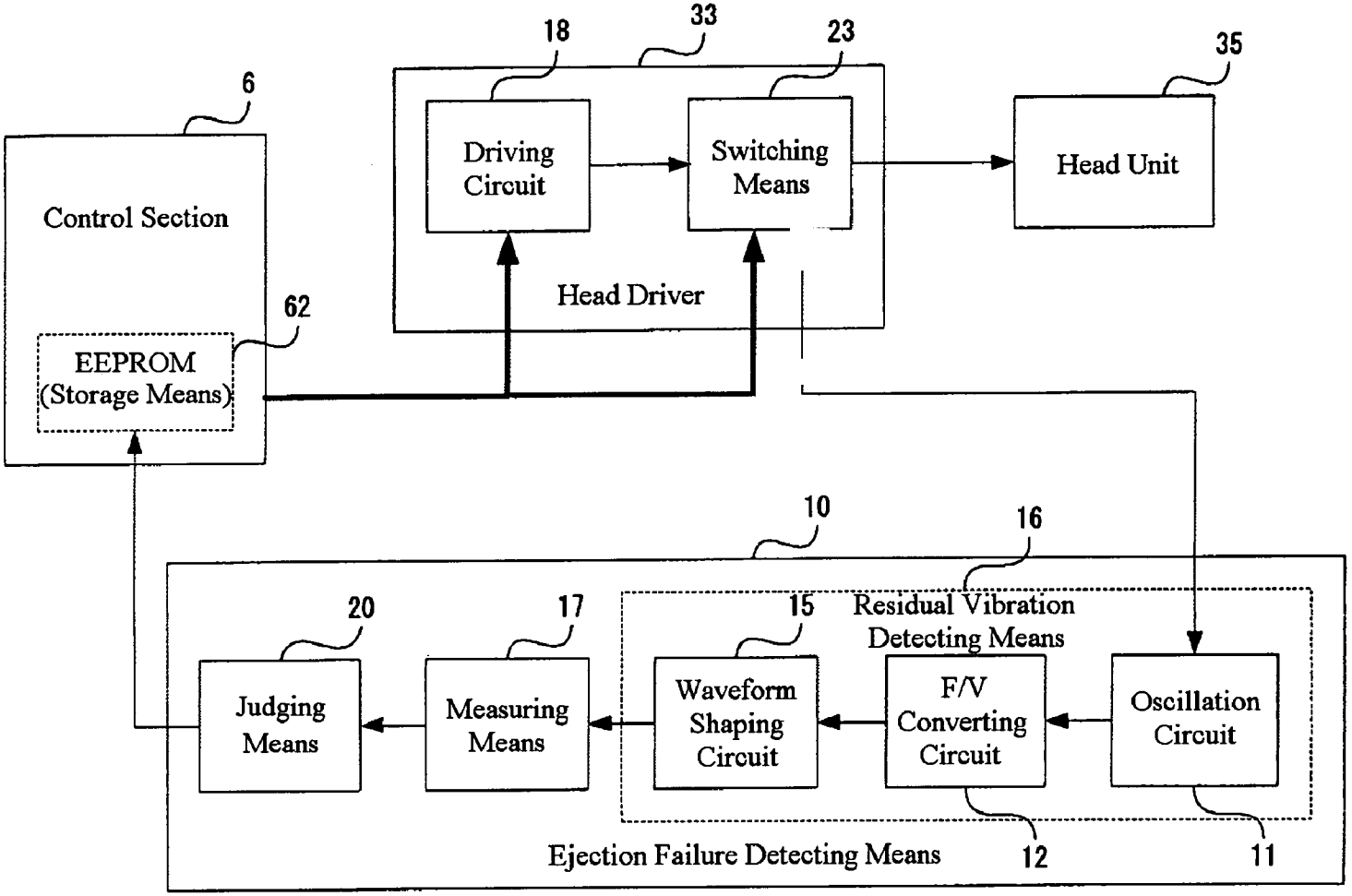
FIG. 16 is a schematic block diagram of the ejection failure detecting means shown in FIG. 2.

Next, the ejection failure detecting means 10 in one embodiment of the invention will now be described. FIG. 16 is a schematic block diagram of the ejection failure detecting means shown in FIG. 2. As shown in FIG. 16, the ejection failure detecting means 10 of the invention is provided with residual vibration detecting means 16 comprising an oscillation circuit 11, an F/V (frequency-to-voltage) converting circuit 12 and a waveform shaping circuit 15, measuring means 17 for measuring the cycle, amplitude or the like of the residual vibration from the residual vibration waveform data detected in the residual vibration detecting means 16, and judging means 20 for judging an ejection failure of the ink jet head 100 on the basis of the cycle or the like measured by the measuring means 17. In the ejection failure detecting means 10, the residual vibration detecting means 16 detects the vibration waveform, which is formed in the F/V converting circuit 12 and the waveform shaping circuit 15 from the oscillation frequency of the oscillation circuit 11 that oscillates on the basis of the residual vibration of the diaphragm 121 of the electrostatic actuator 120. In the residual vibration detecting means 16, the measuring means 17 then measures the cycle or the like of the residual vibration on the basis of the vibration waveform thus detected, and the judging means 20 detects and judges an ejection failure of each of the ink jet heads 100 provided to each head unit 35 in the printing means 3, on the basis of the cycle or the like of the residual vibration thus measured (vibration pattern of the residual vibration). In the following, each component of the ejection failure detecting means 10 will be described.

Figure 17:
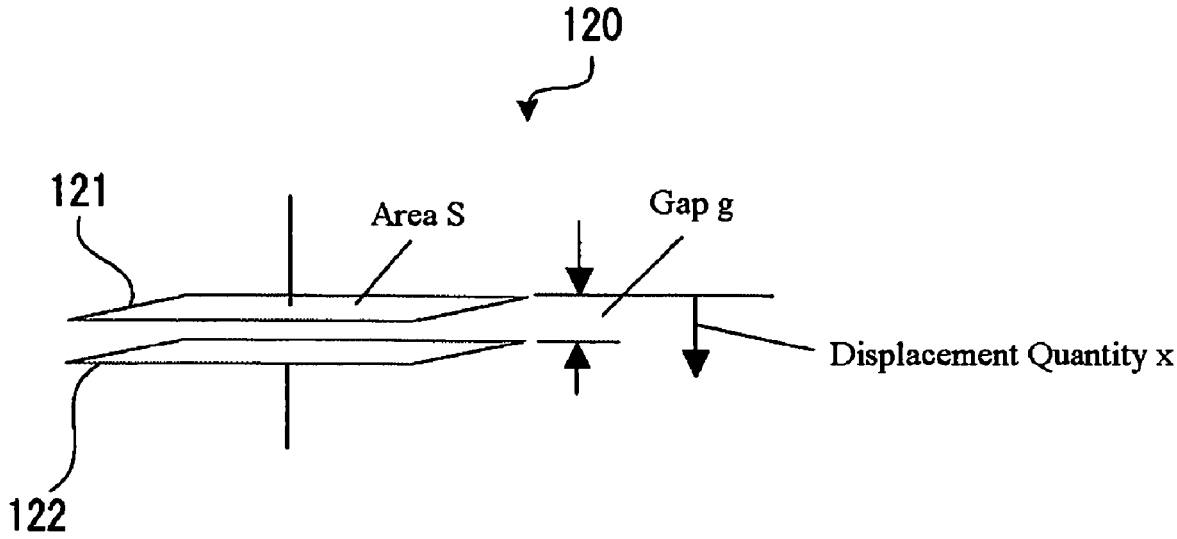
FIG. 17 is a conceptual view in the case where the electrostatic actuator shown in FIG. 3 is assumed as a parallel plate capacitor.
Figure 18:
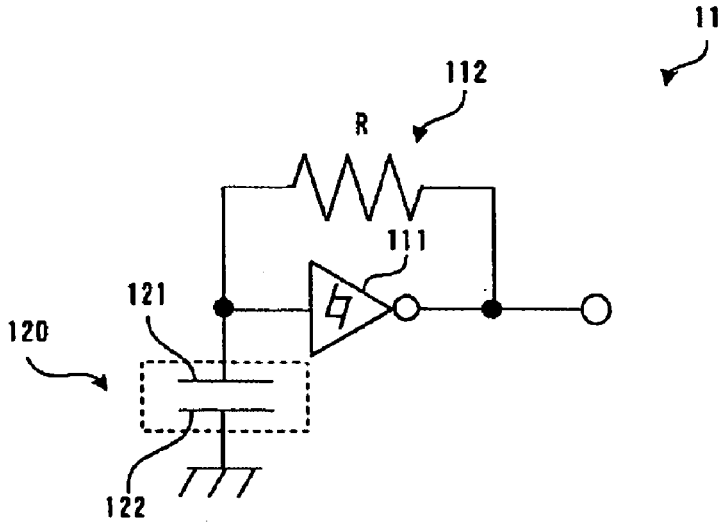
FIG. 18 is a circuit diagram of an oscillation circuit including the capacitor constituted from the electrostatic actuator shown in FIG. 3.

First, a method of using the oscillation circuit 11 to detect the frequency (the number of vibration) of the residual vibration of the diaphragm 121 of the electrostatic actuator 120 will be described. FIG. 17 is a conceptual view in the case where the electrostatic actuator 120 of FIG. 3 is assumed as a parallel plate capacitor. FIG. 18 is a circuit diagram of the oscillation circuit 11 including the capacitor constituted from the electrostatic actuator 120 of FIG. 3. In this case, the oscillation circuit 11 shown in FIG. 18 is a CR oscillation circuit using the hysteresis characteristic of a schmitt trigger. However, in the invention, the oscillation circuit is not limited to such a CR oscillation circuit, and any oscillation circuit can be used provided that it is an oscillation circuit using an electric capacitance component (capacitor C) of the actuator (including the diaphragm). The oscillation circuit 11 may comprise, for example, the one using an LC oscillation circuit. Further, this embodiment describes an example case using a schmitt trigger inverter 111; however, a CR oscillation circuit using inverters in three stages may be formed.

In the ink jet head 100 shown in FIG. 3, as described above, the diaphragm 121 and the segment electrode 122 spaced apart therefrom by an extremely small interval (clearance) together form the electrostatic actuator 120 that forms the counter electrodes. The electrostatic actuator 120 can be deemed as the parallel plate capacitor as shown in FIG. 17. In the case where C is the electric capacitance of the capacitor, S is the surface area of each of the diaphragm 121 and the segment electrode 122, g is a distance (gap length) between the two electrodes 121 and 122, and E is a dielectric constant of the space (clearance) sandwiched by both electrodes (if $\epsilon_0$ is a dielectric constant in vacuum and E″ is a specific dielectric constant in the clearance, then $\epsilon=\epsilon_0\times\epsilon_r$), then an electric capacitance C(x) of the capacitor (electrostatic actuator 120) shown in FIG. 17 can be expressed by the following equation.

$$C(x) = \varepsilon_0 \cdot \varepsilon_r \frac{S}{g - x} \quad (F) \tag{4}$$

As shown in FIG. 17, x in Equation (4) above indicates a displacement quantity of the diaphragm 121 from the reference position thereof, caused by the residual vibration of the diaphragm 121.

As can be understood from Equation (4) above, the smaller the gap length g (i.e., gap length g−displacement quantity x) is, the larger the electric capacitance C(x) becomes, and conversely, the larger the gap length g (gap length g−displacement quantity x) is, the smaller the electric capacitance C(x) becomes. In this manner, the electric capacitance C(x) is inversely proportional to (gap length g−displacement quantity x) (the gap length g when x is 0). In this regard, for the electrostatic actuator 120 shown in FIG. 3, a specific dielectric constant, $\epsilon_r$=1, because the clearance is fully filled with air.

Further, because ink droplets (ink dots) to be ejected become finer with an increase of the resolution of the droplet ejection apparatus (the ink jet printer 1 in this embodiment), the electrostatic actuator 120 is increased in density and decreased in size. The surface area S of the diaphragm 121 of the ink jet head 100 thus becomes smaller and a smaller electrostatic actuator 120 is assembled. Furthermore, the gap length g of the electrostatic actuator 120 that varies with the residual vibration caused by ink droplet ejection is approximately one tenth of the initial gap go. Hence, as can be understood from Equation (4) above, a quantity of change of the electric capacitance of the electrostatic actuator 120 takes an extremely small value.

In order to detect a quantity of change of the electric capacitance of the electrostatic actuator 120 (which varies with the vibration pattern of the residual vibration), a method as follows is used, that is, a method of forming an oscillation circuit as the one shown in FIG. 18 on the basis of the electric capacitance of the electrostatic actuator 120, and analyzing the frequency (cycle) of the residual vibration on the basis of the oscillated signal. The oscillation circuit 11 shown in FIG. 18 comprises a capacitor (C) constituted from the electrostatic actuator 120, a schmitt trigger inverter 111, and a resistor element (R) 112.

In the case where an output signal from the schmitt trigger inverter 111 is in the high level, the capacitor C is charged via the resistor element 112. When the charged voltage in the capacitor C (a potential difference between the diaphragm 121 and the segment electrode 122) reaches an input threshold voltage $V_T$+ of the schmitt trigger inverter 111, the output signal from the schmitt trigger inverter 111 inverts to a low level. Then, when the output signal from the schmitt trigger inverter 111 shifts to the low level, electric charges charged in the capacitor C via the resistor element 112 are discharged. When the voltage of the capacitor C reaches the input threshold voltage $V_T$− of the schmitt trigger inverter 111 through this discharge, the output signal from the schmitt trigger inverter 111 inverts again to the high level. Thereafter, this oscillation operation is carried out repetitively.

Here, in order to detect a change with time of the electric capacitance of the capacitor C in each of the above-mentioned phenomena (intrusion of an air bubble, drying, adhesion of paper dust, and normal ejection), it is required that the oscillation frequency of the oscillation circuit 11 is set to an oscillation frequency at which the frequency in the case of intrusion of an air bubble (see FIG. 10), where the frequency of the residual vibration is the highest, can be detected. For this reason, the oscillation frequency of the oscillation circuit 11 has to be increased, for example, to a few or several tens of times or more than the frequency of the residual vibration to be detected, that is, it has to be set to one or more orders of magnitude higher than the frequency in the case of intrusion of an air bubble. In this case, it is preferable to set the oscillation frequency to an oscillation frequency at which the residual vibration frequency in the case of intrusion of an air bubble can be detected, because the frequency of the residual vibration in the case of intrusion of an air bubble shows a high frequency in comparison with the case of normal ejection. Otherwise, it is impossible to detect the frequency of the residual vibration accurately for the phenomenon of the ejection failure. In this embodiment, therefore, a time constant of the CR in the oscillation circuit 11 is set in accordance with the oscillation frequency. By setting the oscillation frequency of the oscillation circuit 11 high in this manner, it is possible to detect the residual vibration waveform more accurately on the basis of a minute change of the oscillation frequency.

The digital information on the residual vibration waveform for each oscillation frequency can be obtained by counting pulses of the oscillation signal outputted from the oscillation circuit 11 in every cycle (pulse) of the oscillation frequency with the use of a measuring count pulse (counter), and by subtracting a count quantity of the pulses of the oscillation frequency when the oscillation circuit 11 is oscillated with an electric capacitance of the capacitor C at the initial gap $g_0$ from the count quantity thus measured. By carrying out D/A (digital-to-analog) conversion on the basis of the digital information, a schematic residual vibration waveform can be generated. The method as described above may be used; however, the measuring count pulse (counter) having a high frequency (high resolution) that can measure a minute change of the oscillation frequency is needed. Such a count pulse (counter) increases the cost, and for this reason, the ejection failure detecting means 10 uses the F/V converting circuit 12 shown in FIG. 19.

Figure 19:
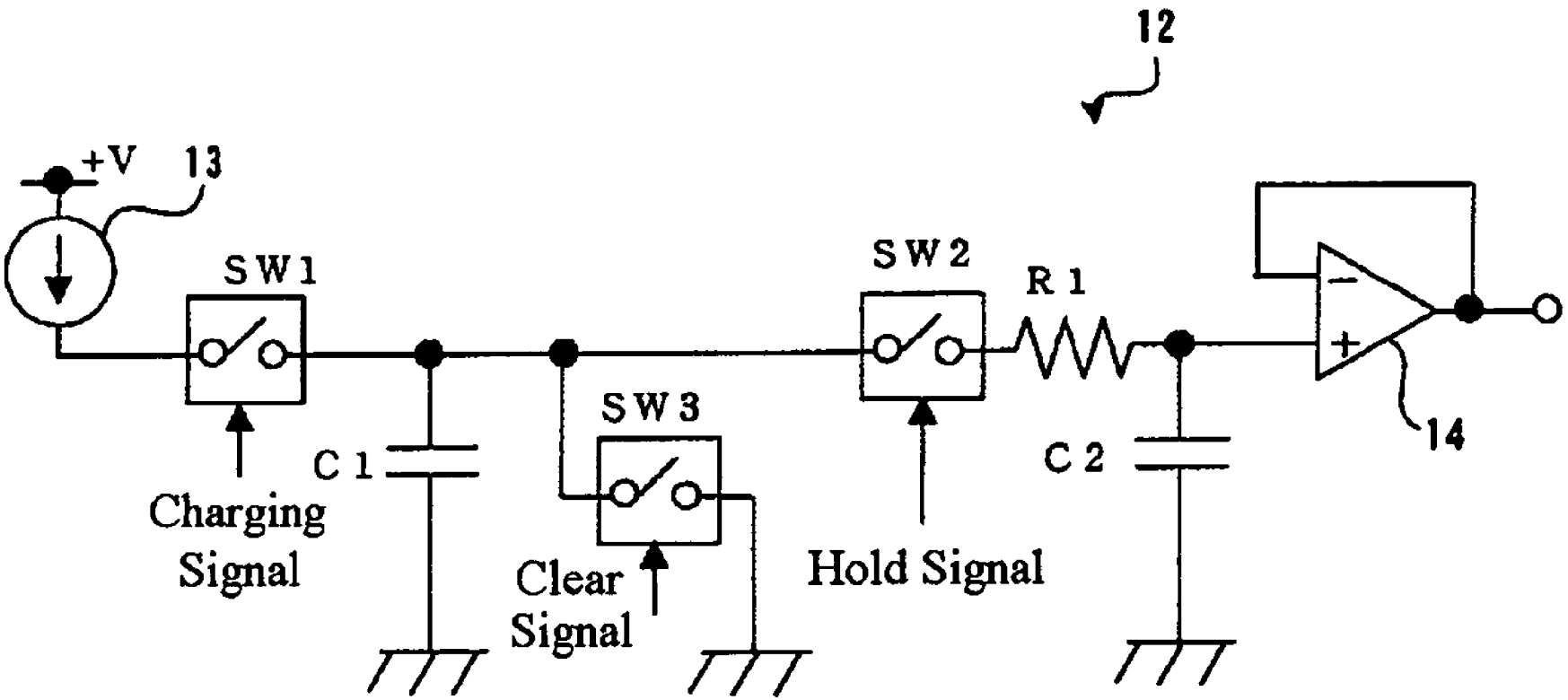
FIG. 19 is a circuit diagram of an F/V converting circuit in the ejection failure detecting means shown in FIG. 16.

FIG. 19 is a circuit diagram of the F/V converting circuit 12 in the ejection failure detecting means 10 shown in FIG. 16. As shown in FIG. 19, the F/V converting circuit 12 comprises three switches SW1, SW2 and SW3, two capacitors C1 and C2, a resistor element R1, a constant current source 13 from which a constant current Is is outputted, and a buffer 14. The operation of the F/V converting circuit 12 will be described with the use of the timing chart of FIG. 20 and the graph of FIG. 21.

Figure 20:
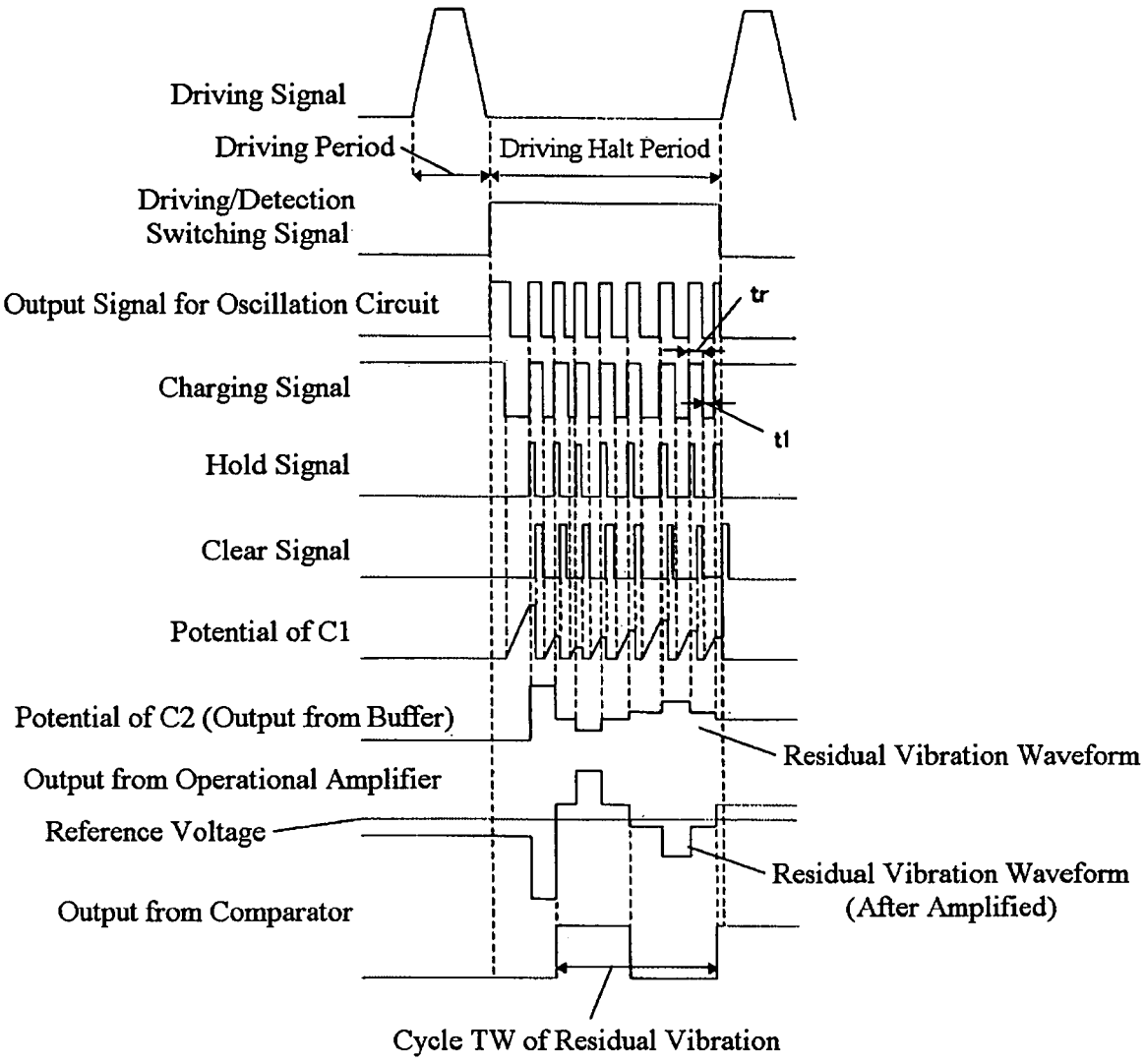
FIG. 20 is a timing chart showing the timing of output signals from respective portions and the like based on an oscillation frequency outputted from the oscillation circuit of the invention.

First, a method of generating a charging signal, a hold signal, and a clear signal shown in the timing chart of FIG. 20 will be described. The charging signal is generated in such a manner that a fixed time tr is set from the rising edge of the oscillation pulse of the oscillation circuit 11 and the signal remains in the high level for the fixed time tr. The hold signal is generated in such a manner that the signal rises in sync with the rising edge of the charging signal, and falls to the low level after it is held in the high level for a predetermined fixed time. The clear signal is generated in such a manner that the signal rises in sync with the falling edge of the hold signal and falls to the low level after it is held in the high level for a predetermined fixed time. In this regard, as will be described later, because electric charges move from the capacitor C1 to the capacitor C2 instantaneously and the capacitor C1 discharges instantaneously, in regard to pulses of the hold signal and the clear signal, it is sufficient for each signal to include one pulse until the following rising edge of the output signal from the oscillation circuit 11 occurs, and the rising edge and the falling edge are not limited to those described above.

Figure 21:
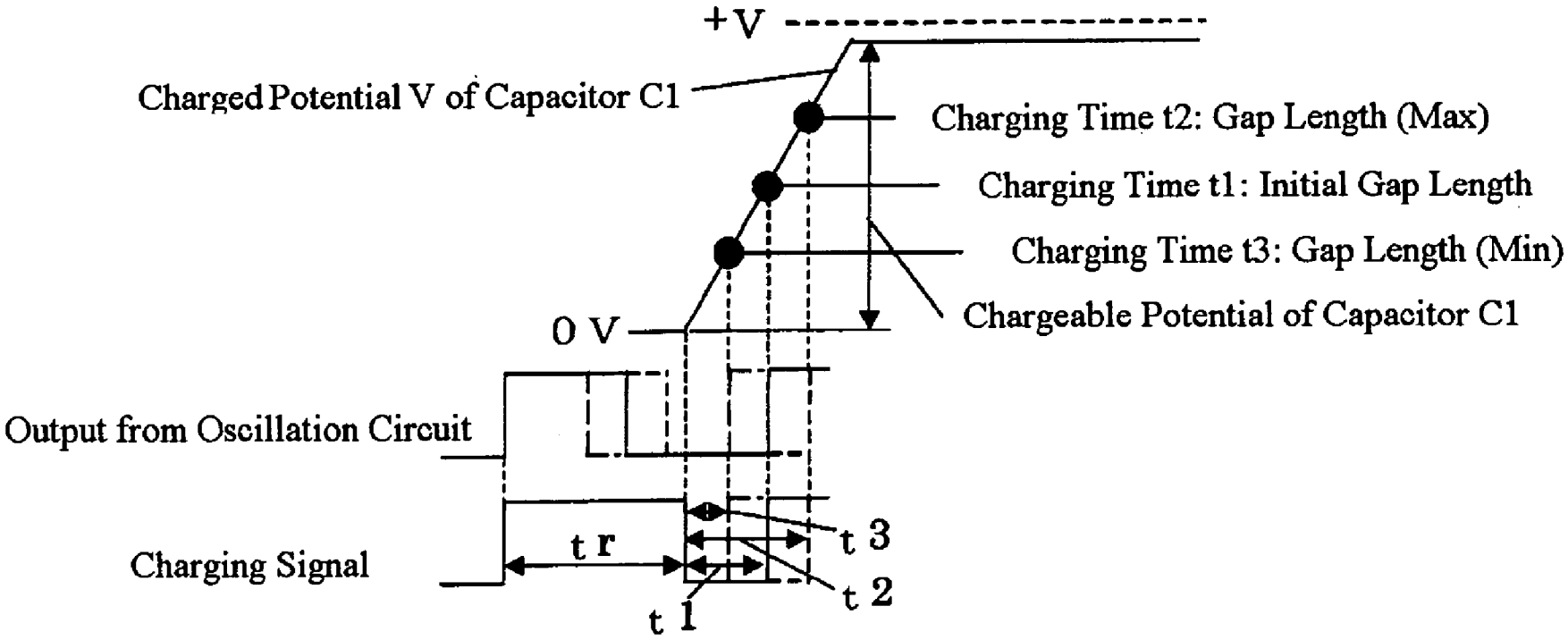
FIG. 21 is a drawing used to explain a setting method of fixed times tr and t1.

With reference to FIG. 21, a method of setting the fixed times tr and t1 in obtaining a sharp waveform (voltage waveform) of the residual vibration will be described. The fixed time tr is adjusted from the cycle of the oscillation pulse oscillated with the electric capacitance C when the electrostatic actuator 120 is at the initial gap length $g_0$, and is set so that a charged potential for the charging time t1 becomes about half of the chargeable range of the capacitor C1. Further, a gradient of the charged potential is set so as not to exceed the chargeable range of the capacitor C1 from a charging time t2 at the position at which the gap length g becomes the maximum (Max) to a charging time t3 at the position at which the gap length g becomes the minimum (Min). In other words, because the gradient of the charged potential is determined by dV/dt=Is/C1, it is sufficient to set the output constant current Is from the constant current source 13 to an appropriate value. By setting the output constant current Is of the constant current source 13 as high as possible within the range, a minute change of the electric capacitance of the capacitor comprising the electrostatic actuator 120 can be detected with high sensitivity, and this makes it possible to detect a minute change of the diaphragm 121 of the electrostatic actuator 120.

Figure 22:
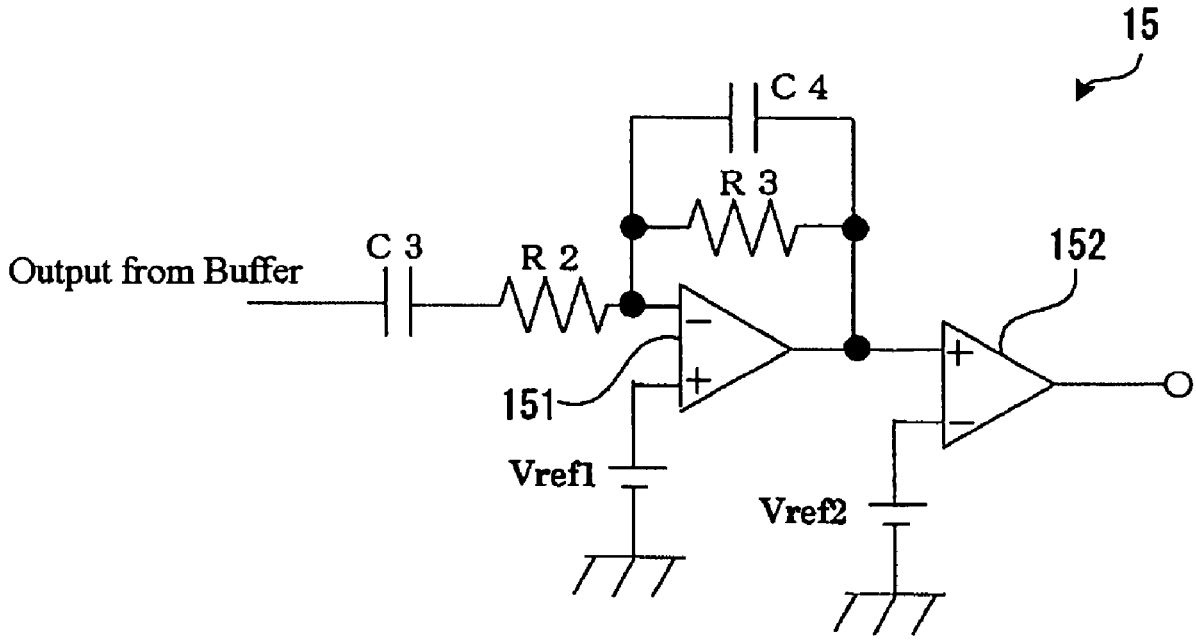
FIG. 22 is a circuit diagram showing the circuitry of a waveform shaping circuit shown in FIG. 16.

The configuration of the waveform shaping circuit 15 shown in FIG. 16 will now be described with reference to FIG. 22. FIG. 22 is a circuit diagram showing the circuitry of the waveform shaping circuit 15 of FIG. 16. The waveform shaping circuit 15 outputs the residual vibration waveform to the judging means 20 in the form of a rectangular wave. As shown in FIG. 22, the waveform shaping circuit 15 comprises two capacitors C3 (DC component eliminating means) and C4, two resistor elements R2 and R3, two direct current voltage sources Vref1 and Vref2, an operational amplifier 151, and a comparator 152. In this regard, the waveform shaping circuit 15 may be configured to measure the amplitude of the residual vibration waveform by directly outputting a wave height value detected in the waveform shaping processing of the residual vibration waveform.

The output from the buffer 14 in the F/V converting circuit 12 includes electric capacitance components of DC components (direct current components) based on the initial gap $g_0$ of the electrostatic actuator 120. Because the direct current components vary with each ink jet head 100, the capacitor C3 is used to eliminate the direct current components of the electric capacitance. The capacitor C3 thus eliminates the DC components from an output signal from the buffer 14, and outputs only the AC components of the residual vibration to the inverting input terminal of the operational amplifier 151.

The operational amplifier 151 inverts and amplifies the output signal from the buffer 14 in the F/V converting circuit 12, from which the direct current components have been eliminated, and also forms a low-pass filter to remove a high band of the output signal. In this case, the operational amplifier 151 is assumed to be a single power source circuit. The operational amplifier 151 forms an inverting amplifier based on the two resistor elements R2 and R3, and the residual vibration (alternating current components) inputted therein is therefore amplified by a factor of −R3/R2.

Further, because of the single power source operation, the operational amplifier 151 outputs an amplified residual vibration waveform of the diaphragm 121 that vibrates about the potential set by the direct current voltage source Vref1 connected to the non-inverting input terminal thereof. Here, the direct current voltage source Vref1 is set to about half the voltage range within which the operational amplifier 151 is operable with a single power source. Furthermore, the operational amplifier 151 forms a low-pass filter, having a cut-off frequency of $1/(2\pi \times C4 \times R3)$, from the two capacitors C3 and C4. Then, as shown in the timing chart of FIG. 20, the residual vibration waveform of the diaphragm 121, which is amplified after the direct current components are eliminated therefrom, is compared with the potential of the other direct current voltage source Vref2 in the comparator 152 in the following stage, and the comparison result is outputted from the waveform shaping circuit 15 in the form of a rectangular wave. In this case, the direct current voltage source Vref1 may be commonly used as the other direct current voltage source Vref2.

Next, the operations of the F/V converting circuit 12 and the waveform shaping circuit 15 of FIG. 19 will now be described with reference to the timing chart shown in FIG. 20. The F/V converting circuit 12 shown in FIG. 19 operates according to the charging signal, the clear signal and the hold signal, which are generated as described above. Referring to the timing chart of FIG. 20, when the driving signal of the electrostatic actuator 120 is inputted into the ink jet head 100 via the head driver 33, the diaphragm 121 of the electrostatic actuator 120 is attracted toward the segment electrode 122 as shown in FIG. 6(*b*), and abruptly contracts upward in FIG. 6 in sync with the falling edge of the driving signal (see FIG. 6(*c*)).

A driving/detection switching signal that switches the connection of the ink jet head 100 between the driving circuit 18 and the ejection failure detecting means 10 shifts to the high level in sync with the falling edge of the driving signal. The driving/detection switching signal is held in the high level during the driving halt period of the corresponding ink jet head 100, and shifts to the low level before the following driving signal is inputted. While the driving/detection switching signal remains in the high level, the oscillation circuit 11 of FIG. 18 keeps oscillating while changing the oscillation frequency in response to the residual vibration of the diaphragm 121 of the electrostatic actuator 120.

As described above, the charging signal is held in the high level from the falling edge of the driving signal, that is, the rising edge of the output signal from the oscillation circuit 11 until the elapse of the fixed time tr, which is set in advance so that the waveform of the residual vibration will not exceed the chargeable range of the capacitor C1. It should be noted that the switch SW1 remains OFF while the charging signal is held in the high level.

When the fixed time tr elapses and the charging signal shifts to the low level, the switch SW1 is switched ON in sync with the falling edge of the charging signal (see FIG. 19). The constant current source 13 and the capacitor C1 are then connected to each other, and the capacitor C1 is charged with the gradient Is/C1 as described above. Namely, the capacitor C1 is kept charged while the charging signal remains in the low level, that is, until it shifts to the high level in sync with the rising edge of the following pulse of the output signal from the oscillation circuit 11.

When the charging signal shifts to the high level, the switch SW1 is switched OFF (i.e., opened), and the capacitor C1 is isolated from the constant current source 13. At this time, the capacitor C1 holds a potential charged during the period t1 during which the charging signal remained in the low level (that is, ideally speaking, Is×t1/C1 (Volt)). When the hold signal shifts to the high level in this state, the switch SW2 is switched ON (see FIG. 19), and the capacitors C1 and C2 are connected to each other via the resistor element R1. After the switch SW2 is switched ON, charging and discharging operations are carried out due to a charged potential difference between the two capacitors C1 and C2, and the electric charges move from the capacitor C1 to the capacitor C2 so that the potential differences in the two capacitors C1 and C2 become almost equal.

Herein, the electric capacitance of the capacitor C2 is set to approximately one tenth or less of the electric capacitance of the capacitor C1. For this reason, a quantity of electric charges that move (are used) due to the charging and discharging caused by a potential difference between the two capacitors C1 and C2 is one tenth or less of the electric charges charged in the capacitor C1. Hence, after the electric charges moved from the capacitor C1 to the capacitor C2, a potential difference in the capacitor C1 varies little (drops little). In the F/V converting circuit 12 of FIG. 19, a primary low-pass filter is formed from the resistor element R1 and the capacitor C2 in preventing the charged potential from rising abruptly by the inductance or the like of the wiring in the F/V converting circuit 12 when the capacitor C2 is charged.

After the charged potential, which is substantially equal to the charged potential in the capacitor C1, is held in the capacitor C2, the hold signal shifts to the low level, and the capacitor C1 is isolated from the capacitor C2. Further, when the clear signal shifts to the high level and the switch SW3 is switched ON, the capacitor C1 is connected to the ground terminal GND, and a discharge operation is carried out so that the electric charges charged in the capacitor C1 is reduced to 0. After the capacitor C1 is discharged, when the clear signal shifts to the low level, and the switch SW3 is switched OFF, then the electrode of the capacitor C1 at the top in FIG. 19 is isolated from the ground terminal GND, and the F/V converting circuit 12 stands by (waits) until the following charging signal is inputted, that is, until the charging signal shifts to the low level.

The potential held in the capacitor C2 is updated at each rising time of the charging signal, that is, at each timing at which the charging to the capacitor C2 is completed, and this potential is outputted to the waveform shaping circuit 15 of FIG. 22 in the form of the residual vibration waveform of the diaphragm 121 via the buffer 14. Hence, by setting the electric capacitance of the electrostatic actuator 120 (in this case, a variation width of the electric capacitance due to the residual vibration has to be taken into consideration) and the resistance value of the resistor element 112 so that the oscillation frequency of the oscillation circuit 11 becomes high, each step (step difference) in the potential in the capacitor C2 (output from the buffer 14) shown in the timing chart of FIG. 20 can become more in detail, and this makes it possible to detect a change with time of the electric capacitance due to the residual vibration of the diaphragm 121 more in detail.

Thereafter, the charging signal repeatedly shifts between the low level and the high level, and the potential held in the capacitor C2 is outputted to the waveform shaping circuit 15 via the buffer 14 at the predetermined timing described above. In the waveform shaping circuit 15, the direct current components are eliminated by the capacitor C3 from the voltage signal (the potential in the capacitor C2 in the timing chart of FIG. 20) inputted from the buffer 14, and the resulting signal is inputted into the inverting input terminal of the operational amplifier 151 via the resistor element R2. The alternating current (AC) components of the residual vibration thus inputted are inverted and amplified in the operational amplifier 151, and outputted to one input terminal of the comparator 152. The comparator 152 compares the potential (reference voltage) set in advance by the direct current voltage source Vref2 with the potential of the residual vibration waveform (alternating current components) to output a rectangular wave (output from the comparator in the timing chart of FIG. 20).

Figure 23:
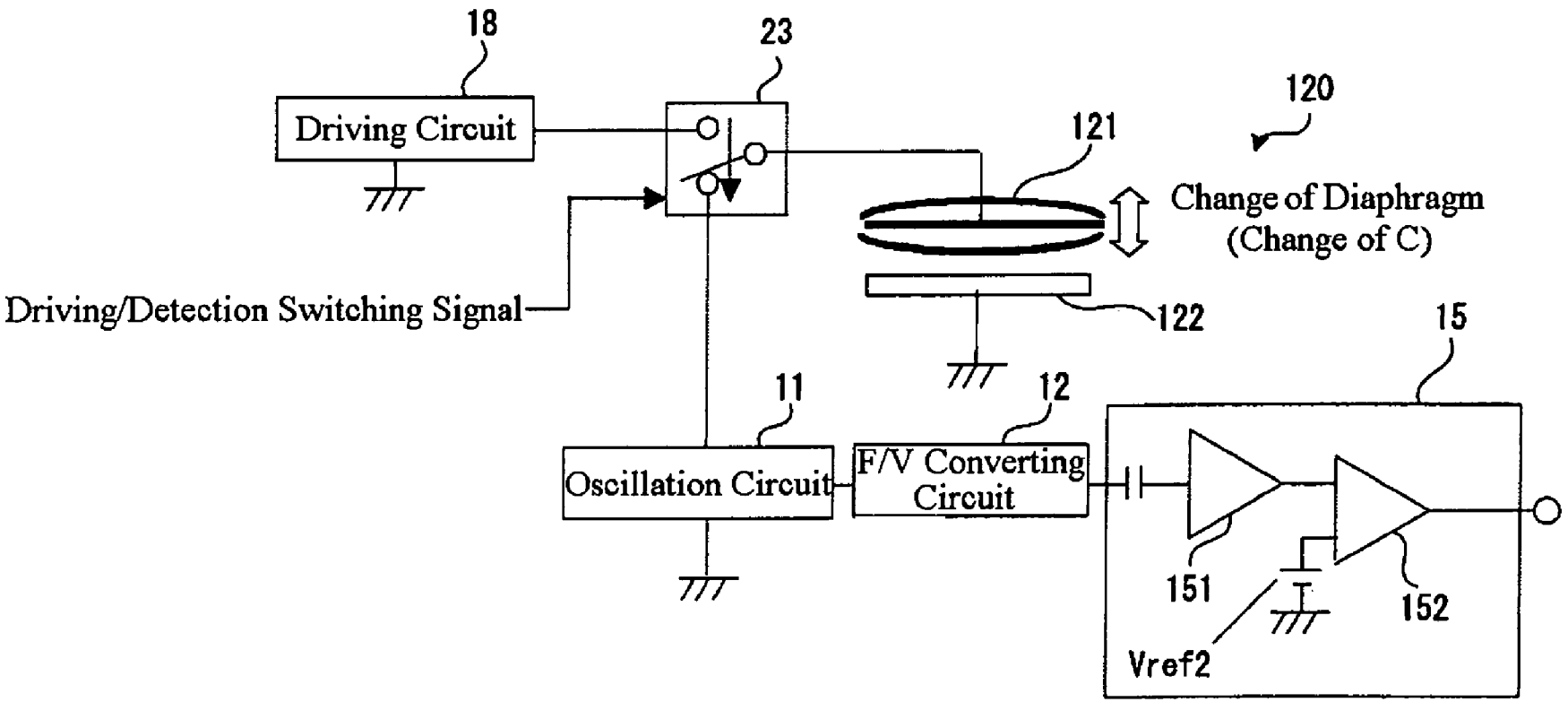
FIG. 23 is a block diagram schematically showing switching means for switching between a driving circuit and a detection circuit.

Next, the switching timing between an ink droplet ejection operation (i.e., driving state) and an ejection failure detection operation (i.e., driving halt state) of the ink jet head 100 will now be described. FIG. 23 is a block diagram schematically showing the switching means 23 for switching the connection of the ink jet head 100 between the driving circuit 18 and the ejection failure detecting means 10. Referring to FIG. 23, the driving circuit 18 in the head driver 33 shown in FIG. 16 will be described as the driving circuit of the ink jet head 100. As shown in the timing chart of FIG. 20, the ejection failure detection processing is carried out in a period between the driving signals for the ink jet head 100, that is, during the driving halt period.

Referring to FIG. 23, the switching means 23 is initially connected to the driving circuit 18 side to drive the electrostatic actuator 120 thereof. As described above, when the driving signal (voltage signal) is inputted from the driving circuit 18 to the diaphragm 121, the electrostatic actuator 120 starts to be driven, and the diaphragm 121 is attracted toward the segment electrode 122. Then, when the applied voltage drops to 0, the diaphragm 121 displaces abruptly in a direction to move away from the segment electrode 122 and starts to vibrate (residual vibration). At this time, an ink droplet is ejected through the nozzle 110 of the ink jet head 100.

When the pulse of the driving signal falls, the driving/detection switching signal is inputted into the switching means 23 in sync with the falling edge thereof (see the timing chart of FIG. 20), and the switching means 23 switches the connection of the diaphragm 121 from the driving circuit 18 to the ejection failure detecting means (detection circuit) 10, so that the electrostatic actuator 120 (used as the capacitor of the oscillation circuit 11) is connected to the ejection failure detecting means 10.

Then, the ejection failure detecting means 10 carries out the detection processing of an ejection failure (missing dot) as described above, and converts the residual vibration waveform data (rectangular wave data) of the diaphragm 121 outputted from the comparator 152 in the waveform shaping circuit 15 into numerical forms, such as the cycle or the amplitude of the residual vibration waveform by means of the measuring means 17. In this embodiment, the measuring means 17 measures a particular vibrational cycle from the residual vibration waveform data, and outputs the measurement result (numerical value) to the judging means 20. In this regard, the measuring means 17 may measure a predetermined time from the residual vibration waveform, such as a time from the falling edge of the driving signal (or the rising edge of the driving/detection switching signal) to the time when the residual vibration occurs, a first half cycle after the occurrence of the residual vibration (or every half cycle), a first quarter cycle after the occurrence of the residual vibration (or every quarter cycle), and the like, in addition to the cycle of the residual vibration. Alternatively, the measuring means 17 may measure a time from the first rising edge to the following falling edge, and output a time two times longer than the measured time (that is, a half cycle thereof) to the judging means 20 as the cycle of the residual vibration.

Figure 24:
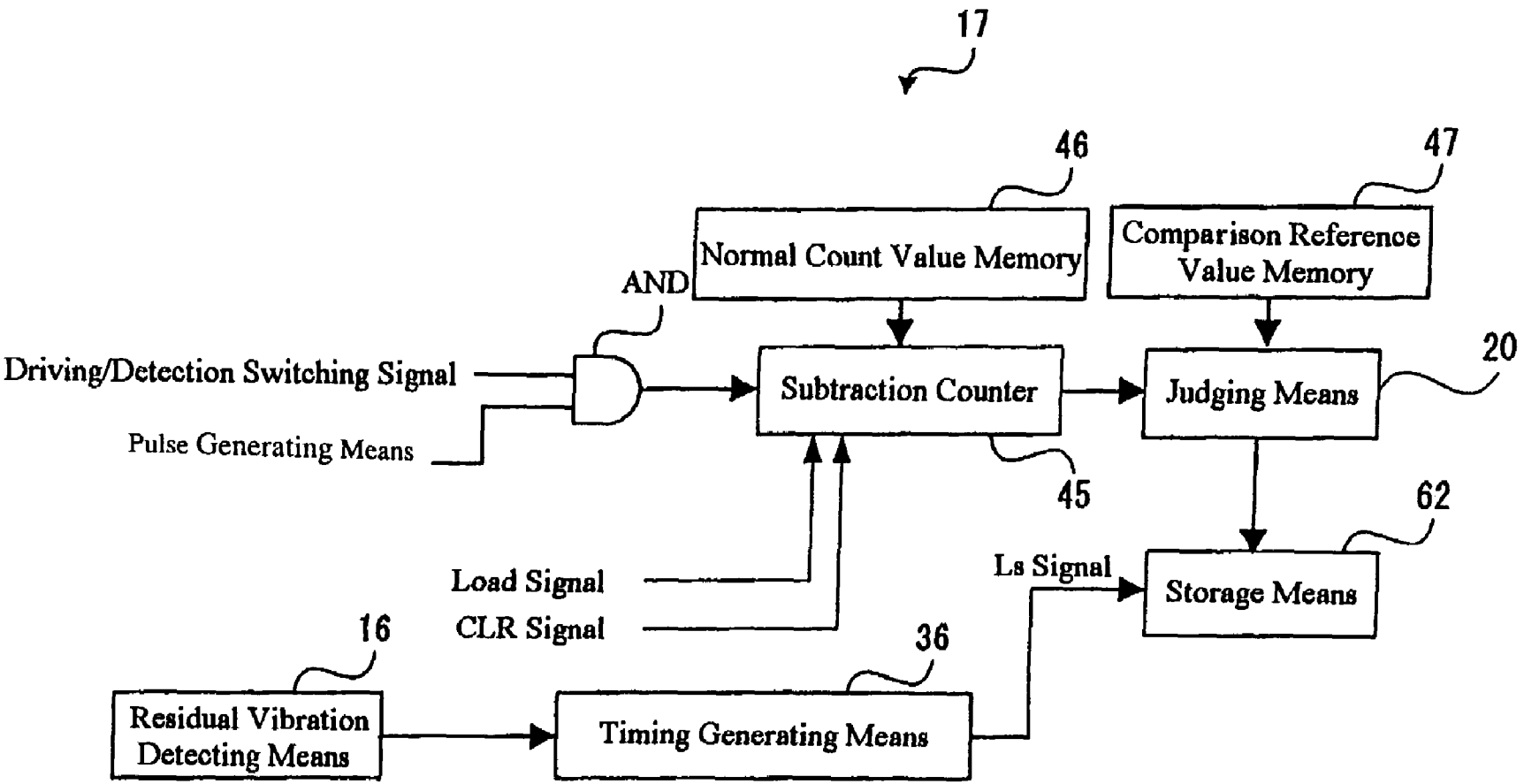
FIG. 24 is a block diagram showing one example of the measuring means of the invention.

FIG. 24 is a block diagram showing one example of the measuring means 17. In order to measure a time until the first rising edge of the waveform (rectangular wave) of the output signal from the comparator 152 and/or a time (cycle of the residual vibration) from the first rising edge to the following rising edge of the waveform of the output signal from the comparator 152, the measuring means 17 subtracts the number of reference pulses by means of a subtraction counter 45, and measures a predetermined time of the residual vibration from the subtraction result. Referring to FIG. 24, the measuring means 17 is constituted from an AND circuit AND, a subtraction counter 45, and a normal count value memory 46. In this case, the reference pulses are generated by pulse generating means (not shown).

As shown in FIG. 24, the AND circuit AND outputs a logical multiply between the driving/detection switching signal and the reference pulses to the subtraction counter 45. In other words, when the driving/detection switching signal is in the high level, the reference pulses are outputted to the subtraction counter 45. When a predetermined count value is inputted from the normal count value memory 46, the subtraction counter 45 holds the value. Then, when the reference pulses are inputted to the subtraction counter 45, the subtraction counter 45 subtracts the number of reference pulses generated for a predetermined time period (a predetermined time) from the predetermined count value. In this regard, the predetermined time period is, for example, a time period until the residual vibration of the diaphragm 121 is generated after an ink droplet has been normally ejected from the inkjet head 100; a time period until a half cycle of the residual vibration of the diaphragm 121 after an ink droplet has been normally ejected from the ink jet head 100; a time period until one cycle of the residual vibration of the diaphragm 121 after an ink droplet has been normally ejected from the ink jet head 100; or the like. Further, the predetermined count value stored in the normal count value memory 46 is the number of pulses counted using the reference pulses for the predetermine time period mentioned above at a normal ejection operation.

Figure 25:
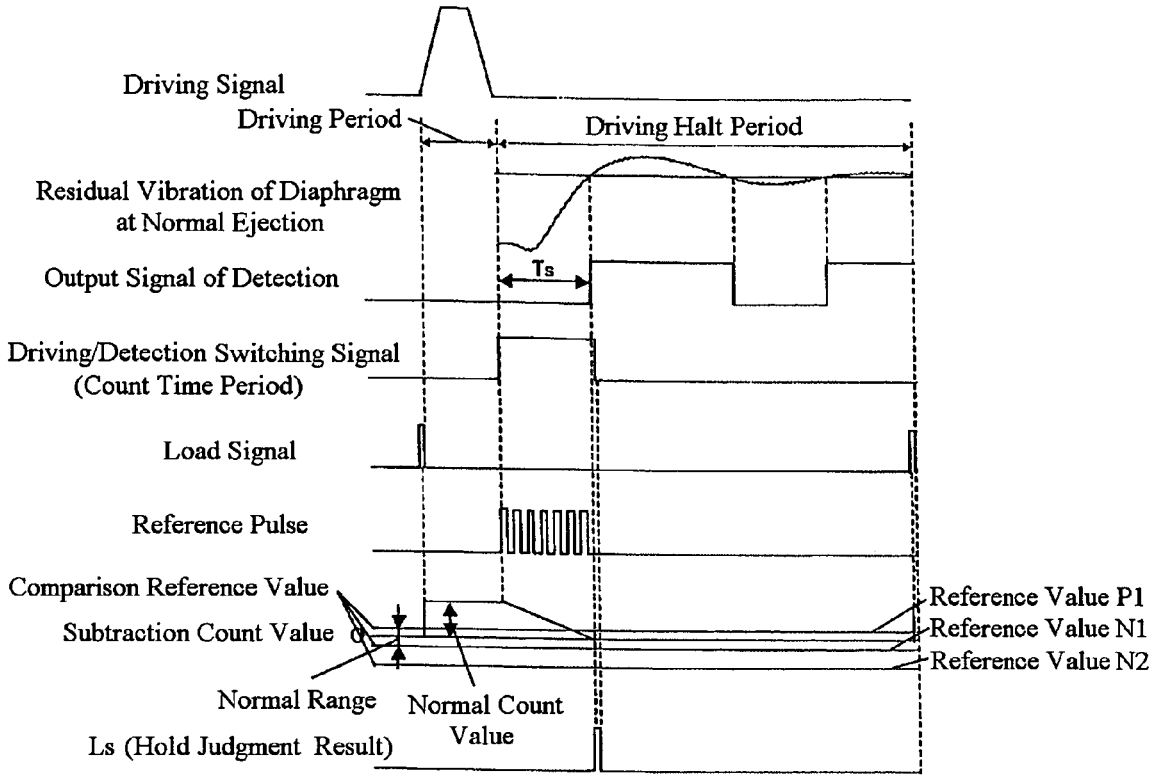
FIG. 25 is a timing chart of a subtraction operation of the subtraction counter shown in FIG. 24.

As shown in the timing chart of FIG. 25, the subtraction counter 45 obtains the predetermined count value (normal count value) from the normal count value memory 46 at the timing when a Load signal is inputted, and opens a gate to receive the reference pulses while the driving/detection switching signal is in the high level, thereby subtracting the number of reference pulses from the normal count value. Then, the subtraction counter 45 outputs the subtraction result to the judging means 20.

Timing generating means 36 generates an Ls signal on the basis of the residual vibration waveform inputted from the residual vibration detecting means 16, and outputs the Ls signal to the storage means 62. In this case, the Ls signal corresponding to the respective ink jet heads 100 is generated in sync with the rising edge or falling edge of the residual vibration waveform continually detected after the ejection driving of each electrostatic actuator 120. The reference pulses may be counted for an arbitrary time period of these edges, and the judgment result of the judging means 20 may be stored into the storage means 62 with the timing of the output of the Ls signal.

The judging means 20 compares the subtraction result obtained in the subtraction processing of the subtraction counter 45 with predetermined reference values (comparison reference values) inputted from a comparison reference value memory 47. Then, at the input timing of the Ls signal in the high level (the time when the Ls signal is in the high level), the judgment result of the judging means 20 is held, and outputted to the storage means 62. In this regard, the predetermined reference value may be set up from some reference values (thresholds), and it is possible to detect and judge a cause of the ejection failure described above (i.e., intrusion of an air bubble, adhesion of paper dust and thickening due to drying) by comparing the judgment result with each of the some reference values. The operation in detail will be described later.

It should be noted that the normal count value memory 46 and the comparison reference value memory 47 may be respectively provided in the ink jet printer 1 as separate memories, and may be shared with the EE PROM (storage means) 62 in the control section 6. Further, such subtraction count processing may be carried out at a driving halt period at which the electrostatic actuators 120 in the ink jet printer 1 are not driven. This makes it possible to carry out detection of an ejection failure without deteriorating the throughput of the ink jet printer 1.

The judging means 20 judges the presence or absence of an ejection failure of the nozzle, the cause of the ejection failure, a comparative deviation, and the like on the basis of the particular vibration cycle (measurement result) of the residual vibration waveform measured by the measuring means 17, and outputs the judgment result to the control section 6. The control section 6 then saves the judgment result in a predetermined storage region of the EE PROM (storage means) 62. The driving/detection switching signal is inputted into the switching means 23 again at the timing at which the following driving signal is inputted from the driving circuit 18, and the driving circuit 18 and the electrostatic actuator 120 are thereby connected to each other. Because the driving circuit 18 holds the ground (GND) level once the driving voltage is applied thereto, the switching means 23 carries out the switching operation as described above (see the timing chart of FIG. 20). This makes it possible to detect the residual vibration waveform of the diaphragm 121 of the electrostatic actuator 120 accurately without being influenced due to a disturbance or the like from the driving circuit 18.

In this regard, in the invention, the residual vibration waveform data is not limited to that made into a rectangular wave by the comparator 152. As the configuration shown in FIG. 24 described above, it may be arranged in such a manner that the residual vibration amplitude data outputted from the operational amplifier 151 is converted into numerical forms by means of the measuring means 17 that carries out the A/D (analog-to-digital) conversion without carrying out the comparison processing by the comparator 152, and then the presence or absence of an ejection failure or the like is judged by the judging means 20 on the basis of the data converted into the numerical forms in this manner, and the judgment result is stored into the storage means 62.

Further, because the meniscus (the surface on which ink within the nozzle 110 comes in contact with air) of the nozzle 110 vibrates in sync with the residual vibration of the diaphragm 121, each of the ink jet heads 100 waits for the residual vibration of the meniscus to be damped in a time substantially determined based on the acoustic resistance r after the ink droplet ejection operation (stand by for a predetermined time), and then starts the following ink droplet ejection operation. In the present invention, because the residual vibration of the diaphragm 121 is detected by effectively using this stand-by time, detection of an ejection failure can be carried out without influencing the driving of the ink jet head 100. In other words, it is possible to carry out the ejection failure detection processing for the nozzle 110 of the ink jet head 100 without reducing the throughput of the ink jet printer 1 (droplet ejection apparatus).

As described above, in the case where an air bubble has intruded into the cavity 141 of the ink jet head 100, because the frequency becomes higher than that of the residual vibration waveform of the diaphragm 121 in the case of normal ejection, the cycle thereof conversely becomes shorter than the cycle of the residual vibration in the case of normal ejection. Further, in the case where ink has thickened or fixed due to drying in the vicinity of the nozzle 110, the residual vibration is over-damped. Hence, because the frequency becomes extremely low in comparison with that of the residual vibration waveform in the case of normal ejection, the cycle thereof becomes markedly longer than the cycle of the residual vibration in the case of normal ejection. Furthermore, in the case where paper dust is adhering in the vicinity of the outlet of the nozzle 110, the frequency of the residual vibration is lower than the frequency of the residual vibration in the case of normal ejection and higher than the frequency of the residual vibration in the case of drying/thickening of ink. Hence, the cycle thereof becomes longer than the cycle of the residual vibration in the case of normal ejection and shorter than the cycle of the residual vibration in the case of drying of ink.

Therefore, by setting a predetermined range Tr as the cycle of the residual vibration in the case of normal ejection, and by setting a predetermined threshold T1 to differentiate the cycle of the residual vibration when paper dust is adhering in the vicinity of the outlet of the nozzle 110 from the cycle of the residual vibration when ink has dried in the vicinity of the nozzle 110, it is possible to determine the cause of such an ejection failure of the ink jet head 100. The judging means 20 judges the cause of an ejection failure depending on whether or not the cycle Tw of the residual vibration waveform detected in the ejection failure detection processing described above is a cycle within the predetermined range, or longer than the predetermined threshold.

Next, the operation of the ejection failure detecting means 10 of the invention will be described with reference to the timing chart of FIG. 25. A method of generating a Load signal, an Ls signal and a CLR signal shown in FIGS. 24 and 25 will be first described. As shown in the timing chart of FIG. 25, the Load signal is a signal that becomes a high level for a short time right before a rising edge of the driving signal outputted from the driving circuit 18. The Ls signal is a signal that becomes a high level in sync with a falling edge of the driving/detection switching signal inputted to the switching means 23 and the AND circuit AND, and holds in the high level for a predetermined time (enough time to store the judgment result into the storage means 62). Further, it is not shown in the timing chart of FIG. 25, but the CLR signal is a signal to clear the subtraction result held in the subtraction counter 45 in the subtraction processing, and is inputted to the subtraction counter 45 at predetermined timing until the Load signal is inputted after the output of the Ls signal.

The ejection failure detecting means 10 operates in response to a group of signals generated in this way. When the Load signal is inputted to the subtraction counter 45 right before the rising edge of the driving signal outputted from the driving circuit 18, a normal count value is inputted from the normal count value memory 46 to the subtraction counter 45 and held therein at this timing. When the ejection driving operation of the ink jet head 100 (driving period) is terminated, the driving/detection switching signal is inputted to the switching means 23 and the AND circuit AND in sync with the falling edge of the driving signal. Then, the switching means 23 switches the connection of the electrostatic actuator 120 from the driving circuit 18 to the oscillation circuit 11 in response to the driving/detection switching signal (see FIG. 23).

The capacitance C in the oscillation circuit 11 is varied in response to the residual vibration of the diaphragm 121, whereby the oscillation circuit 11 starts to oscillate. The subtraction counter 45 opens the gate in sync with the rising edge of the driving/detection switching signal (in this case, because the reference pulses are inputted to the subtraction counter 45 only when the driving/detection switching signal is in the high level by means of the AND circuit AND, the gate may be held in the open state), and carries out the subtraction processing, in which the number of reference pulses is subtracted from the normal count value, while the driving/detection switching signal remains in the high level (i.e., for the time period Ts). The time period Ts is a time period until the residual vibration of the diaphragm 121 occurs (the residual vibration is generated) after a normal ejection operation, and more specifically, it is a time period until the diaphragm 121 returns to the position, where the diaphragm 121 is positioned when the electrostatic actuator 120 is not driven, after an ink droplet was ejected from the ink jet head 100.

In the timing chart of FIG. 25, after switching the connection from the driving circuit 18 to the ejection failure detecting means 10, the judgment of the ejection failure is carried out on the basis of the normal count value in the time period until the residual vibration of the diaphragm 121 occurs. The driving/detection switching signal falls to the low level and the Ls signal is generated at the timing when the residual vibration occurs (i.e., at the timing when the diaphragm 121 returns to a initial state position). Then, the judging means 20 carries out predetermined judgment processing on the basis of the subtraction result of the subtraction counter 45, and the judgment result is stored into the storage means 62. In this regard, each of the reference values N1, N2, and P1 (that is, comparison reference values) in FIG. 25 is a predetermined threshold as shown in TABLE 1 of FIG. 28. The cause of the ejection failure is judged on the basis of differences between these thresholds and the subtraction result (subtraction count value).

Figure 26:
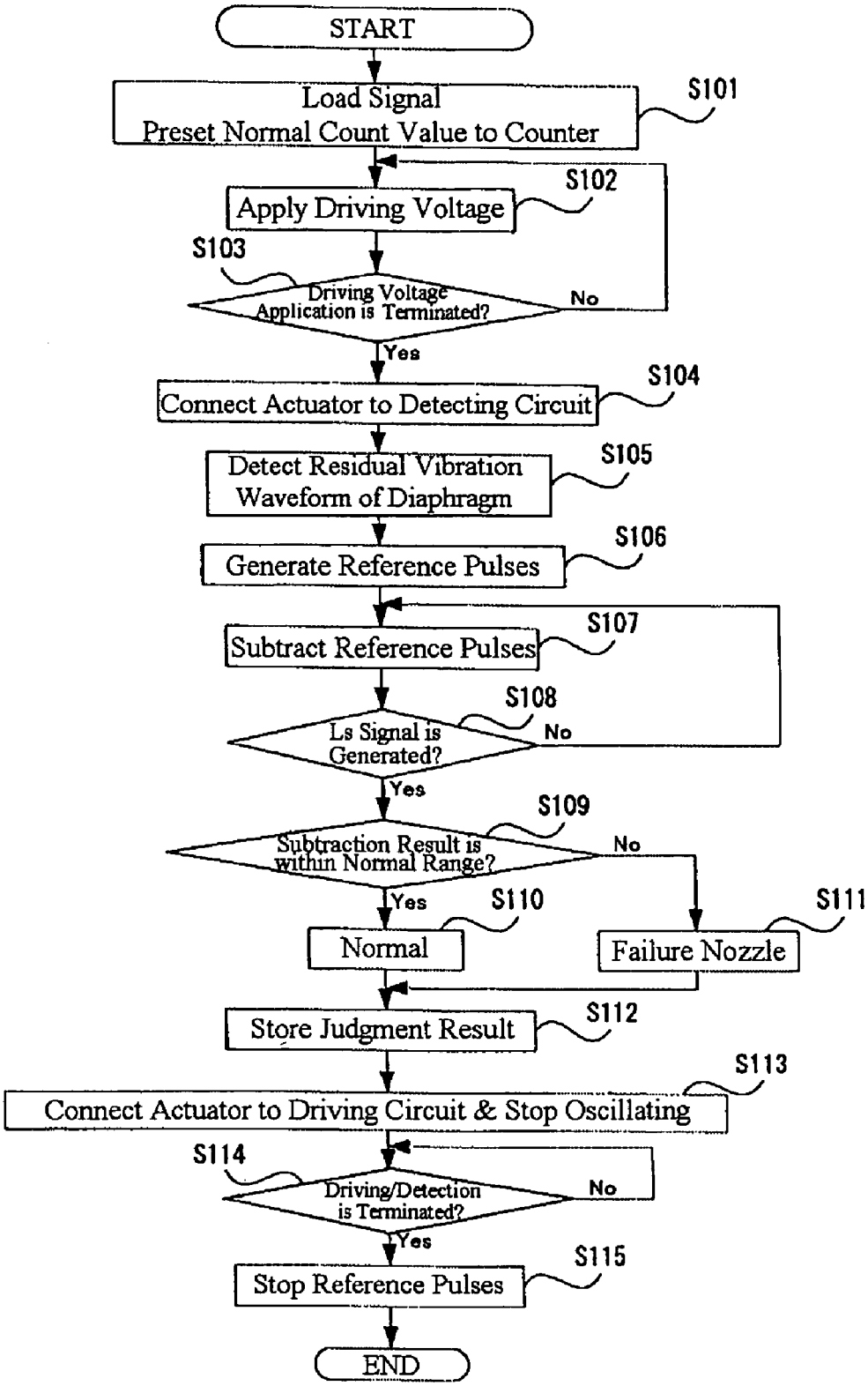
FIG. 26 is a flowchart showing ejection failure detecting processing in one embodiment of the invention.

Next, ejection failure detecting processing when an ejection failure is detected on the basis of the time period until the residual vibration of the diaphragm 121 is generated (occurs). FIG. 26 is a flowchart showing ejection failure detecting processing of the droplet ejection heads in one embodiment of the invention. When printing data to be printed (or ejection data used for the flushing operation) is inputted into the control section 6 from the host computer 8 via the interface (IF) 9, the ejection failure detection processing is carried out at the predetermined timing. In this regard, in the flowchart shown in FIG. 23, the ejection failure detection processing corresponding to an ink ejection operation of one ink jet head 100, that is, one nozzle 110, will be described for ease of explanation.

Initially, the Load signal is inputted into the subtraction counter 45 at the timing right before input of the driving signal (here, it is not limited to this timing), the normal count value is inputted (preset) from the normal count value memory 46 (Step S101). Then, the driving signal corresponding to the printing data (ejection data) is inputted from the driving circuit 18 of the head driver 33, whereby the driving signal (voltage signal) is applied between both electrodes of the electrostatic actuator 120 according to the timing of the driving signal as shown in the timing chart of FIGS. 20 and 25 (Step S102). The control section 6 then judges whether or not input of the driving signal (voltage signal) into the electrostatic actuator 120 is terminated (Step S103). In the case where it is judged that the input of the driving signal is terminated, the driving/detection switching signal is inputted into the switching means 23 from the control section 6.

When the driving/detection switching signal is inputted into the switching means 23, the electrostatic actuator 120, that is, the capacitor constituting the oscillation circuit 11 is isolated from the driving circuit 18 by the switching means 23, and is connected to the ejection failure detecting means 10 (detection circuit) side, that is, to the oscillation circuit 11 of the residual vibration detecting means 16 (Step S104). Subsequently, the oscillation circuit 11 is constituted on the basis of a capacitance (capacitor) of the electrostatic actuator 120, and the oscillation pulses are outputted from the oscillation circuit 11, whereby the residual vibration of the diaphragm 121 is detected (Step S105). At the same time, the reference pulses are outputted (Step S106) to the subtraction counter 45. The subtraction counter 45 subtracts the number of reference pulses from the normal count value inputted from the normal count value memory 46 (Step S107).

At Step S108, the control section 6 judges whether or not the Ls signal is generated by the timing generating means 36, that is, the time Ts elapses. The subtraction counter 45 carries out this subtraction processing until the Ls signal is generated. Once the Ls signal is generated, the subtraction result obtained by the subtraction processing is outputted to the judging means 20. The judging means 20 judges whether or not the subtraction result is within a normal range (or normal count range) (i.e., the range between the reference values N1 and P1) (Step S109).

In the case where it is judged that the subtraction result is within the normal range, the judging means 20 judges that the ink droplet has been normally ejected (Step S110). On the other hand, in the case where the subtraction result is not within the normal range, the judging means 20 judges that the ink jet head 100 is in an ejection failure state (i.e., the ink jet head 100 has a failure nozzle 110) (Step S111). Subsequently, the judgment result by the judging means 20 is stored (held) in the storage means 62 (Step S112). In response to the driving/detection switching signal, the connection of the electrostatic actuator 120 is switched from the oscillation circuit 11 to the driving circuit 18, thereby stopping the oscillation of the oscillation circuit 11 (Step S113).

At Step S114, it is judged whether or not the ejection driving processing is terminated. In the case where it is judged that this processing is not terminated, the control section 6 stands by (wait) at Step S114 until the driving signal is inputted. On the other hand, in the case where it is judged that this processing is terminated, the pulse generating means stops generating the reference pulses (Step S115), and this ejection failure detecting processing is terminated.

In this way, in the ejection failure detecting processing for the droplet ejection heads of the invention, it is possible to detect presence or absence of an ejection failure for the ink jet head 100 and a cause of the ejection failure in the event of ejection failure are detected with a simple configuration by subtracting the number of reference pulses from the normal count value and comparing the subtraction result with the predetermined reference value (comparison reference value).

Figure 27:
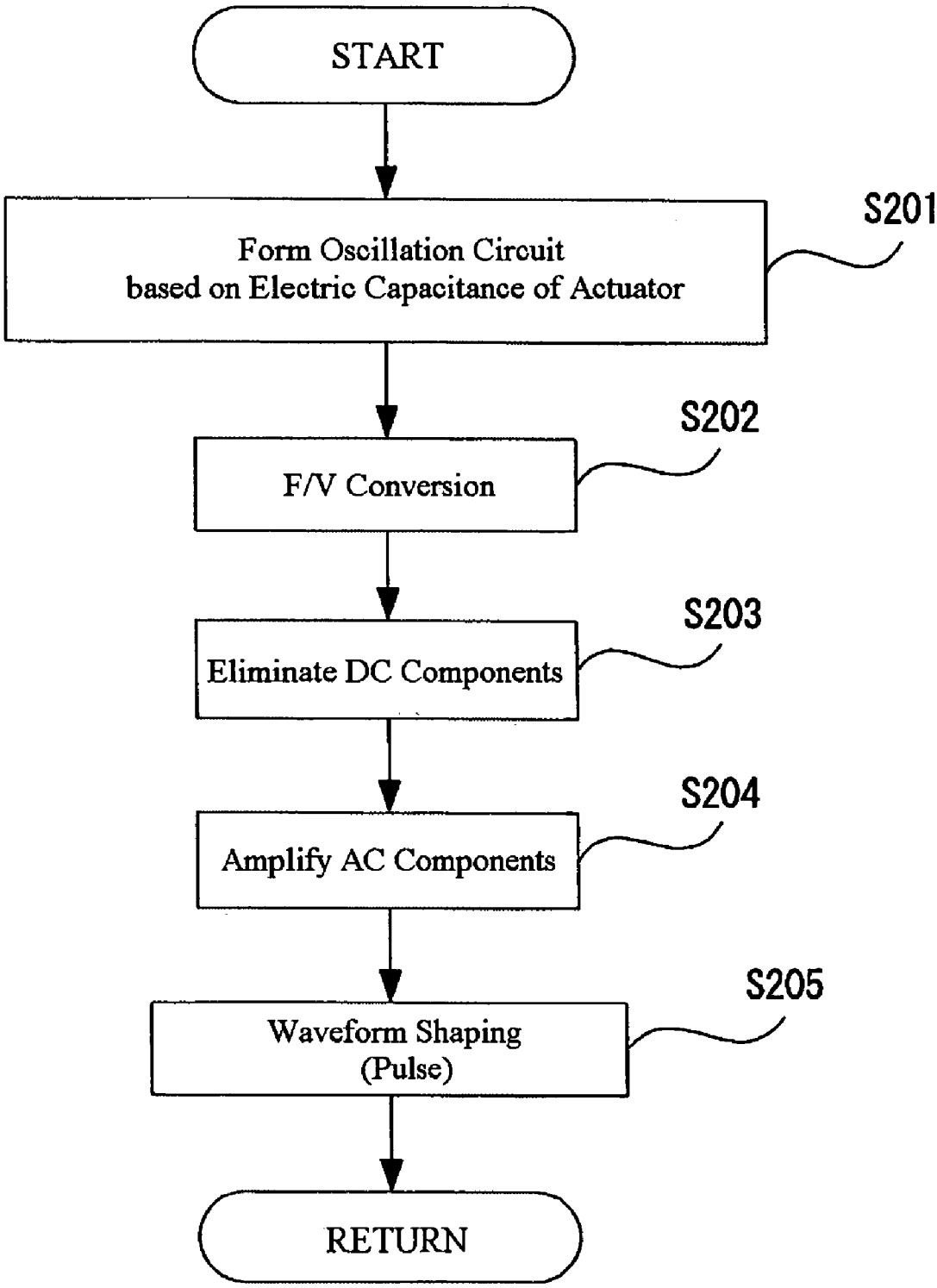
FIG. 27 is a flowchart showing residual vibration detection processing of the invention.

Next, the residual vibration detection processing (sub routine) at Step S104 of the flowchart shown in FIG. 24 will now be described. FIG. 27 is a flowchart showing the residual vibration detection processing of the invention. When the electrostatic actuator 120 and the oscillation circuit 11 are connected to each other by the switching means 23 as described above, the oscillation circuit 11 forms a CR oscillation circuit, and starts to oscillate in response to the change of the electric capacitance of the electrostatic actuator 120 (residual vibration of the diaphragm 121 of the electrostatic actuator 120) (Step S201).

As shown in the timing chart described above (see FIGS. 20 and 25), the charging signal, the hold signal and the clear signal are generated in the F/V converting circuit 12 according to the output signal (pulse signal) from the oscillation circuit 11, and the F/V conversion processing is carried out according to these signals by the F/V converting circuit 12, by which the frequency of the output signal from the oscillation circuit 11 is converted into a voltage (Step S202), and then the residual vibration waveform data of the diaphragm 121 is outputted from the F/V converting circuit 12. The DC components (direct current components) are eliminated from the residual vibration waveform data outputted from the F/V converting circuit 12 in the capacitor C3 of the waveform shaping circuit 15 (Step S203), and the residual vibration waveform (AC components) from which the DC components have been eliminated is amplified in the operational amplifier 151 (Step S204).

The residual vibration waveform data after the amplification is subjected to waveform shaping in the predetermined processing and converted into pulses (Step S205). In other words, in this embodiment, the voltage value (predetermined voltage value) set by the direct current voltage source Vref2 is compared with the output voltage from the operational amplifier 151 in the comparator 152. The comparator 152 outputs the binarized waveform (rectangular wave) on the basis of the comparison result. The output signal from the comparator 152 is the output signal from the residual vibration detecting means 16, and is outputted to the measuring means 17 for the above-mentioned ejection failure judgment processing to be carried out, upon which the residual vibration detection processing is completed (terminated).

Figure 29:
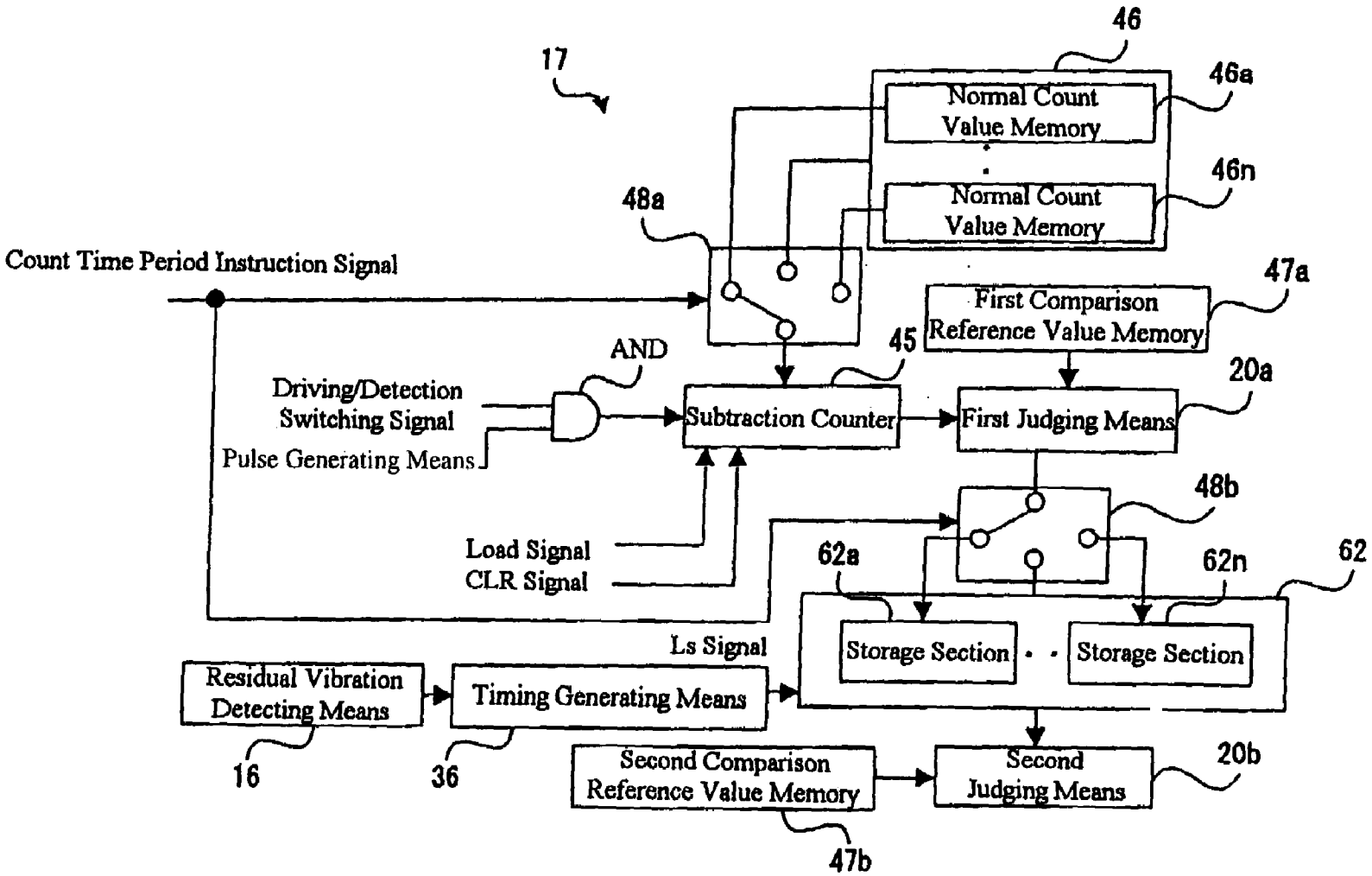
FIG. 29 is a block diagram showing another example of the measuring means of the invention.

Next, measuring means 17 in another embodiment of the invention will be described. Here, the case where an ejection failure is detected in response to a time period of every half cycle at the normal ejection operation will be explained. FIG. 29 is a block diagram showing another example of the measuring means of the invention. In this regard, only components different from those in FIG. 24 will be described, the components having similar functions to those in the block diagram of FIG. 24 are designated as the same reference numerals, and explanations thereof will be omitted.

The measuring means 17 is constituted from an AND circuit AND, a subtraction counter 45, and a normal count value memory 46 including a plurality of normal count value memory sections 46*a* through 46*n*. In this regard, a first selector 48*a* for selecting any one of these normal count value memory sections 46*a* through 46*n*, a first comparison reference value memory 47*a*, first judging means 20*a*, storage means 62 including a plurality of storage sections 62*a* through 62*n*, a second selector 48*b* for selecting any one of these storage sections 62*a* through 62*n*, a second comparison reference value memory 47*b*, and second judging means 20*b* are shown in FIG. 29.

The first selector 48*a* selects a normal count value (stored in the normal count value memory section) to be inputted into the subtraction counter 45 at the predetermined timing of the residual vibration at the normal ejection operation. The second selector 48*b* selects one of the storage sections 62*a* through 62*n* (in the storage means 62) for storing a judgment result of the first judging means 20*a* (it has a same configuration of the judging means 20 described above) in response to one of the normal count value memory sections 46*a* through 46*n* selected by the first selector 48*a*.

The second judging means 20*b* finally judges presence or absence of an ejection failure of the ink jet head 100 and a cause thereof on the basis of the judgment results stored in the plurality of storage sections 62*a* through 62*n* (in the storage means 62) as shown in Table 2 of FIG. 33. In this regard, sequences as shown in Table 2 of FIG. 33 are stored in the second comparison reference value memory 47*b*, and they are outputted to the second judging means 20*b* at predetermined timing.

Figure 30:
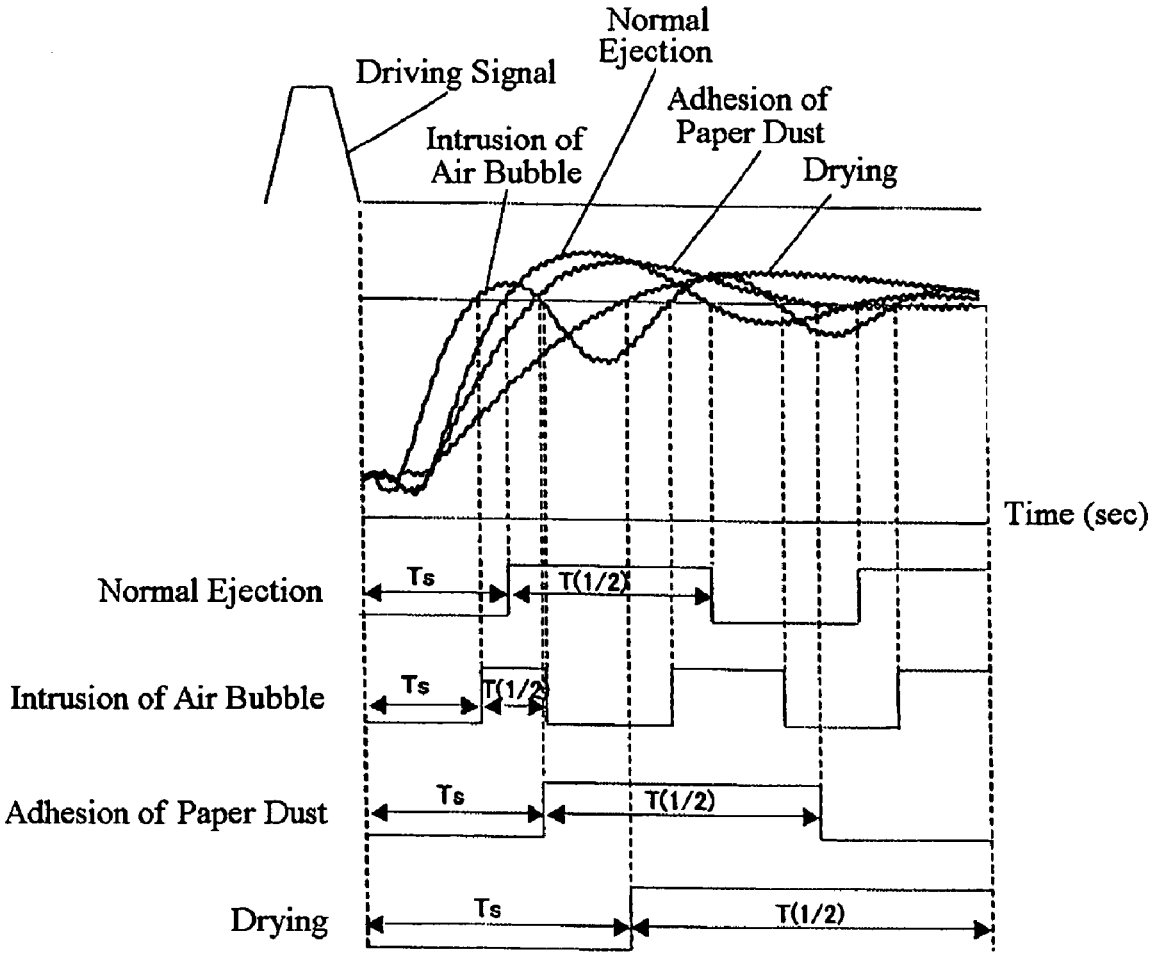
FIG. 30 is a drawing showing the residual vibration waveforms in the case where the ejection failures occur in the ink jet head and an ink droplet is normally ejected.

FIG. 30 is a drawing showing the residual vibration waveforms in the case where the ejection failures occur in the ink jet head 100 and an ink droplet is normally ejected. As shown in FIG. 30, it is possible to judge (identify) the cause of the ejection failure so that the cause is intrusion of an air bubble in the case where the time period Ts until the residual vibration occurs at the respective states is shorter than the time period Ts at the normal ejection, and the cause is adhesion of paper dust or thickening due to drying in the case where the time period Ts until the residual vibration occurs at the respective states is longer than the time period Ts at the normal ejection. In addition, it is possible to obtain the similar result in the case where the first half cycles at the respective states are compared. In this invention, in order to identify (detect) the cause of the ejection failure more accurately, the judging result on the cycle of the residual vibration may be prioritized over the judging result on the time period Ts until the occurrence of the residual vibration.

Figure 31:
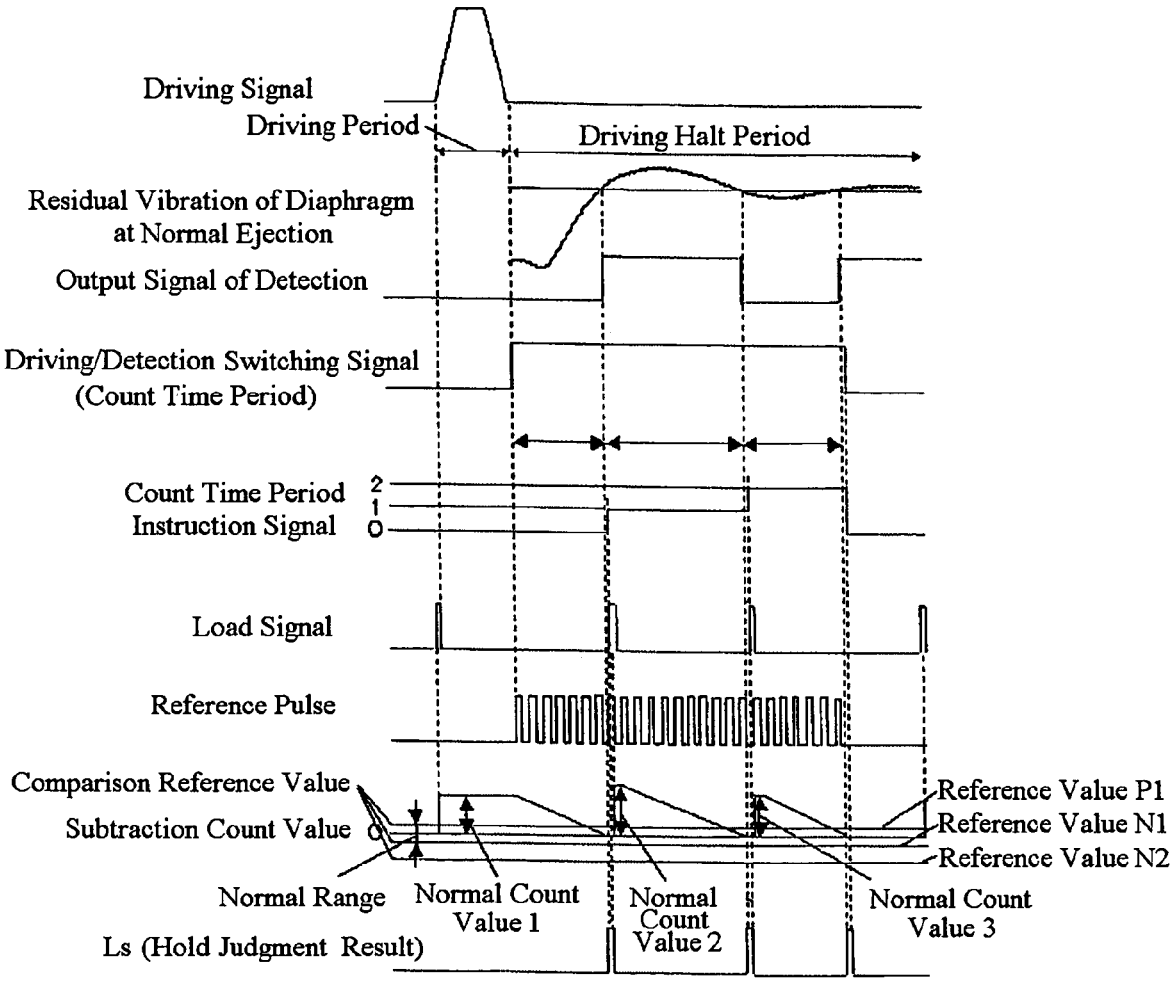
FIG. 31 is a timing chart (every half cycle) of the subtraction processing of the subtraction counter shown in FIG. 29.

The operation of the ejection failure detecting means 10 will now be described with reference to a timing chart in FIG. 31. FIG. 31 is a timing chart (every half cycle) of the subtraction processing of the subtraction counter 45 shown in FIG. 29. When a count period instruction signal is zero, a first driving signal is inputted right before input of a driving signal, whereby a normal count value 1 is inputted into the subtraction counter 45. The subtraction counter 45 opens a gate in sync with a falling edge of the driving signal to start the subtraction processing. An Ls signal is inputted to the storage means 62 at the occurrence of the residual vibration (i.e., at the time when the diaphragm 121 first returns to a steady-state position (an initial position)), and the subtraction result at this time thereby is stored in the storage section 62*a*. The CLR signal and Load signal are inputted into the subtraction counter 45 at this time, and then the subtraction result until this time is cleared and the following normal count value 2 is inputted from the normal count value memory 46 to the subtraction counter 45.

Hereinafter, the same subtraction processing is repeated, whereby the subtraction results from the respective normal count values are stored in the storage means 62. When comparison reference values (see Table 2 in FIG. 33) are inputted from the second comparison reference value 47*b*, the second judging means 20*b* finally judges presence or absence of an ejection failure of the corresponding ink jet head 100 and a cause of the ejection failure on the basis of the comparison reference values.

Figure 32:
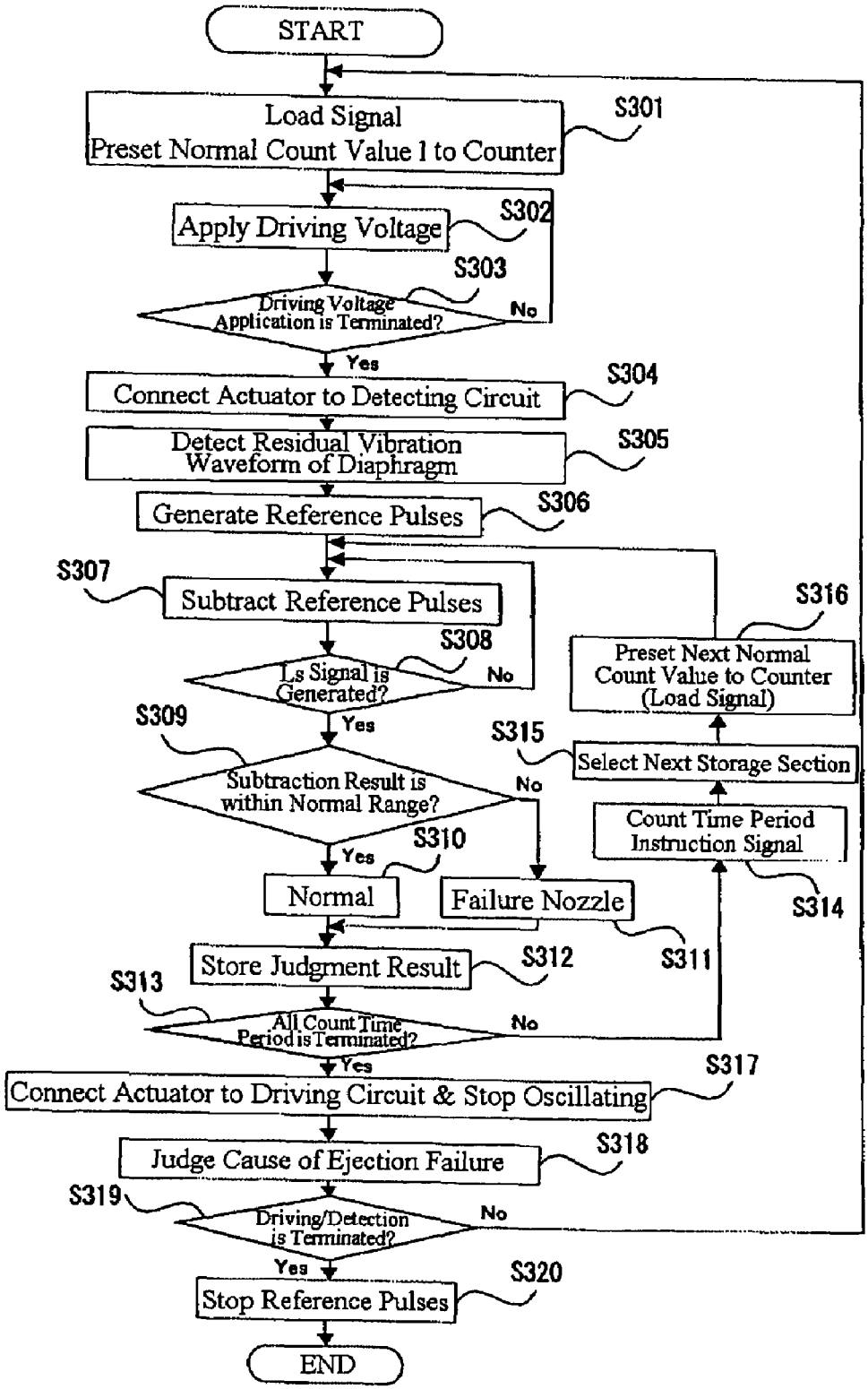
FIG. 32 is a flowchart showing the ejection failure detecting processing in another embodiment of the invention.

Next, the ejection failure detecting processing in the case where an ejection failure is detected in response to the time periods for every half cycle of the residual vibration at the normal ejection operation will now be described. FIG. 32 is a flowchart showing the ejection failure detecting processing for the ink jet heads in another embodiment of the invention. As well as the flowchart of FIG. 26, the ejection failure detecting processing is carried out at predetermined timing such as the timing when printing data is inputted into the ink jet printer 1.

Initially, the Load signal is inputted into the subtraction counter 45 at the timing right before input of the driving signal (here, it is not limited to this timing), the normal count value is inputted (preset) from the normal count value memory 46 (Step S301). Then, the driving signal corresponding to the printing data (ejection data) is inputted from the driving circuit 18 of the head driver 33, whereby the driving signal (voltage signal) is applied between both electrodes of the electrostatic actuator 120 according to the timing of the driving signal as shown in the timing chart of FIG. 31 (Step S302). The control section 6 then judges whether or not input of the driving signal (voltage signal) into the electrostatic actuator 120 is terminated (Step S303). In the case where it is judged that the input of the driving signal is terminated, the driving/detection switching signal is inputted into the switching means 23 from the control section 6.

When the driving/detection switching signal is inputted into the switching means 23, the electrostatic actuator 120, that is, the capacitor constituting the oscillation circuit 11 is isolated from the driving circuit 18 by the switching means 23, and is connected to the ejection failure detecting means 10 (detection circuit) side, that is, to the oscillation circuit 11 of the residual vibration detecting means 16 (Step S304). Subsequently, the oscillation circuit 11 is constituted on the basis of a capacitance (capacitor) of the electrostatic actuator 120, and the oscillation pulses are outputted from the oscillation circuit 11, whereby the residual vibration of the diaphragm 121 is detected (Step S305). At the same time, the reference pulses are outputted (Step S306), and they are inputted into the subtraction counter 45. Then, the subtraction counter 45 subtracts the number of reference pulses from the first normal count value 1 (Step S307). This subtraction processing is carried out until a predetermined count time period, that is, for the time period until the residual vibration is generated after the switching means 23 carried out the switching operation is terminated. When the count time period is terminated, that is, when the Ls signal is generated (Step S308), the processing proceeds to the judging processing.

At Step S309, the first judging means 20*a* judges whether or not the subtraction result of the subtraction counter 45 is within a range for the normal count value (i.e., the range between the reference values N1 and P1: the normal range). In the case where it is judged that the subtraction result is within the range for the normal count value, the first judging means 20*a* judges that the ink droplet has been normally ejected (Step S310). On the other hand, in the case where the subtraction result is not within the range for the normal count value, the first judging means 20*a* judges that the ink jet head 100 is in an ejection failure state (i.e., the ink jet head 100 has a failure nozzle 110) (Step S311).

Subsequently, the judgment result by the first judging means 20*a* is stored (held) in the storage section 62*a* of the storage means 62 (Step S312). The control section 6 judges whether or not the subtraction processing is terminated for all the count time periods (Step S313). In this case, because the subtraction processing is not carried out for every half cycle of the residual vibration, the control section 6 proceeds to Step S314, and the count time period instruction signal increments by one (see the timing chart of FIG. 31). Thus, the following storage section 62*b* is selected by the second selector 48*b* (Step S315), and the following normal count value memory section 46*b* is selected by the first selector 48*a* to preset the normal count value 2 to the subtraction counter 45 (Step S316). Then, the control section 6 repeats the same processing after Step S307.

In the case where it is judged at Step S313 that the subtraction processing (first judging processing) is terminated for all the count time periods, the connection of the electrostatic actuator 120 is switched from the oscillation circuit 11 to the driving circuit 18 in response to the driving/detection switching signal, thereby stopping the oscillation of the oscillation circuit 11 (Step S317). The second judging means 20*b* carries out the ejection failure judging processing for the ink jet head 100 on the basis of the first judgment results stored in the plurality of storage sections 62*a* through 62*n* (in the storage means 62) and the second comparison reference values (Step S318). At Step S319, it is judged whether or not the ejection driving processing is terminated. In the case where it is judged that this processing is terminated, the pulse generating means stops generating the reference pulses (Step S320), and the ejection failure detecting processing is terminated. On the other hand, in the case where it is judged that this processing is not terminated, the control section 6 proceeds to Step S301 and repeats the processing in the same manner.

In this way, in the ejection failure detecting processing for the droplet ejection heads of the invention, the number of reference pulses is subtracted from the respective normal count values at a plurality of times and these subtraction results are compared with predetermined reference values (comparison reference values). Hence, it is possible to detect presence or absence of an ejection failure for the ink jet head 100 and a cause of the ejection failure in the event of ejection failure are detected with a simple configuration.

As described above, the droplet ejection apparatus of the invention (ink jet printer 1) is provided with the plurality of droplet ejection heads (ink jet heads 100), each of the droplet ejection heads including: the diaphragm 121; the electrostatic actuator 120 which displaces the diaphragm 121; a cavity 141 filled with a liquid (ink), an internal pressure of the cavity 141 being increased and decreased in response to displacement of the diaphragm 121; and a nozzle 110 communicated with the cavity 141, through which the liquid is ejected in the form of droplets in response to the increase and decrease of the internal pressure of the cavity 141; the driving circuit 18 which drives the electrostatic actuator 120 of each droplet ejection head; pulse generating means for generating reference pulses; the counter (subtraction counter) for counting the number of reference pulses generated for a predetermined time period; and the ejection failure detecting means 10 for detecting an ejection failure of the droplets on the basis of the count value of the counter 45 counted for the predetermined time period.

Therefore, according to the droplet ejection apparatus and the method of detecting the ejection failure in the droplet ejection heads of the invention, compared with the conventional droplet ejection apparatus and the droplet ejection head capable of detecting an ejection failure (missing dot) (for example, an optical detecting method), the droplet ejection apparatus of this embodiment as described above does not need other parts (for example, optical missing dot detecting device or the like) in order to detect the ejection failure. As a result, not only an ejection failure of the droplets can be detected accurately without increasing the size of the droplet ejection head, but also the manufacturing costs of the droplet ejection apparatus capable of carrying out an ejection failure (missing dot) detecting processing can be reduced. Further, in the droplet ejection apparatus of the invention, because the droplet ejection apparatus detects an ejection failure of the droplets through the use of the residual vibration of the diaphragm after the droplet ejection operation, an ejection failure of the droplets can be detected even during the printing operation. Hence, even though the method of detecting the ejection failure in the droplet ejection heads (the ejection failure detecting processing) of the invention is carried out during the printing operation, the throughput of the droplet ejection apparatus of the invention will be neither reduced nor deteriorated.

Moreover, according to the droplet ejection apparatus of the invention, it is possible to judge a cause of an ejection failure of droplets, which the apparatus such as an optical detecting apparatus capable of carrying out a conventional missing dot detection operation cannot judge. Therefore, it is possible to select and carry out appropriate recovery processing in accordance with the cause if needed.

Furthermore, in the droplet ejection apparatus of the invention, the cause of the ejection failure is detected and identified on the basis of the time period until the occurrence of the residual vibration of the diaphragm and the cycle of the residual vibration. Hence, it is possible to carry out the identification of the cause of the ejection failure more accurately.

Second Embodiment

Examples of other configurations of the ink jet head of the invention will now be described. FIGS. 34-37 are cross sectional views each schematically showing an example of other configuration of the ink jet head 100 (head unit 35). Hereinafter, an explanation will be given with reference to these drawings; however, differences from the first embodiment described above are chiefly described, and the description of the similar portions is omitted.

Figure 34:
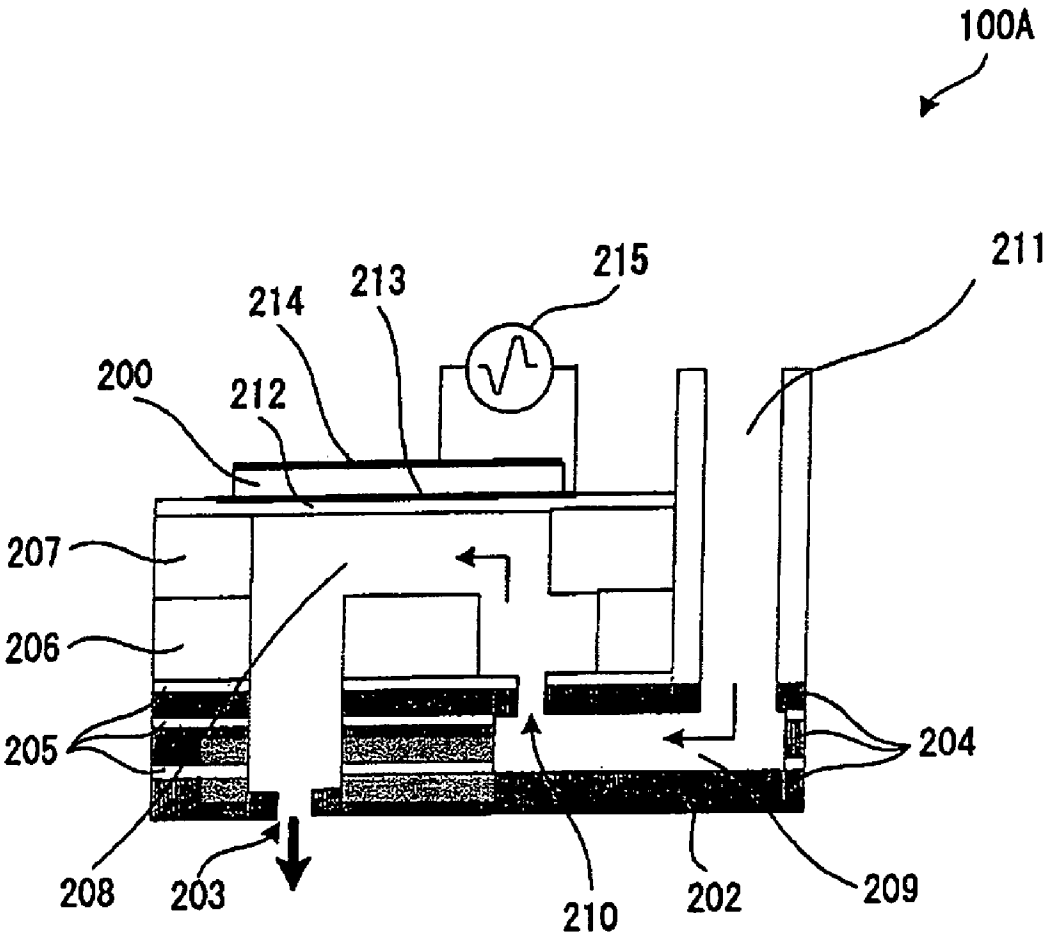
FIG. 34 is a cross sectional view schematically showing an example of another configuration of the ink jet head of the invention.

An ink jet head 100A shown in FIG. 34 is one that ejects ink (liquid material) within a cavity 208 through a nozzle 203 as a diaphragm 212 vibrates when a piezoelectric element 200 is driven. A metal plate 204 made of stainless steel is bonded to a nozzle plate 202 made of stainless steel in which the nozzle (hole) 203 is formed, via an adhesive film 205, and another metal plate 204 made of stainless steel is further bonded to the first-mentioned metal plate 204 via an adhesive film 205. Furthermore, a communication port forming plate 206 and a cavity plate 207 are sequentially bonded to the second-mentioned metal plate 204.

The nozzle plate 202, the metal plates 204, the adhesive films 205, the communication port forming plate 206, and the cavity plate 207 are molded into their respective predetermined shapes (a shape in which a concave portion is formed), and the cavity 208 and a reservoir 209 are defined by laminating these components. The cavity 208 and the reservoir 209 communicate with each other via an ink supply port 210. Further, the reservoir 209 communicates with an ink intake port 211.

The diaphragm 212 is placed at the upper surface opening portion of the cavity plate 207, and the piezoelectric element 200 is bonded to the diaphragm 212 via a lower electrode 213. Further, an upper electrode 214 is bonded to the piezoelectric element 200 on the opposite side of the lower electrode 213. A head driver 215 is provided with a driving circuit that generates a driving voltage waveform. The piezoelectric element 200 starts to vibrate when a driving voltage waveform is applied (supplied) between the upper electrode 214 and the lower electrode 213, whereby the diaphragm 212 bonded to the piezoelectric element 200 starts to vibrate. The volume (and the internal pressure) of the cavity 208 varies with the vibration of the diaphragm 212, and ink (liquid) filled in the cavity 208 is thereby ejected through the nozzle 203 in the form of droplets.

A reduced quantity of liquid (ink) in the cavity 208 due to the ejection of droplets is replenished with ink supplied from the reservoir 209. Further, ink is supplied to the reservoir 209 through the ink intake port 211.

Figure 35:
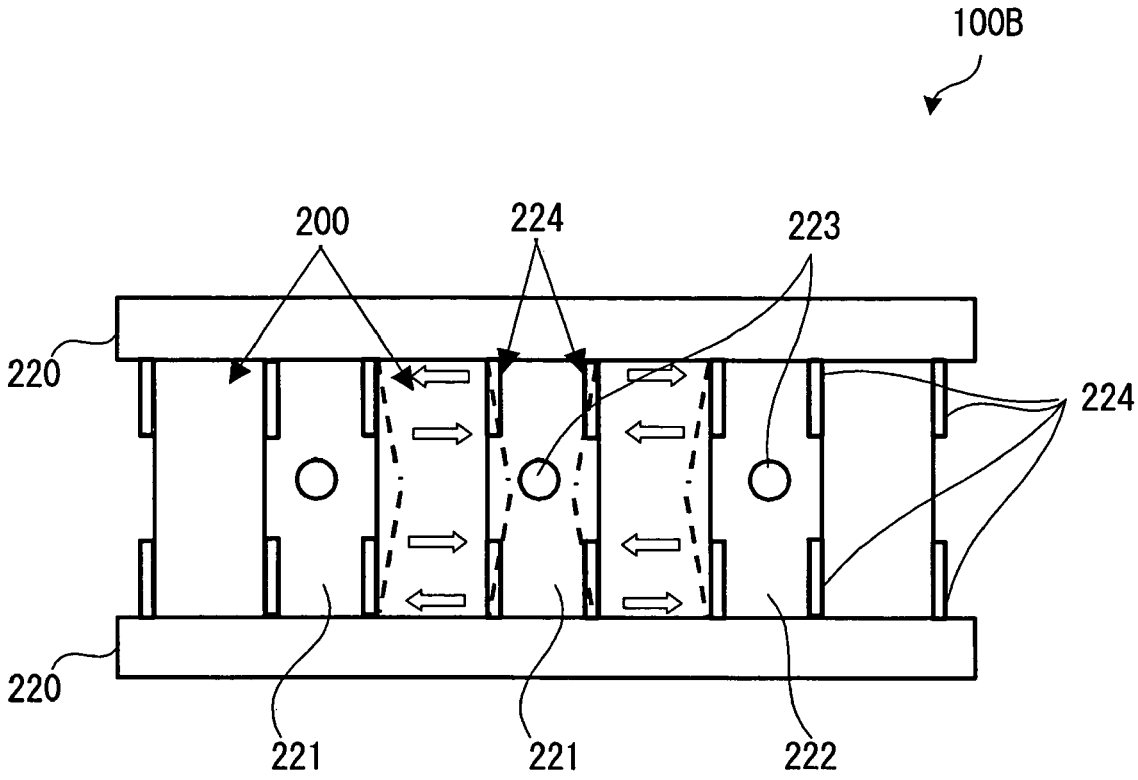
FIG. 35 is a cross sectional view schematically showing an example of still another configuration of the ink jet head of the invention.

Likewise, an ink jet head 100B shown in FIG. 35 is one that ejects ink (liquid material) within a cavity 221 through a nozzle 223 when the piezoelectric element 200 is driven. The ink jet head 100B includes a pair of opposing substrates 220, and a plurality of piezoelectric elements 200 are placed intermittently at predetermined intervals between both substrates 220.

Cavities 221 are formed between adjacent piezoelectric elements 200. A plate (not shown) and a nozzle plate 222 are placed in front and behind the cavities 221 of FIG. 35, respectively, and nozzles (holes) 223 are formed in the nozzle plate 222 at positions corresponding to the respective cavities 221.

Pairs of electrodes 224 are placed on one and the other surfaces of each piezoelectric element 200. That is to say, four electrodes 224 are bonded to one piezoelectric element 200. When a predetermined driving voltage waveform is applied between predetermined electrodes of these electrodes 224, the piezoelectric element 200 undergoes share-mode deformation and starts to vibrate (indicated by arrows in FIG. 35). The volume of the cavities 221 (internal pressure of cavity) varies with the vibration, and ink (liquid material) filled in the cavities 221 is thereby ejected through nozzles 223 in the form of droplets. In other words, the piezoelectric elements 200 per se function as the diaphragms in the ink jet head 100B.

Figure 36:
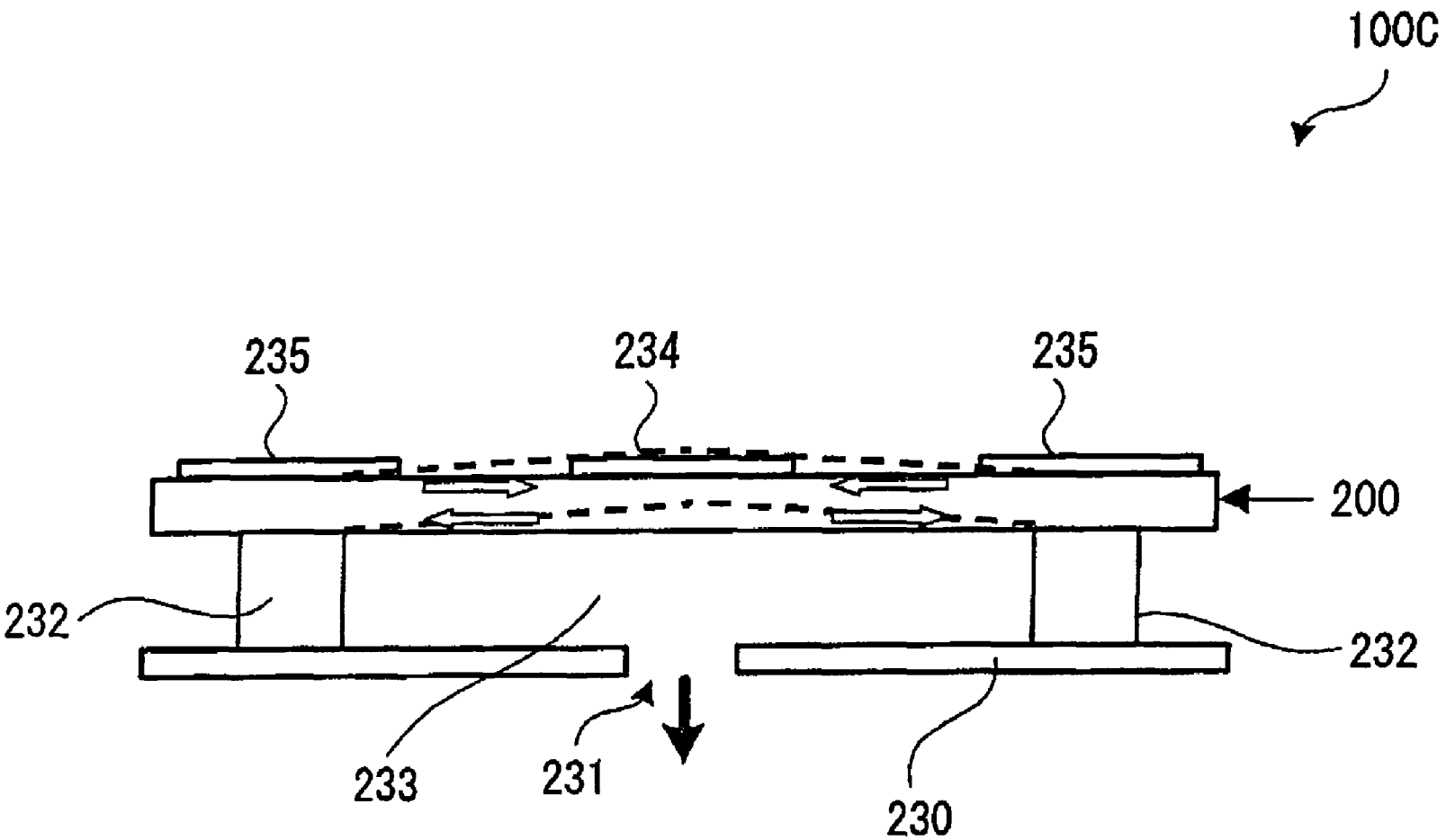
FIG. 36 is a cross sectional view schematically showing an example of still another configuration of the ink jet head of the invention.

Likewise, an ink jet head 100C shown in FIG. 36 is one that ejects ink (liquid material) within a cavity 233 through a nozzle 231 when the piezoelectric element 200 is driven. The ink jet head 100C is provided with a nozzle plate 230 in which the nozzle 231 is formed, spacers 232, and the piezoelectric element 200. The piezoelectric element 200 is placed to be spaced apart from the nozzle plate 230 by a predetermined distance with the spacers 232 in between, and the cavity 233 is defined by a space surrounded by the nozzle plate 230, the piezoelectric element 200, and the spacers 232.

A plurality of electrodes are bonded to the top surface of the piezoelectric element 200 in FIG. 36. To be more specific, a first electrode 234 is bonded to a substantially central portion of the piezoelectric element 200, and second electrodes 235 are bonded on both sides thereof. When a predetermined driving voltage waveform is applied between the first electrode 234 and the second electrodes 235, the piezoelectric element 200 undergoes share-mode deformation and starts to vibrate (indicated by arrows of FIG. 36). The volume of the cavity 233 (internal pressure of cavity 233) varies with the vibration, and ink (liquid material) filled in the cavity 233 is thereby ejected through the nozzle 231 in the form of droplets. In other words, the piezoelectric element 200 per se functions as the diaphragm in the ink jet head 100C.

Figure 37:
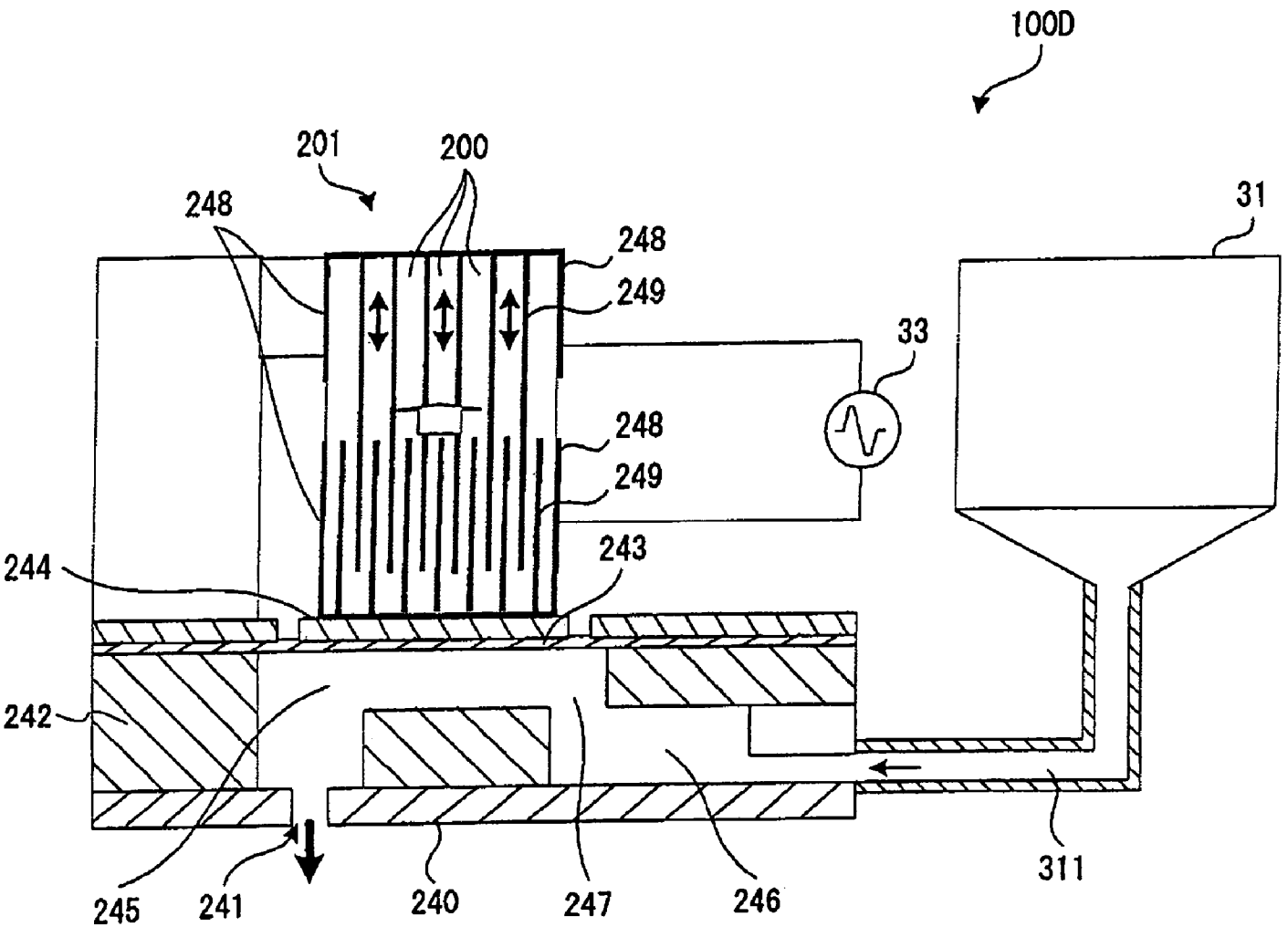
FIG. 37 is a cross sectional view schematically showing an example of still another configuration of the ink jet head of the invention.

Likewise, an ink jet head 100D shown in FIG. 37 is one that ejects ink (liquid material) within a cavity 245 through a nozzle 241 when the piezoelectric element 200 is driven. The ink jet head 100D is provided with a nozzle plate 240 in which the nozzle 241 is formed, a cavity plate 242, a diaphragm 243, and a layered piezoelectric element 201 comprising a plurality of piezoelectric elements 200 to be layered.

The cavity plate 242 is molded into a predetermined shape (a shape in which a concave portion is formed), by which the cavity 245 and a reservoir 246 are defined. The cavity 245 and the reservoir 246 communicate with each other via an ink supply port 247. Further, the reservoir 246 communicates with an ink cartridge 31 via an ink supply tube 311.

The lower end of the layered piezoelectric element 201 in FIG. 37 is bonded to the diaphragm 243 via an intermediate layer 244. A plurality of external electrodes 248 and internal electrodes 249 are bonded to the layered piezoelectric element 201. To be more specific, the external electrodes 248 are bonded to the outer surface of the layered piezoelectric element 201 and the internal electrodes 249 are provided in spaces between piezoelectric elements 200, which together form the layered piezoelectric element 201 (or inside each piezoelectric element). In this case, the external electrodes 248 and the internal electrodes 249 are placed so that parts of them are alternately layered in the thickness direction of the piezoelectric element 200.

By applying a driving voltage waveform between the external electrodes 248 and the internal electrodes 249 by the head driver 33, the layered piezoelectric element 201 undergoes deformation (contracts in the vertical direction of FIG. 37) and starts to vibrate as indicated by arrows in FIG. 37, whereby the diaphragms 243 undergoes vibration due to this vibration. The volume of the cavity 245 (internal pressure of cavity 245) varies with the vibration of the diaphragm 243, and ink (liquid material) filled in the cavity 245 is thereby ejected through the nozzle 241 in the form of droplets.

A reduced quantity of liquid (ink) in the cavity 245 due to the ejection of droplets is replenished with ink supplied from the reservoir 246. Further, ink is supplied to the reservoir 246 from the ink cartridge 31 through the ink supply tube 311.

As with the electric capacitance type of ink jet head 100 as described above, the ink jet heads 100A through 100D provided with piezoelectric elements are also able to detect an ejection failure of droplets and identify the cause of the ejection failure on the basis of the residual vibration of the diaphragm or the piezoelectric element functioning as the diaphragm. Alternatively, the ink jet heads 100B and 100C may be provided with a diaphragm (diaphragm used to detect the residual vibration) serving as a sensor at a position facing the cavity, so that the residual vibration of this diaphragm is detected.

Figure 38:
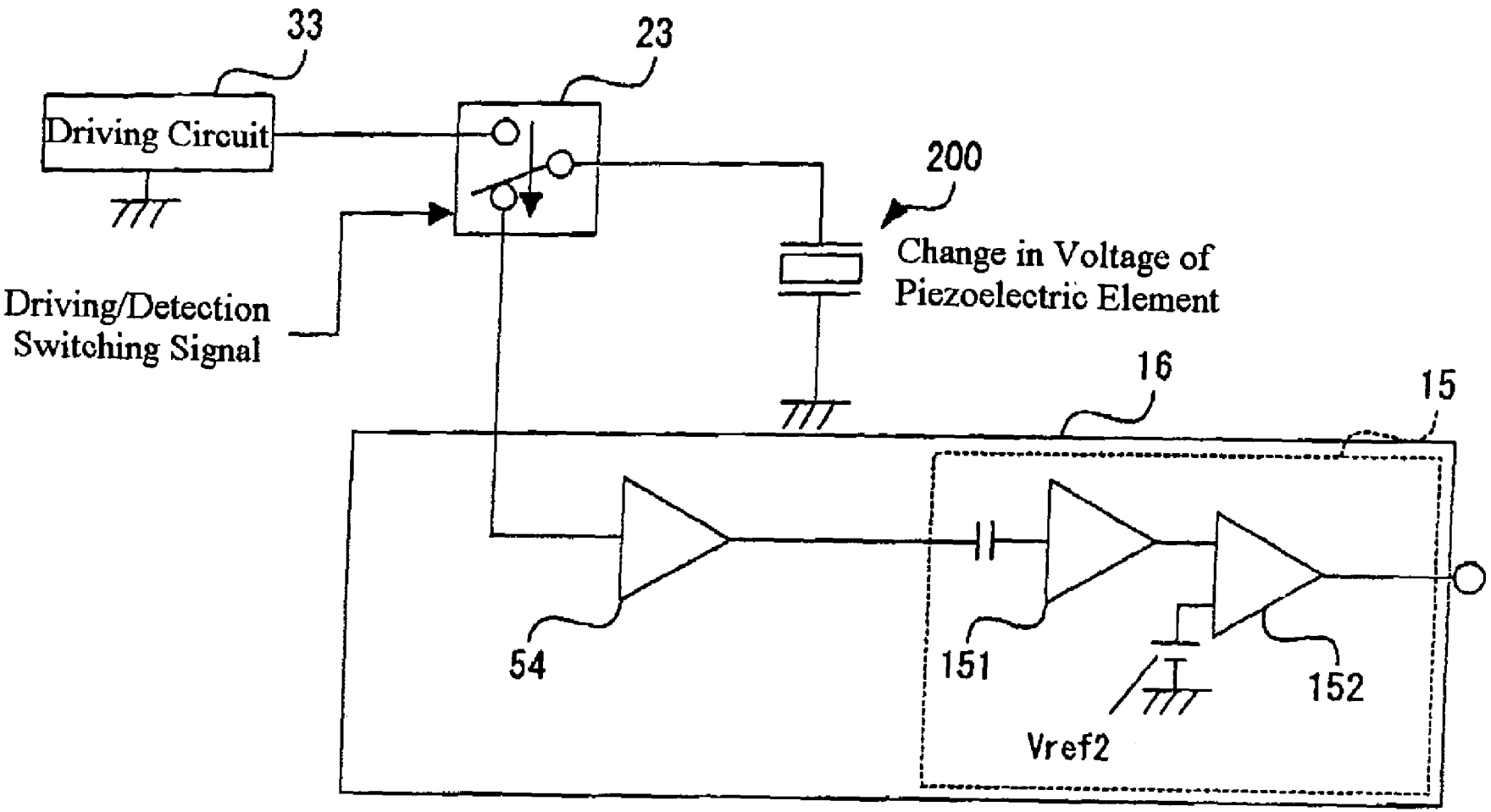
FIG. 38 is a block diagram schematically showing switching means between the driving circuit and detecting circuit in the case of using a piezoelectric actuator.

FIG. 38 is a block diagram schematically showing switching means 23 between the driving circuit 18 and detecting circuit (herein, residual vibration detecting means) 16 in the case of using a piezoelectric actuator (piezoelectric element 200). By having such a structure, the electromotive voltage of the piezoelectric element 200 in the piezoelectric actuator after the ejection driving operation can be inputted into a waveform shaping circuit 15 via a buffer 54, and a rectangular waveform can be shaped by the waveform shaping circuit 15. Therefore, by using the electromotive voltage of the piezoelectric element 200, it is possible to carry out the same ejection failure detecting processing as that in the first embodiment described above.

As described above, in the droplet ejection apparatus and the method of detecting an ejection failure in the droplet ejection heads of the invention, when the operation in which liquid is ejected from a droplet ejection head in the form of droplets was carried out by driving an electrostatic actuator or a piezoelectric actuator, the residual vibration of a diaphragm displaced by the actuator or the electromotive voltage of the piezoelectric element is detected, and it is detected whether or not the droplet has been normally ejected (normal ejection or ejection failure) on the basis of the residual vibration of the diaphragm or the electromotive voltage of the piezoelectric element.

Further, in the invention, a cause of the ejection failure of the droplets is judged on the basis of a vibration pattern of the residual vibration of the diaphragm (for example, a cycle of a residual vibration waveform) or a voltage pattern of the electromotive voltage of the piezoelectric element.

Therefore, according to the invention, compared with the conventional droplet ejection apparatus capable of detecting an ejection failure (missing dot), the droplet ejection apparatus of this embodiment as described above does not need other parts (for example, optical missing dot detecting device or the like). As a result, not only an ejection failure of the droplets can be detected without increasing the size of the droplet ejection head, but also the manufacturing costs thereof can be reduced. In addition, in the droplet ejection apparatus of the invention, because the droplet ejection apparatus of the invention detects an ejection failure of the droplets through the use of the residual vibration of the diaphragm after the droplet ejection operation, an ejection failure of the droplets can be detected even during the printing operation.

Further, according to the invention, it is possible to judge a cause of an ejection failure of droplets, which the apparatus such as an optical detecting apparatus capable of carrying out a conventional missing dot detection operation cannot judge. Therefore, it is possible to select and carry out appropriate recovery processing in accordance with the cause if needed.

The droplet ejection apparatus and the method of detecting an ejection failure in the droplet ejection heads of the invention have been described based on embodiments shown in the drawings, but it is to be understood that the invention is not limited to these embodiments, and respective portions forming the droplet ejection head or the droplet ejection apparatus can be replaced with an arbitrary arrangement capable of functioning in the same manner. Further, any other arbitrary component may be added to the droplet ejection head or the droplet ejection apparatus of the invention.

Liquid to be ejected (droplets) that is ejected from a droplet ejection head (ink jet head 100 in the embodiments described above) in the droplet ejection apparatus of the invention is not particularly limited, and for example, it may be liquid (including dispersion liquid such as suspension and emulsion) containing various kinds of materials as follows. Namely, a filter material (ink) for a color filter, a light-emitting material for forming an EL (Electroluminescence) light-emitting layer in an organic EL apparatus, a fluorescent material for forming a fluorescent body on an electrode in an electron emitting device, a fluorescent material for forming a fluorescent body in a PDP (Plasma Display Panel) apparatus, a migration material forming a migration body in an electrophoresis display device, a bank material for forming a bank on the surface of a substrate W, various kinds of coating materials, a liquid electrode material for forming an electrode, a particle material for forming a spacer to provide a minute cell gap between two substrates, a liquid metal material for forming metal wiring, a lens material for forming a microlens, a resist material, a light-scattering material for forming a light-scattering body, liquid materials for various tests used in a bio-sensor such as a DNA chip and a protein chip, and the like may be mentioned.

Further, in the invention, a droplet receptor to which droplets are ejected is not limited to paper such as a recording sheet, and it may be other media such as a film, a woven cloth, a non-woven cloth or the like, or a workpiece such as various types of substrates including a glass substrate, a silicon substrate and the like.

This application claims priority to Japanese Patent Application No.2003-092935 filed Mar. 28, 2003, which is hereby expressly incorporated by reference herein in its entirety.

What is claimed is:

1. A droplet ejection apparatus comprising:

a plurality of droplet ejection heads, each of the droplet ejection heads including:

a diaphragm;

an actuator which displaces the diaphragm;

a cavity filled with a liquid, an internal pressure of the cavity being increased and decreased in response to displacement of the diaphragm; and a nozzle communicated with the cavity, through which the liquid is ejected in the form of droplets in response to the increase and decrease of the internal pressure of the cavity;

a driving circuit which drives the actuator of each droplet ejection head;

a pulse generating unit for generating reference pulses;

a counter for counting a number of reference pulses generated for a predetermined time period;

an ejection failure detecting unit for detecting an ejection failure of the droplets on the basis of a count value of the counter counted for the predetermined time period; and a switching unit for switching a connection of the actuator from the driving circuit to the ejection failure detecting unit after carrying out a droplet ejection operation by driving the actuator;

wherein the ejection failure detecting unit detects presence or absence of the ejection failure by comparing a normal count range of the reference pulses when a droplet is normally ejected by the driving of the actuator with a count value of the counter counted for the predetermined time period.

2. The droplet ejection apparatus as claimed in claim 1, wherein the predetermined time period is a time period until a residual vibration of the diaphragm displaced by the actuator is generated after a droplet has been normally ejected from the droplet ejection head.

3. The droplet ejection apparatus as claimed in claim 1, wherein the predetermined time period is a time period corresponding to a first half cycle of a residual vibration.

4. The droplet ejection apparatus as claimed in claim 1, wherein the predetermined time period is a time period corresponding to a first one cycle of a residual vibration.

5. The droplet ejection apparatus as claimed in claim 1, wherein the ejection failure detecting unit judges that an air bubble has been intruded into the cavity as a cause of the ejection failure in the case where the count value is smaller than the normal count range.

6. The droplet ejection apparatus as claimed in claim 1, wherein the ejection failure detecting unit judges that the liquid in the vicinity of the nozzle has thickened due to drying or that paper dust is adhering in the vicinity of an outlet of the nozzle as a cause of the ejection failure in the case where the count value is larger than the normal count range.

7. The droplet ejection apparatus as claimed in claim 1, further comprising storage unit for storing a detection result detected by the ejection failure detecting unit.

8. The droplet ejection apparatus as claimed in claim 1, wherein the actuator includes an electrostatic actuator.

9. The droplet ejection apparatus as claimed in claim 1, wherein the actuator includes a piezoelectric actuator having a piezoelectric element and using a piezoelectric effect of the piezoelectric element.

10. The droplet ejection apparatus as claimed in claim 1, wherein the droplet ejection apparatus includes an ink jet printer.

11. The droplet ejection apparatus as claimed in claim 1, wherein the ejection failure detecting unit includes an oscillation circuit and the oscillation circuit oscillates in response to an electric capacitance component of the actuator that varies with a residual vibration of the diaphragm.

12. The droplet ejection apparatus as claimed in claim 11, wherein the ejection failure detecting unit includes a resistor element connected to the actuator, and the oscillation circuit forms a CR oscillation circuit based on the electric capacitance component of the actuator and a resistance component of the resistor element.

13. The droplet ejection apparatus as claimed in claim 11, wherein the ejection failure detecting unit includes an F/V converting circuit that generates a voltage waveform in response to the residual vibration of the diaphragm from a predetermined group of signals generated based on changes in an oscillation frequency of an output signal from the oscillation circuit.

14. The droplet ejection apparatus as claimed in claim 13, wherein the ejection failure detecting unit includes a waveform shaping circuit that shapes the voltage waveform in response to the residual vibration of the diaphragm generated by the F/V converting circuit into a predetermined waveform.

15. The droplet ejection apparatus as claimed in claim 14, wherein the waveform shaping circuit includes: a DC component eliminating unit for eliminating a direct current component from the voltage waveform of the residual vibration of the diaphragm generated by the F/V converting circuit; and a comparator that compares the voltage waveform from which the direct current component thereof has been eliminated by the DC component eliminating unit with a predetermined voltage value; and wherein the comparator generates and outputs a rectangular wave based on this voltage comparison.

16. A droplet ejection apparatus comprising:

a plurality of droplet ejection heads, each of the droplet ejection heads including:

a diaphragm;

an actuator which displaces the diaphragm;

a cavity filled with a liquid, an internal pressure of the cavity being increased and decreased in response to displacement of the diaphragm; and a nozzle communicated with the cavity, through which the liguid is ejected in the form of droplets in response to the increase and decrease of the internal pressure of the cavity;

a driving circuit which drives the actuator of each droplet ejection head;

a pulse generating unit for generating reference pulses;

a counter for counting a number of reference pulses generated for a predetermined time period;

an ejection failure detecting unit for detecting an ejection failure of the droplets on the basis of a count value of the counter counted for the predetermined time period; and a switching unit for switching a connection of the actuator from the driving circuit to the ejection failure detecting unit after carrying out a droplet ejection operation by driving the actuator;

wherein the counter subtracts the number of reference pulses counted for the predetermined time period from a predetermined reference value, and the ejection failure detecting unit detects the ejection failure on the basis of a subtraction result.

17. The droplet ejection apparatus as claimed in claim 16, wherein the ejection failure detecting unit judges that an air bubble has intruded into the cavity as a cause of the ejection failure in the case where the subtraction result is smaller than a first threshold.

18. The droplet ejection apparatus as claimed in claim 16, wherein the ejection failure detecting unit judges that the liquid in the vicinity of the nozzle has thickened due to drying as a cause of the ejection failure in the case where the subtraction result is larger than a second threshold.

19. The droplet ejection apparatus as claimed in claim 18, wherein the ejection failure detecting unit judges that paper dust is adhering in the vicinity of the outlet of the nozzle as a cause of the ejection failure in the case where the subtraction result is smaller than the second threshold and larger than a third threshold.

* * * * *